US008462012B2

(12) United States Patent
Clark et al.

(10) Patent No.: US 8,462,012 B2
(45) Date of Patent: Jun. 11, 2013

(54) ANTI-COLLISION METHOD FOR DRILLING WELLS

(75) Inventors: Brian Oliver Clark, Sugar Land, TX (US); Wayne J. Phillips, Houston, TX (US); Benny Poedjono, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 258 days.

(21) Appl. No.: 12/668,476

(22) PCT Filed: Jun. 24, 2008

(86) PCT No.: PCT/US2008/067976

§ 371 (c)(1), (2), (4) Date: Jul. 7, 2010

(87) PCT Pub. No.: WO2009/014838

PCT Pub. Date: Jan. 29, 2009

(65) Prior Publication Data

US 2010/0271232 A1 Oct. 28, 2010

Related U.S. Application Data

(60) Provisional application No. 60/951,145, filed on Jul. 20, 2007.

(51) Int. Cl.
*G01V 3/00* (2006.01)

(52) U.S. Cl.
USPC ..... 340/853.2; 340/853.1; 340/853.5

(58) Field of Classification Search
USPC ..... 340/853.1, 853.2, 853.4, 853.5; 166/245; 175/61
See application file for complete search history.

(56) References Cited

U.S. PATENT DOCUMENTS

| | | | |
|---|---|---|---|
| 4,323,848 | A | 4/1982 | Kuckes |
| 4,372,398 | A | 2/1983 | Kuckes |
| 4,446,762 | A | 5/1984 | Junkers |
| 4,529,939 | A | 7/1985 | Kuckes |
| 4,593,770 | A | 6/1986 | Hoehn |
| 4,700,142 | A | 10/1987 | Kuckes |
| 4,791,373 | A | 12/1988 | Kuckes |
| 4,845,434 | A | 7/1989 | Kuckes |
| 4,933,640 | A | 6/1990 | Kuckes |

(Continued)

OTHER PUBLICATIONS

Walstrom, J.E. et al., An Analysis of Uncertainty in Directional Surveying, Journal of Petroleum Technology, Apr. 1969; pp. 515-523.

(Continued)

*Primary Examiner* — Peguy Jean Pierre
(74) *Attorney, Agent, or Firm* — Kimberly Ballew

(57) ABSTRACT

Methods for drilling a new well in a field having a plurality of existing cased wells using magnetic ranging while drilling are provided. In accordance with one embodiment, a method of drilling a new well in a field having an existing cased well includes drilling the new well using a bottom hole assembly (BHA) having a drill collar having by an insulated gap, generating a current on the BHA while drilling the new well, such that some of the current passes through a surrounding formation and travels along a casing of the existing cased well, measuring from the BHA a magnetic field caused by the current traveling along the casing of the existing cased well, and adjusting a trajectory of the BHA to avoid a collision between the new well and the existing cased well based on measurements of the magnetic field.

25 Claims, 33 Drawing Sheets

U.S. PATENT DOCUMENTS

| | | | | |
|---|---|---|---|---|
| 4,957,172 | A | 9/1990 | Patton | |
| 5,074,365 | A | 12/1991 | Kuckes | |
| 5,131,477 | A | 7/1992 | Stagg | |
| 5,218,301 | A | 6/1993 | Kuckes | |
| 5,258,755 | A | 11/1993 | Kuckes | |
| 5,305,212 | A | 4/1994 | Kuckes | |
| 5,323,856 | A | 6/1994 | Davis | |
| 5,343,152 | A | 8/1994 | Kuckes | |
| 5,485,089 | A | 1/1996 | Kuckes | |
| 5,512,830 | A | 4/1996 | Kuckes | |
| 5,513,710 | A | 5/1996 | Kuckes | |
| 5,515,931 | A | 5/1996 | Kuckes | |
| 5,589,775 | A | 12/1996 | Kuckes | |
| 5,657,826 | A | 8/1997 | Kuckes | |
| 5,676,212 | A | 10/1997 | Kuckes | |
| 5,725,059 | A | 3/1998 | Kuckes et al. | |
| 5,923,170 | A | 7/1999 | Kuckes | |
| 5,960,370 | A | 9/1999 | Towle et al. | |
| 6,484,819 | B1 * | 11/2002 | Harrison | 175/61 |
| 6,619,393 | B1 * | 9/2003 | Olivera | 166/245 |
| 6,736,221 | B2 * | 5/2004 | Chia et al. | 175/45 |
| 7,703,548 | B2 | 4/2010 | Clark et al. | |
| 7,878,268 | B2 * | 2/2011 | Chapman et al. | 175/57 |
| 7,886,844 | B2 * | 2/2011 | Phillips | 175/24 |
| 7,962,287 | B2 | 6/2011 | Clark | |
| 2002/0112856 | A1 | 8/2002 | Van Steenwyk | |
| 2002/0130663 | A1 | 9/2002 | Kuckes | |
| 2003/0085059 | A1 | 5/2003 | Kuckes et al. | |
| 2003/0188891 | A1 | 10/2003 | Kuckes | |
| 2004/0040745 | A1 | 3/2004 | Kuckes | |
| 2004/0069514 | A1 * | 4/2004 | Rodney et al. | 174/35 R |
| 2005/0211469 | A1 | 9/2005 | Kuckes et al. | |
| 2006/0028321 | A1 | 2/2006 | Kennedy et al. | |
| 2006/0065441 | A1 | 3/2006 | Kuckes | |
| 2006/0066454 | A1 | 3/2006 | Kuckes et al. | |
| 2006/0131013 | A1 | 6/2006 | McElhinney | |
| 2007/0126426 | A1 | 6/2007 | Clark et al. | |
| 2008/0041626 | A1 * | 2/2008 | Clark | 175/45 |
| 2009/0030615 | A1 | 1/2009 | Clark | |
| 2009/0260879 | A1 * | 10/2009 | Clark et al. | 175/45 |

OTHER PUBLICATIONS

Williamson, H.S., Accuracy Prediction for Directional Measurement While Drilling, SPE Drilling and Completion, vol. 15, No. 4; Dec. 2000, pp. 221-233.

Wolff, C.J.M. et al., Borehole Position Uncertainty—Analysis of Measuring Methods and Derivation of Systematic Error Model, Journal of Petroleum Technology, Dec. 1981, pp. 2330-2350.

Numerical Recipes in C, 2nd Edition, W.H. Press et al., Cambridge University Press, 1997, Section 15.6.

* cited by examiner

FIG. 3
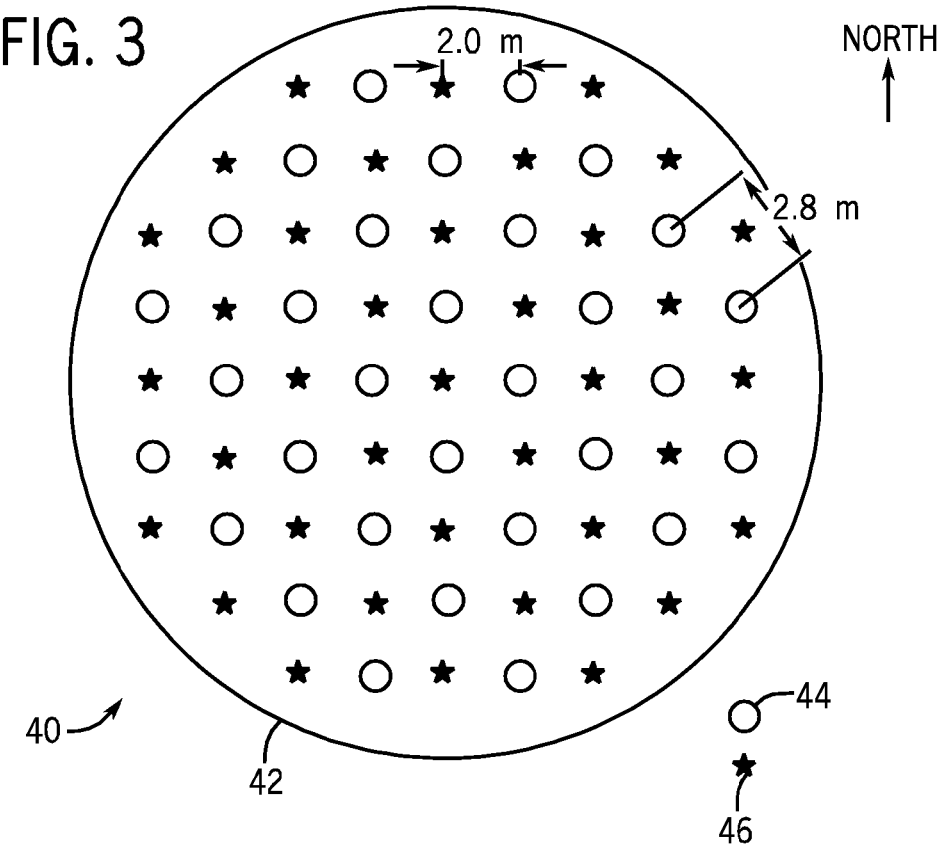
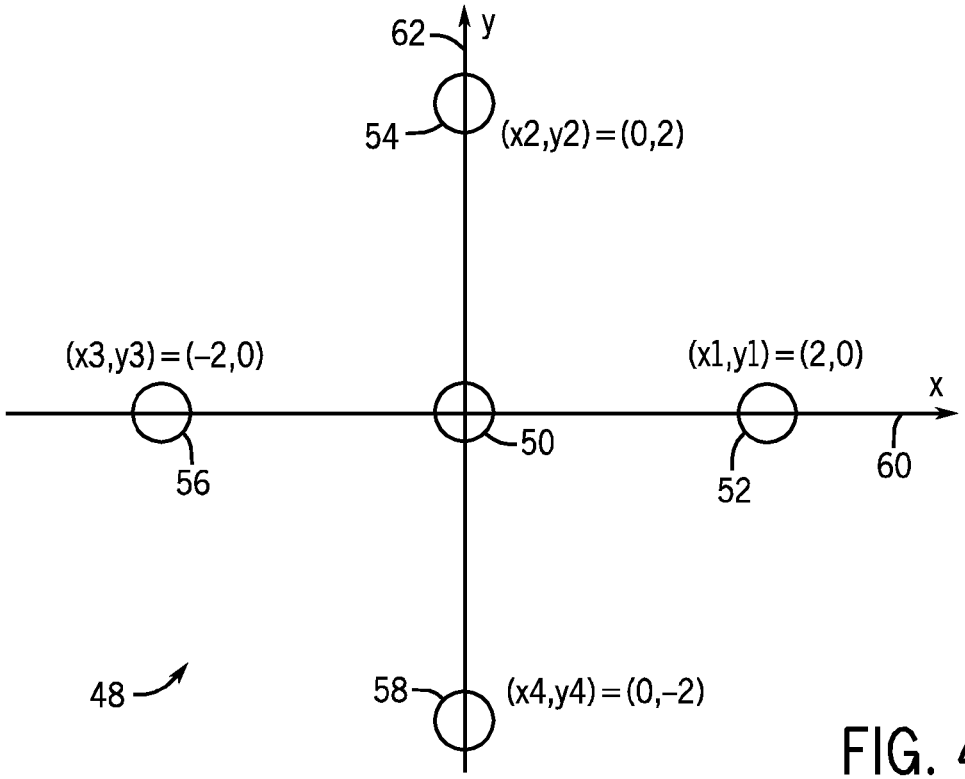
FIG. 4

2.500–3.000 2.000–2.500 1.500–2.000

1.000–1.500 0.500–1.000 0.000–0.500

FIG. 27
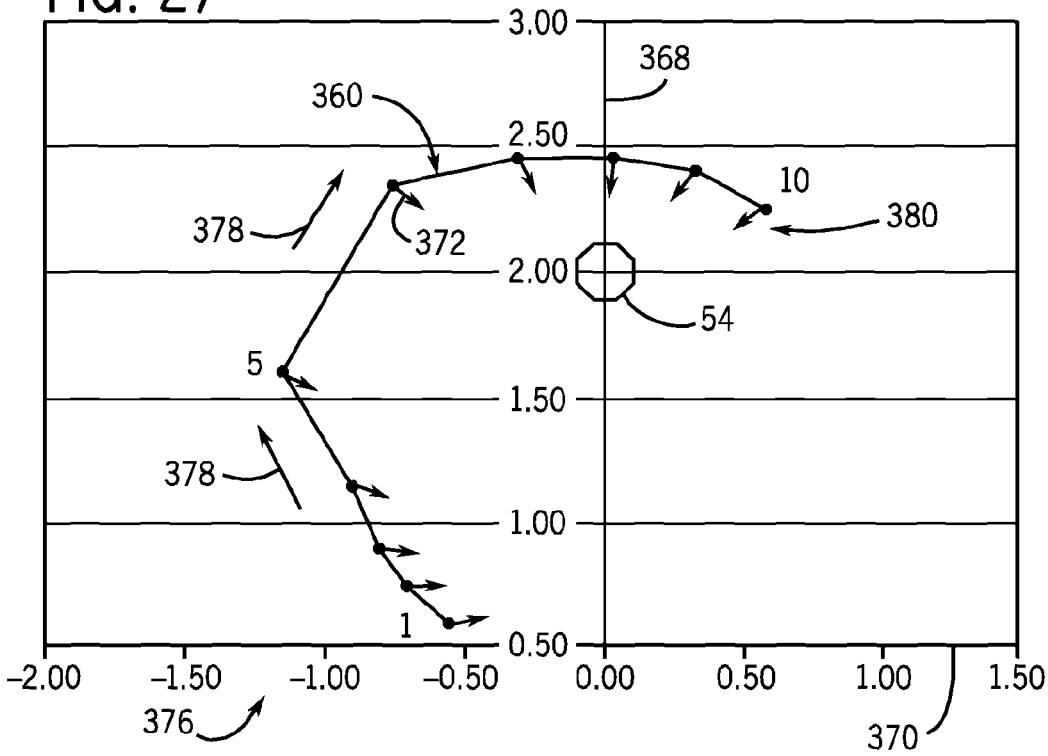
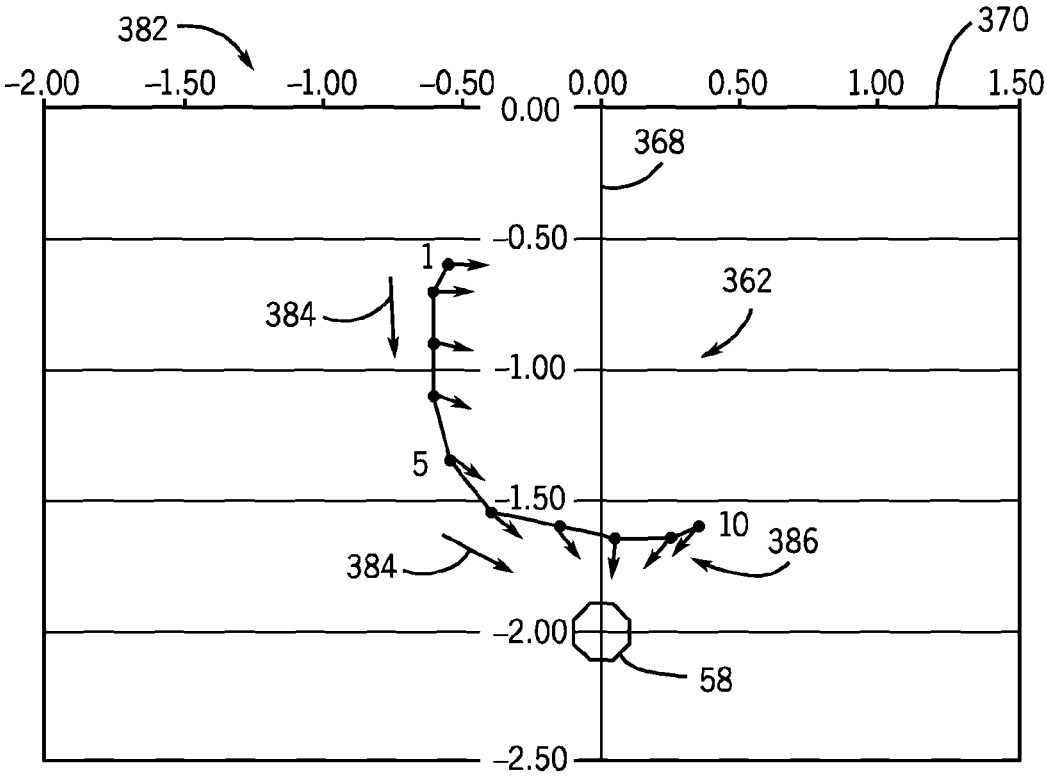
FIG. 28

1) DEFINE LOCATIONS OF CASED WELLS VERSUS DEPTH: $\vec{r}_i = (x_i, y_i, z_i)$, FOR $i = \{1, 2, 3, \ldots, n\}$, WHERE $\vec{r}_i$ IS THE ASSUMED LOCATION OF THE $i^{th}$ CASED WELL. THE $\{\vec{r}_i\}$ WILL REMAIN FIXED THROUGH-OUT THE PROCEDURE. DEFINE DIAMETER OF EACH CASED WELLS: Di — 390

↓

2) FOR A GIVEN DEPTH $z_m$, ASSUME A LOCATION FOR THE MAGNETOMETER, i.e. $\vec{r}_m = (x_m, y_m, z_m)$ ($x_m$ AND $y_m$ WILL BE INCREMENTED OVER A RANGE OF VALUES.) — 392

↓

3) COMPUTE THE CONDUCTANCE BETWEEN THE BHA AND EACH CASED WELLS:

$$\text{e.g. } Gi = \frac{\pi\sigma}{\cosh^{-1}(S_i/D)}, \text{ WHERE } S_i = \sqrt{(x_m - x_i)^2 + (y_m - y_i)^2}.$$

COMPUTE THE CONDUCTANCE BETWEEN EACH PAIR OF CASED WELLS. INCLUDE FORMATION RESISTIVITY, CEMENT RESISTIVITY, AND BEDDING. — 394

↓

4) COMPUTE THE CURRENT ON EACH CASING, Ii, FOR THE ASSUMED POSITION OF THE BHA $\vec{r}_m$ — 396

↓

5) COMPUTE THE MAGNETIC FIELD AT THE MAGNETOMETER FOR THE ASSUMED BHA POSITION $\vec{r}_m$, $$\text{e.g. } \vec{B}(x_m, y_m, z_m) = \sum_{i=1}^{n} \vec{B}i(x_m, y_m, z_m) = \sum_{i=1}^{n} \frac{\mu_0 \, Ii(z_m)}{2\pi \, Si^2} \hat{n} \times (\vec{r}_m - \vec{r}_i)$$

WHERE $\hat{n}$ IS A UNIT VECTOR IN THE DIRECTION OF THE $i^{th}$ WELL — 398

↓

6) MEASURE THE INDUCED MAGNETIC FIELD WITH THE 3-AXIS MAGNETOMETER TO OBTAIN THE QUANTITIES: $\vec{\beta}(x, y, z) = \beta x(x, y, z)\hat{x} + \beta y(x, y, z)\hat{y} + \beta z(x, y, z)\hat{z}$, WHERE $\vec{r} = (x, y, z)$ IS THE ACTUAL POSITION OF THE BHA WHICH IS TO BE DETERMINED. — 400

↓

388 ↗ TO FIG. 29B

FIG. 29A

1) DEFINE LOCATIONS OF CASED WELLS VERSUS DEPTH: $\vec{r}_i = (x_i, y_i, z_i)$, FOR $i = \{1, 2, 3, \ldots, n\}$, WHERE $\vec{r}_i$ IS THE ASSUMED LOCATION OF THE $i^{th}$ CASED WELL. THE $\{\vec{r}_i\}$ WILL REMAIN FIXED THROUGH-OUT THE PROCEDURE. DEFINE DIAMETER OF EACH CASED WELLS: Di. — 462

↓

2) DRILL DOWN TO A DEPTH $z_m$ — 464

↓

3) FROM THE MWD SURVEY DATA (i.e. DIRECTION, INCLINATION, AND DEPTH), OBTAIN THE PROBABILITY DISTRIBUTION FUNCTION, $F(x, y) = \frac{1}{2\pi\tilde{\sigma}^2} \text{EXP}\left\{-\frac{(x-x')^2}{2\tilde{\sigma}^2} - \frac{(y-y')^2}{2\tilde{\sigma}^2}\right\}$, AT THE GIVEN DEPTH $z_m$, WHERE $\vec{r}' = (x', y', z_m)$ IS THE MOST LIKELY POSITION DETERMINED BY THE SURVEY DATA, WHERE $\tilde{\sigma} = \sqrt{\sigma^2 + \sigma_i^2}$, WHERE $\sigma$ IS THE STANDARD DEVIATION IN THE x–y PLANE FOR THE BHA AND WHERE $\sigma_i$ IS THE STANDARD DEVIATION FOR THE SURVEY DATA FOR THE CASED WELLS. — 466

↓

4) FOR A GIVEN DEPTH $z_m$, ASSUME A LOCATION FOR THE MAGNETOMETER, i.e. $\vec{r}_m = (x_m, y_m, z_m)$. ($x_m$ AND $y_m$ WILL BE INCREMENTED OVER A RANGE OF VALUES) — 468

↓

5) COMPUTE THE CONDUCTANCE BETWEEN THE BHA AND EACH CASED WELLS:

e.g. $Gi = \frac{\pi\sigma}{\cosh^{-1}(S_i/D)}$, WHERE $S_i = \sqrt{(x_m - x_i)^2 + (y_m - y_i)^2}$ COMPUTE THE CONDUCTANCE BETWEEN EACH PAIR OF CASED WELLS. INCLUDE FORMATION RESISTIVITY, CEMENT RESISTIVITY, AND BEDDING. — 470

↓

TO FIG. 34B

460

FIG. 34A

FROM FIG. 34A

6) COMPUTE THE CURRENT ON EACH CASING, Ii, FOR THE ASSUMED POSITION OF THE BHA $\vec{r}_m$ — 472

7) COMPUTE THE MAGNETIC FIELD AT THE MAGNETOMETER FOR THE ASSUMED BHA POSITION $\vec{r}_m$, e.g. $\vec{B}(x_m, y_m, z_m) = \sum_{i=1}^{n} \vec{B}i(x_m, y_m, z_m) = \sum_{i=1}^{n} \frac{\mu_0 \, Ii(z_m)}{2\pi \, Si^2} \hat{n} \times (\vec{r}_m - \vec{r}_i)$ WHERE $\hat{n}$ IS A UNIT VECTOR IN THE DIRECTION OF THE $i^{th}$ WELL. — 474

8) MEASURE THE INDUCED MAGNETIC FIELD WITH THE 3-AXIS MAGNETOMETER TO OBTAIN THE QUANTITIES:

$\vec{\beta}(x, y, z) = \beta x(x, y, z)\hat{x} + \beta y(x, y, z)\hat{y} + \beta z(x, y, z)\hat{z}$, WHERE $\vec{r} = (x, y, z)$ IS THE ACTUAL POSITION OF THE BHA WHICH IS TO BE DETERMINED. — 476

9) COMPUTE THE QUANTITY $Q(x_m, y_m, z_m) =$ $\xi(x_m, y_m, z_m) \rightarrow Q(x_m, y_m, z_m) / \sigma_B =$ $$\sqrt{[\beta x(x, y, z) - Bx(x_m, y_m, z_m)]^2 + [\beta y(x, y, z) - By(x_m, y_m, z_m)]^2 + [\beta z(x, y, z) - Bz(x_m, y_m, z_m)]^2} \Big/ \sigma_B$$

FOR THE ASSUMED LOCATION FOR BHA $\vec{r}_m$ — 478

10) INCREMENT THE VALUE FOR $x_m$ BY $\Delta x$ AND RETURN TO STEP 4 UNLESS THE MAXIMUM VALUE FOR $x_m$ HAS BEEN REACHED. IF SO, PROCEED TO STEP 11. — 480

460

TO FIG. 34C

FIG. 34B

ANTI-COLLISION METHOD FOR DRILLING WELLS

BACKGROUND OF THE INVENTION

The present invention relates generally to well drilling operations and, more particularly, to well drilling operations using magnetic ranging while drilling to avoid collisions with existing cased wells.

With conventional drilling practices, the uncertainties in a well's position increase as the depth of the well increases. These uncertainties are usually represented as ellipsoids that are centered on the location of the well as determined by Measurement While Drilling (MWD) or wireline survey data. An ellipsoid corresponds to a certain probability density corresponding to whether the well bore is actually located within the ellipsoid. The uncertainties in the well position arise from the limited accuracy of the well bore direction, inclination, and depth measurements which may be obtained from MWD and/or wireline surveys, as documented extensively. For example, MWD inclination measurements are typically accurate to no better than 0.1°, while MWD directional measurements are typically accurate to no better than 1°. Moreover, MWD survey points may be acquired only once every 90 feet in practice. Thus, under-sampling may significantly increase the actual errors in the well position.

An additional source of survey error arises because the directional measurement is based on the magnetic field, which requires correction for variations in the Earth's magnetic field, and which can also be strongly perturbed by nearby casing. If the casings are very close to the well path, then the MWD directional measurement may not even be useful. Under such conditions, a gyro may be used to provide the directional information. The gyro may be run with the MWD tool, or it may be run on wireline with periodic descents inside the drill pipe to the bottom hole assembly (BHA). Finally, an accurate MWD depth measurement is difficult to achieve, with depth errors of 1/1000 common.

Further complications may arise in older fields with existing wells. In older fields, the survey information on existing wells may be very low quality, survey data may have been lost, or the wells may have been drilled without running a MWD or wireline survey.

Wells associated with a typical offshore platform are drilled vertically for a considerable depth before they are deviated to reach distant portions of the reservoir. These vertical sections typically range from several hundred feet to a few thousand feet before they reach the kick-off point (KOP) where directional drilling begins. Because offshore production platforms are very expensive and have as many wells as possible given the limited surface area of the platform, well heads are packed as closely as possible. The distances between well heads, and therefore the number of wells, are limited primarily by the uncertainty in well positions and the risk of accidentally drilling into a cased well. Since an existing cased well and the drill bit could be located anywhere inside the respective ellipsoids of uncertainty, well heads are spaced a distance apart so that any two ellipsoids cannot overlap.

Existing platforms may have filled many or all of the available slots (i.e., locations for well heads) based on factors derived from MWD direction and inclination technology. In order to tap additional oil or gas resources, new wells may be drilled. Unless there is a reliable method to avoid drilling into an existing well, another platform may have to be built. However, if one could thread new wells among the existing wells without risk of collision, then a new platform may not be needed.

SUMMARY

Certain aspects commensurate in scope with the originally claimed invention are set forth below. It should be understood that these aspects are presented merely to provide the reader with a brief summary of certain forms of the invention might take and that these aspects are not intended to limit the scope of the invention. Indeed, the invention may encompass a variety of aspects that may not be set forth below.

In accordance with one embodiment of the invention, a method of drilling a new well in a field having an existing cased well includes drilling the new well using a bottom hole assembly (BHA) having a drill collar having by an insulated gap, generating a current on the BHA while drilling the new well, such that some of the current passes through a surrounding formation and travels along a casing of the existing cased well, measuring from the BHA a magnetic field caused by the current traveling along the casing of the existing cased well, and adjusting a trajectory of the BHA to avoid a collision between the new well and the existing cased well based on measurements of the magnetic field. The relative position of the new well to the existing well may be estimated based on measurements of the magnetic field. An alarm may be triggered if an apparent distance between the new well and the existing cased well approaches less than a threshold distance.

BRIEF DESCRIPTION OF THE DRAWINGS

Advantages of the invention may become apparent upon reading the following detailed description and upon reference to the drawings in which:

FIG. 3 is a schematic of a well slot pattern on an offshore platform depicting locations for additional wells available for drilling in accordance with an embodiment of the invention;

FIG. 4 is a schematic diagram depicting a location for a new well amid existing wells in accordance with an embodiment of the invention;

FIG. 27 is a plot indicating a ghost image trajectory of the plan view of FIG. 25 with apparent directions illustrated as arrows;

FIG. 28 is a plot indicating a second ghost image trajectory of the plan view of FIG. 25 with apparent directions illustrated as arrows;

DETAILED DESCRIPTION OF SPECIFIC EMBODIMENTS

One or more specific embodiments of the present invention are described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Figure 1:
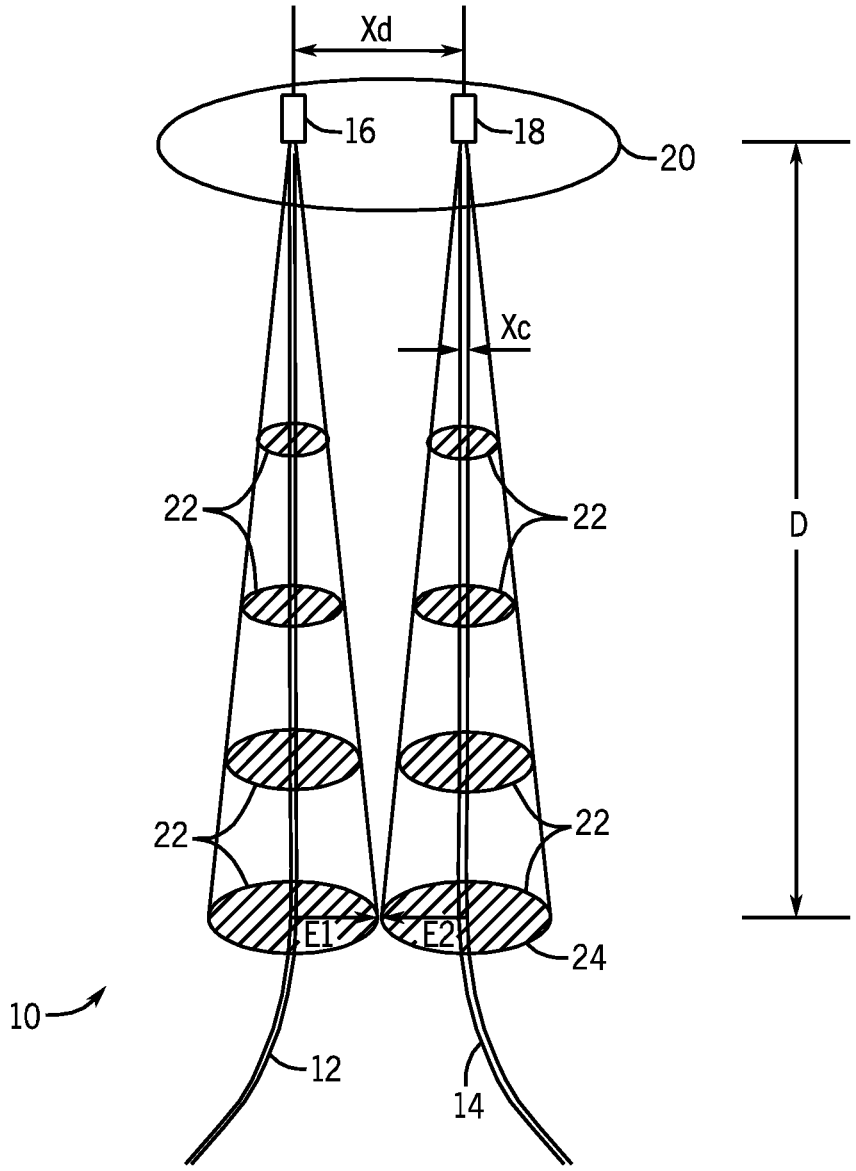
FIG. 1 is a schematic diagram depicting the spacing of two proximate wells at an offshore platform.

FIG. 1 is a schematic 10 illustrating the spacing of two proximate wells at an offshore platform. A first well 12 and a second well 14 have wellheads 16 and 18, respectively, extending from a platform area 20. The initial placement of the first well 12 and the second well 14 is based on a well head separation Xd, the determination of which is discussed below. Based on potential survey errors associated with drilling and the casing diameter Xc, as the first well 12 and second well 14 extend to a depth D, ellipsoids of uncertainty 22 increase correspondingly until reaching a kick-off point (KOP) 24. Each ellipsoid of uncertainty 22 corresponds respectively to a certain probability density corresponding to whether the well bore is actually located within the ellipsoid. As apparent in the schematic 10, the final ellipsoids of uncertainty 22 at the KOP 24 are represented as E1 and E2. Upon reaching the KOP 24, the first well 12 and the second well 14 deviate for directional drilling.

Well head separation Xd for the first well 12 and the second well 14 may be based on a relationship known as oriented safety factor (OSF). To ensure no collision occurs, the final ellipsoids of uncertainty 22 at the depth D may not overlap. The OSF may be defined according to the following equation:

$$OSF = \frac{Xd - Xc}{\sqrt{(E1)^2 + (E2)^2}}. \tag{1}$$

In equation (1) above, $X_d$ represents the well head separation, $X_c$ represents the casing diameter, and $E_1$ and $E_2$ represent the radii of the ellipsoids at the depth D. The larger the oriented safety factor, the less likely that two wells will collide. Typically, one wants OSF>1.5 for a sufficient safety factor to avoid a collision.

By way of example, suppose the first well 12 and the second well 14 are vertical for a depth D=500 m, and that the casings on both wells will be 30 inches in diameter, such that $X_c$=0.76 m. Also, assume that the ellipsoids of uncertainty 22 are solely determined by the accuracy of the measurement while drilling (MWD) inclination measurement ($\alpha=2\cdot10^{-3}$ radians, ~0.1°, and that the accuracy is the same for any new well as for existing cased wells. Hence, at 1500 ft, $E_1=E_2=\alpha\cdot D=0.9$ m, and a new well must be separated from existing wells by $X_d=X_c+OSF\cdot\sqrt{(E_1)^2+(E_2)^2}=0.76\text{ m}+1.5\cdot\sqrt{2}\cdot(0.9\text{ m})\approx2.8$ m.

Note that the slot spacing may be primarily determined by the accuracy of the MWD tool. If the MWD measurements are less accurate, or if the wells must go to greater depths, or if a greater safety margin is desired, the distance between slots may generally be increased. Using the techniques disclosed herein, however, a driller may plan and subsequently drill within the ellipsoids of uncertainty 22 that may be determined based on MWD tool capabilities. Thus, the slot spacing may be reduced, as discussed below.

Figure 2:
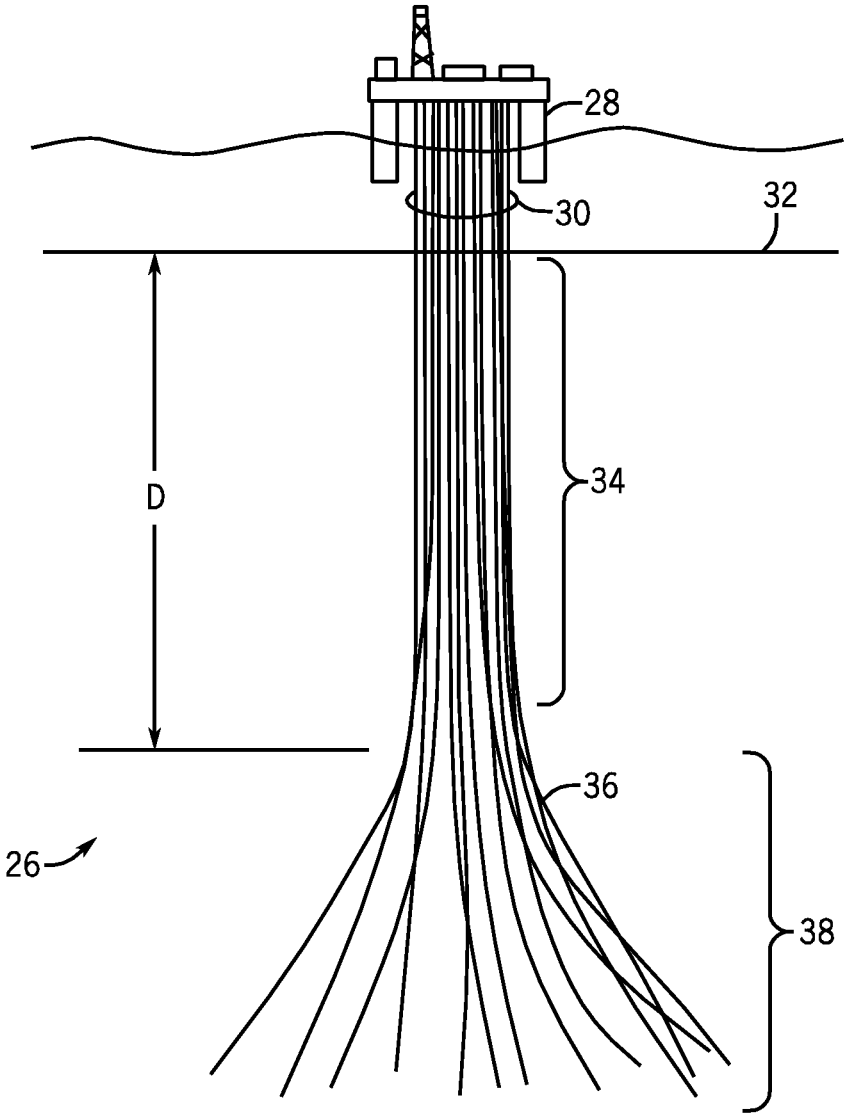
FIG. 2 is a schematic diagram illustrating a plurality of existing wells at an offshore platform.

FIG. 2 illustrates a schematic view 26 of existing wells from an offshore platform. In the schematic view 26, an offshore platform 28 includes a plurality of wells 30. After penetrating a seabed 32, the wells 30 remain in a largely parallel configuration 34 through a depth D. Upon reaching a kick-off point (KOP) 36, the wells 30 deviate into directional wells 38.

FIG. 3 depicts an exemplary well slot pattern 40 for drilling additional wells amid the plurality of wells 30 of FIG. 2. Within a platform perimeter 42, each existing well 44 is represented by a circle and each proposed well 46 is represented by a star. The existing wells 44 have been drilled with a well head spacing Xd of 2.8 meters (m). Given the limited space within the platform perimeter 42, this spacing provides a maximum number of existing wells 30 when the ellipsoids of uncertainty 22 have a 2.8 meter diameter at the depth D of the kick-off point (KOP) 36 where the wells 30 deviate.

Using a technique discussed below, the ellipsoids of uncertainty 22 may be reduced to 2.0 meters in diameter at the depth D. Accordingly, an additional thirty-seven proposed wells 46 may be drilled within the platform perimeter 42 amid the existing wells 44, more than doubling the total number of wells 30 on the offshore platform 28. To accommodate the new well heads, a second floor may be added to the offshore platform 28, above or below the initial floor. This configuration could save the cost of building an additional offshore platform when additional wells are desired.

Turning to FIG. 4, a well placement schematic 48 illustrates a placement of a new well 50 amid four existing wells 52, 54, 56, and 58 on the offshore platform 28 when well head spacing of 2.0 meters (m) for new wells may be achieved. For the purposes of the discussion, the new well 50 and the existing wells 52, 54, 56, and 58 are assumed to be vertical for the first few hundred meters before diverging at different angles. The well head of the new well 50 is located at $(x,y,z)=(0,0,z_p)$, and the well heads of the existing wells 52, 54, 56, and 58 are located at $(x,y,z)=(2,0,z_p)$, $(0,2,z_p)$, $(-2,0,z_p)$, $(0,-2,z_p)$, respectively, where the floor of the offshore platform 28 is at $z_p$ and the z-direction is vertical. The well head spacing Xd between the four existing cased wells is 2.8 m, consistent with the example in FIG. 3.

Figure 5:
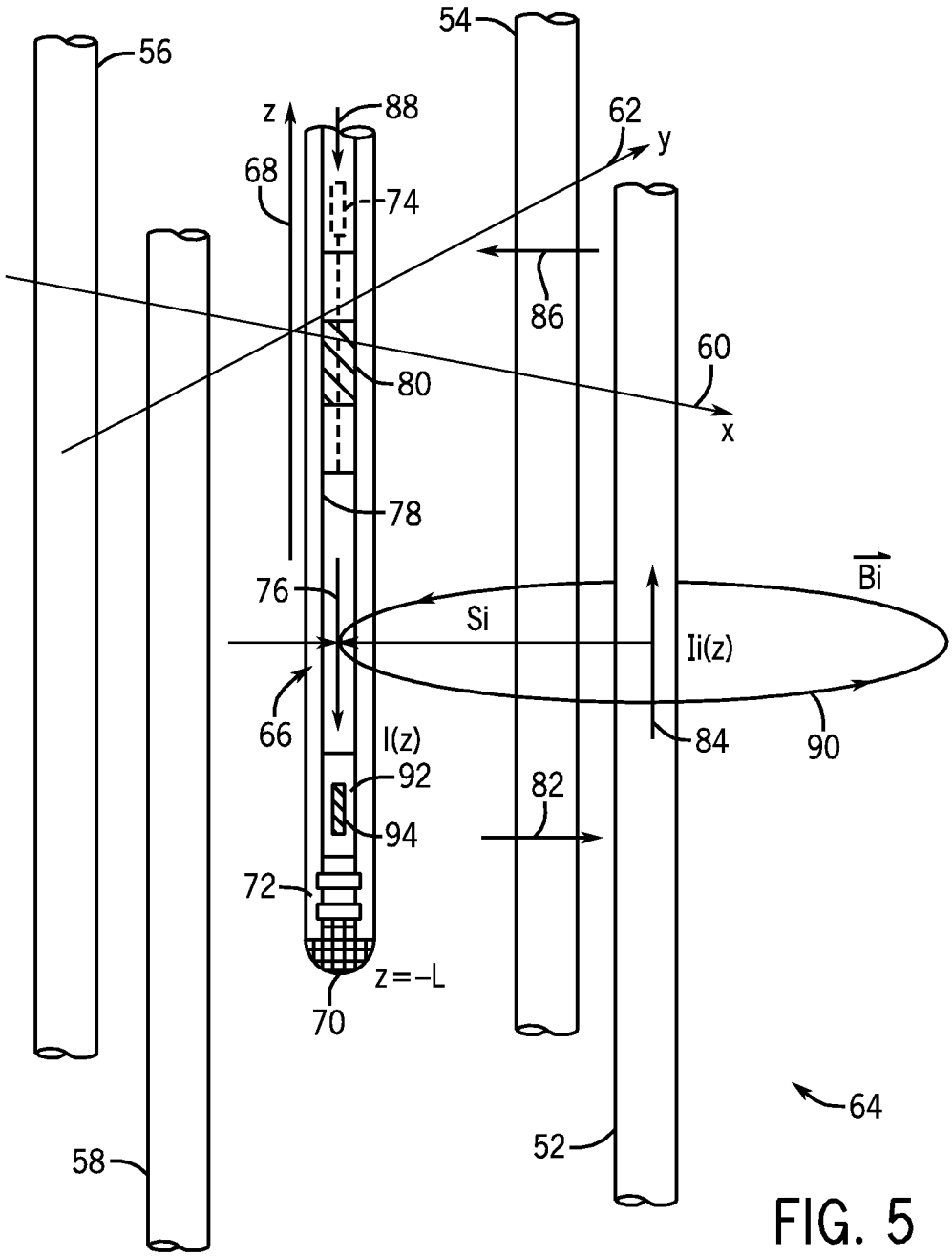
FIG. 5 illustrates a bottom hole assembly (BHA) drilling between four cased wells in accordance with an embodiment of the invention.

FIG. 5 provides a schematic 64 of a bottom hole assembly (BHA) 66 for drilling amid the four existing wells 52, 54, 56, and 58 of FIG. 4. The BHA 66 is aligned vertically on the z-axis 68, drilling downward with a drill bit 70 coupled to a rotary steerable system (RSS) 72 for setting the direction of the drill bit 70. The BHA 66 further includes an electric current driving tool 74, which may be a component of a measurement while drilling (MWD) tool or a standalone tool, such as Schlumberger's E-Pulse or E-Pulse Express tool. The electric current driving tool 74 provides an electric current 76 to an outer drill collar 78 of the BHA 66. The outer drill collar 78 is separated from the rest of the BHA 66 by an insulated gap 80 in the drill collar, over which electric current may not pass.

As discussed above, the electric current driving tool 74 may provide the electric current 76 to the outer drill collar 78. The current 76 produced by the electric current driving tool 74 may, for example, have a frequency between about 1 Hz and about 100 Hz, and may have an amplitude of around 17 amps. Beginning along the outer drill collar 78 of the BHA 66, the current 76 may subsequently enter the formation surrounding the BHA 66. The portion of the current 76 that enters the surrounding formation is depicted as an electric current 82.

The casing on existing wells 52, 54, 56, and 58 provides very low resistance to electricity as compared to the surrounding formation. As a result, a substantial portion of the current 82 will pass along the casing of the existing wells 52, 54, 56, and 58. For purposes of simplification, the current 82 is depicted as flowing toward the casing of the existing well 52, but it should be noted that the current 82 will be divided among the existing wells 52, 54, 56, and 58. The portion of the current 82 which travels along the casing of the existing well 52 is illustrated as current 84. The current 84 travels along the casing of the existing well 52 before re-entering the formation as a current 86 toward the BHA 66. When the current 86 reaches the BHA 66, the resulting current is depicted as a current 88, which completes the circuit at the electric current driving tool 74.

The movement of the current 84 along the casing of the existing well 52 creates an azimuthal magnetic field 90 centered on the casing of the existing well 52. A magnetometer tool 92 having a three-axis magnetometer 94 may detect both the magnitude and the direction of the magnetic field 90 along three axes. The magnitude and direction of the magnetic field 90 may provide measurements for estimating the direction and distance from the BHA 66 to the existing well 52 according to techniques discussed below.

The BHA 66 may include a variety of tools and configurations. For example, the RSS 72 may be a PowerDrive RSS. Circulating drilling mud may power the PowerDrive RSS cartridge. Because the PowerDrive RSS has a magnetometer at 126 inches behind the bit, the magnetometer tool 92 may form a part of the PowerDrive RSS. Such a configuration could be used to measure the induced magnetic field 90 generated by the current 84 on the casing of the existing well 52. To do so, the control cartridge of the PowerDrive RSS could be maintained in geostationary mode while it is measuring the induced magnetic field 90.

Above the RSS 72, the BHA 66 may include a SlimPulse MWD tool. Because the SlimPulse MWD tool has a magnetometer located at 254 inches from the bit, the magnetometer tool 92 may alternatively or additionally form a part of the SlimPulse MWD tool. The SlimPulse tool is battery powered, so it can acquire data with the mud pumps on or off. After the induced magnetic field 90 has been measured, the data may be transmitted to the surface by the MWD pulser.

Alternatively, another MWD tool, such as a PowerPulse tool, may replace the SlimPulse tool. It is also possible to replace the PowerDrive RSS by an Exceed RSS or simply by a mud motor with a steerable assembly. A special purpose tool including both the magnetometer tool 92 and the electric current driving tool 74 may be used in place of the SlimPulse MWD tool, and the E-Pulse tool used to send data to the surface via electromagnetic (EM) waves. Moreover, if continuous steering data and instantaneous feedback to the steerable system are desired, a wired drill pipe may be used for telemetry.

Continuing to view FIG. 5, the generation of the magnetic field 90 may be further described. The electric current 76 generated by the electric current driving tool 74 may be given by $I(z,t)=(z)\cdot\cos(2\pi t+\phi)$, where t represents time, f represents frequency, and $\phi$ represents phase. Hereafter, the time t and frequency f dependence is suppressed in the formulas, but should be understood. The electric current 76 on the BHA 66, I(z), decreases with distance (z) from the insulated gap 80 as it flows from the BHA 66 into the surrounding formation. For example, between the insulated gap 80 and the drill bit 70, the current 76 decreases in a nearly linear manner as $I/(z)\approx I/(0)(1+z/L)$, where L is the distance from the insulated gap 80 to the tip of the drill bit 70, and where $z<0$ below the insulated gap 80.

As discussed above, most of the current 76 that enters the surrounding formation also flows onto the casing of the existing wells 52, 54, 56, and 58 to return to the BHA 66 above the insulated gap 80. In the foregoing description, the current 84, which may represent a return current moving along any $i^{th}$ existing well casing may be denoted as Ii. Further, L may be assumed to be larger than the inter-well spacing for simplicity in the mathematical analysis, but the technique described herein does not depend on this assumption.

Figure 6:
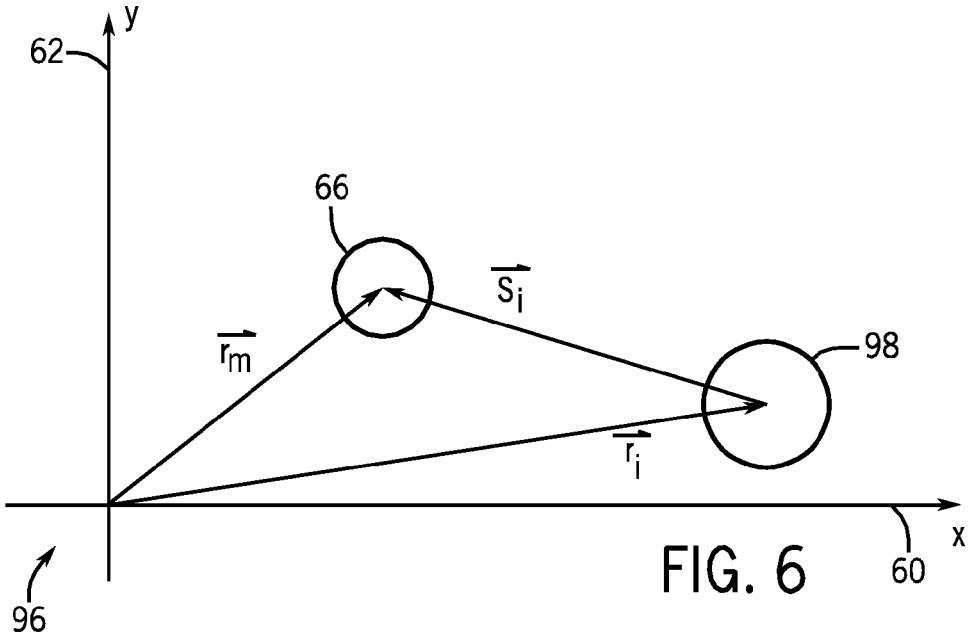
FIG. 6 is a schematic illustrating the geometry for calculating magnetic induction at the BHA due to casing (i)

Turning to FIG. 6, a schematic 96 depicts geometry underlying the calculation of magnetic field 90 at the BHA 66 which, in a general case, arises due to the current 84 on an $i^{th}$ well casing 98. The magnetometer 94 may be located in the center of the BHA 66 may be understood to be located at $\vec{r}_m=(x_m,y_m,z_m)$; the $i^{th}$ well casing 98 may be understood to be located at $\vec{r}_i=(x_i,y_i,z_i)$, and a vector pointing from the $i^{th}$ well casing 98 to the BHA 66 may be $\vec{S}_i=\vec{r}_m-\vec{r}_i$. For simplicity, the BHA 66 and the $i^{th}$ well casing 98 may be assumed to be parallel and aligned in the z-direction. Hence, the distance from the BHA to the $i^{th}$ casing may be represented by $S_i^2=(x_m-x_i)^2+(y_m-y_i)^2$. Because it should be understood that the quantities are evaluated at the same depth, the explicit z dependence may be neglecting in the equations that follow.

The induced magnetic field 90 measured at the magnetometer 94 due to the current Ii on the $i^{th}$ well casing 98 may be described according to the following equation:

$$\vec{B}i = \frac{\mu_0 I_i(z)}{2\pi S_i^2}\hat{z}\times\vec{S}i. \tag{2}$$

It should be appreciated that equation (2) represents an expression for induced magnetic field from a long line of constant current. Under the assumption that L□ $S_i$, this is a reasonable approximation.

Further, a total induced magnetic field 90 at the magnetometer 94 may be represented by a sum of the induced magnetic fields from all nearby casings (not depicted) according to the following equations:

$$\vec{B}(x_m, y_m) = \sum_{i=1}^{n}\vec{B}i(x_m, y_m) = \sum_{i=1}^{n}\frac{\mu_0 I_i(z_m)}{2\pi S_i^2}\hat{z}\times\vec{S}_i = \sum_{i=1}^{n}\frac{\mu_0 I_i(z_m)}{2\pi S_i^2}\hat{z}\times(\vec{r}_m-\vec{r}_i) \tag{3}$$

$$\vec{B}i(x_m, y_m) = \frac{\mu_0 I_i(z_m)}{2\pi S_i^2}[(y_i-y_m)\hat{x}+(x_m-x_i)\hat{y}];$$

$$\vec{B}i(x_m, y_m) = \frac{\mu_0 I_i(z_m)}{2\pi}\frac{(y_i-y_m)\hat{x}+(x_m-x_i)\hat{y}}{(x_m-x_i)^2+(y_m-y_i)^2}. \tag{4}$$

It should be noted that equations (3) and (4) lack a Bz component. Due to the assumption that the BHA 66 and the existing wells 52, 54, 56, and 58 all extend in the z-direction, the induced azimuthal magnetic field 90 which forms on the casing of the existing wells 52, 54, 56, and 58 accordingly includes components in only the x- and y-directions.

The sum of the currents on all of the casing of the existing wells 52, 54, 56, and 58 must not exceed the current 76 on the BHA 66, as represented by the relationship $$I \geq \sum_{i=1}^{n} I_i.$$

The current 84 on any casing of the existing wells 52, 54, 56, and 58 depends on the position of the well relative to the BHA 66, the resistivities of both the formation and the cement surrounding the casing of the existing wells 52, 54, 56, and 58, and on the presence of other nearby casings. The current 84 and resulting induced magnetic field 90 for each of the existing wells 52, 54, 56, and 58 may be obtained from a full 3-D numerical model, but simpler approaches may yield sufficient results.

With the assumption that L□ $S_i$, the current distributions on adjacent casings may be approximated with a simple formula describing the conductance between two long, parallel cylinders. If two parallel conductors have a diameter D and are separated by the distance $S_i$, then the conductance per unit length between them is given by the following relationship:

$$G_i = \frac{\pi\sigma}{\cosh^{-1}(S_i/D)}. \tag{5}$$

Equation (5) above applies for a homogeneous formation with a conductivity σ. The current Ii on the casing of the $i^{th}$ well 98 is therefore proportional to $G_i$ according to the following equation:

$$I_i(z)\square\frac{G_i}{\sum_{i=1}^{n}G_i}I(z). \tag{6}$$

In equation (6), the sum considers a total of n adjacent casings. Distant casings have a small effect and can be neglected for this analysis. Also, a small fraction of the current 76 of the BHA 66 will return though the borehole and shallow formation, but this minor effect may be neglected. However, the effects may be considered in a more rigorous analysis.

It should be noted that $\vec{B}(x_m,y_m)$ is not a vector magnetic field in the normal sense. Rather, it represents the induced magnetic field 90 at the location of the magnetometer 94 inside the drill collar of the BHA 66 when the magnetometer 94 is located at coordinates $(x_m,y_m)$. The current 76 on the BHA 66 itself does not produce a magnetic field inside the BHA 66, but it does produce a strong magnetic field outside the BHA 66. This external field due to the current 76 on the BHA 66 is not included in the expression for $\vec{B}(x_m,y_m)$ for the reasons stated above, but the external magnetic field would be included in any expression for the magnetic field outside of the BHA 66. Also, the expression for $\vec{B}(x_m,y_m)$ includes any changes in any casing current 84 as the BHA 66 changes position.

Some specific examples of $\vec{B}(x_m,y_m)$ are now given. The four existing wells 52, 54, 56, and 58 surrounding the BHA 66 may be located at $(x_1,y_1)=(2,0)$, $(x_2,y_2)=(0,2)$, $(x_3,y_3)=(-2,0)$, and $(x_4,y_4)=(0,-2)$, while the BHA 66 is located at $(x_m,y_m)$. Unless explicitly indicated otherwise, all distances are in meters. The current 76 generated at the insulated gap 80 of the BHA 66 may be I(0)≈17 amp, where the insulated gap 80 is defined at z=0. The diameter D of the BHA 66 and of the casing on the existing wells 52, 54, 56, and 58 may be D=0.18 m, the length L of the BHA 66 below the insulated gap 80 may be L=15 m, the drill bit 70 may be located at z=−15 m, and the magnetometer 94 may be located at $z_m$=−9 m. With the assumption that the current 76 decays linearly from the BHA 66, the current on the BHA 66 at the location of the magnetometer 94 is I(−9)≈=(1−9/15) amp≈7 amp. The sum of the currents on the four adjacent casings of the existing wells 52, 54, 56, and 58 is thus $$\sum_{i=1}^{4} I_i(-9) = I(-9) \approx 7 \text{ amp.}$$

If the BHA 66 is located at $(x_m,y_m)=(0,0)$, as depicted in the well placement schematic 48 of FIG. 4, then all four casings of the existing wells 52, 54, 56, and 58 will have the same currents and, as the distances from the BHA 66 to the four casings of the existing wells 52, 54, 56, and 58 are identical, the induced magnetic fields from the four casings of the existing wells 52, 54, 56, and 58 will cancel. Hence, the magnetic field at the magnetometer will be $\vec{B}(0,0)=0$. If the BHA is closer to any $i^{th}$ casing 98, representing one of the existing wells 52, 54, 56, and 58, then the distance $S_i$ will decrease, the conductance Gi will increase, and the current Ii will correspondingly increase. As a result, the induced magnetic field 90, or $B_i(x_m,y_m)$, due to the current 84 on the casing of the $i^{th}$ well 98 will increase due to the increase in the current 84 and the factor $S_i^{-1}$ in equation (4). Meanwhile, the induced magnetic fields from the casings of the other existing wells 52, 54, 56, or 58 will decrease.

Figure 7:
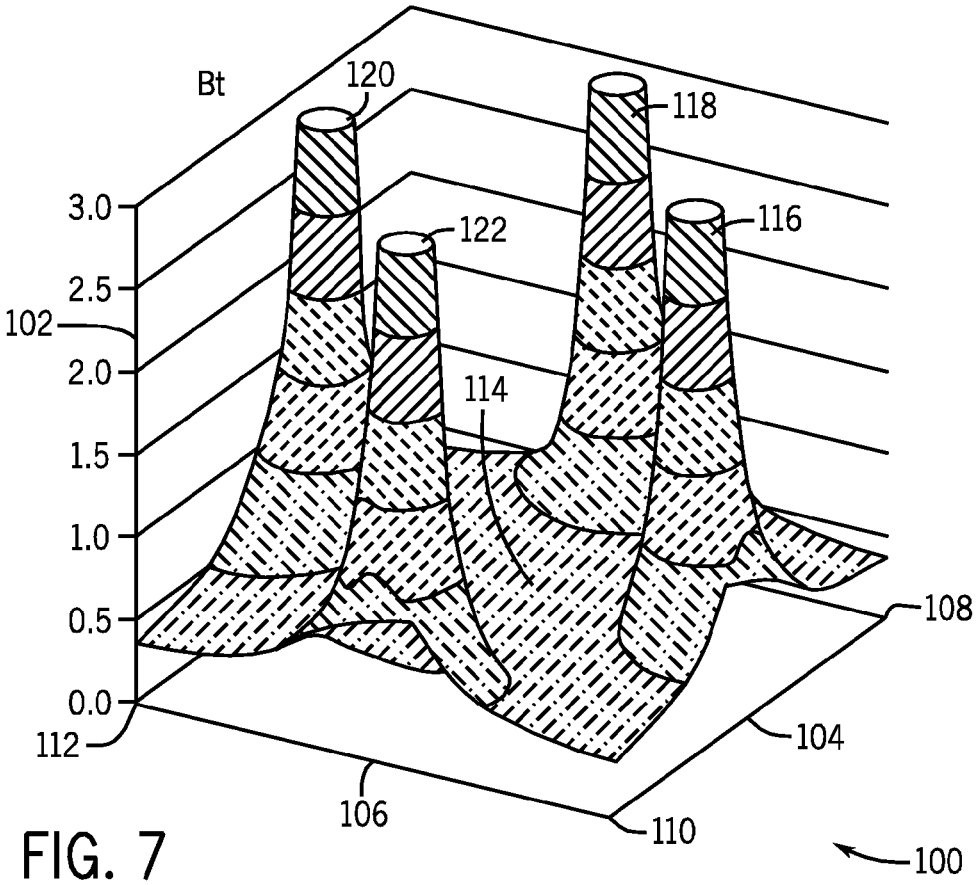
FIG. 7 is a 3-D plot of magnetic field amplitude caused by induced magnetic fields on four cased wells.
Figure 8:
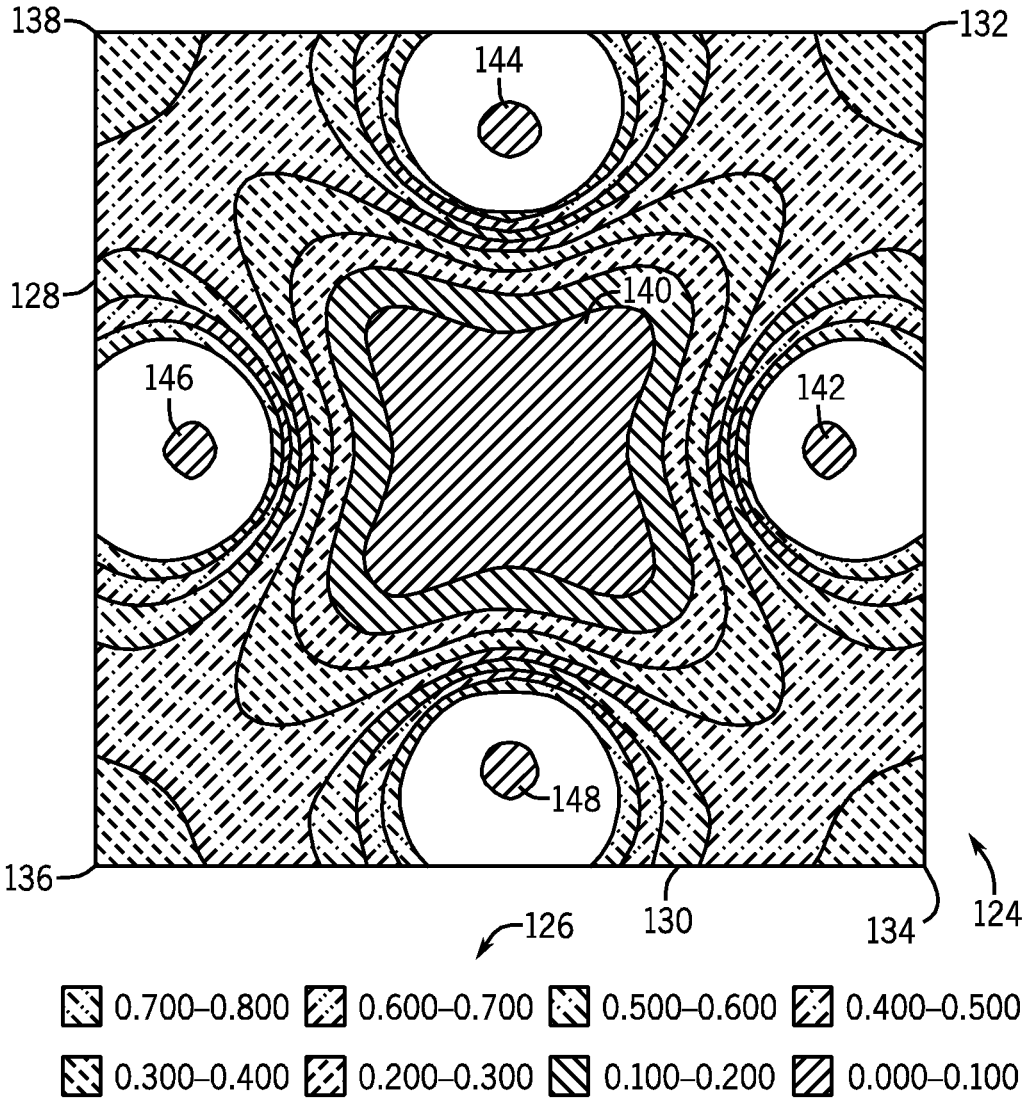
FIG. 8 is a contour plot of magnetic field amplitude caused by induced magnetic fields on four cased wells.

FIGS. 7 and 8 plot the induced magnetic field 90 amplitude Bt $(x_m,y_m)=|\vec{B}(x_m,y_m)|$ as a function of the magnetometer 94 position $(x_m,y_m)$ over the ranges $x_m\epsilon[-2.6,2.6]$ and $y_m\epsilon[-2.6,2.6]$. Turning first to FIG. 7, a 3-D plot 100 clearly indicates the locations of casings of the four existing wells 52, 54, 56, and 58. The 3-D plot 100 illustrates the amplitude $B_t$ 102 for the magnetic field 90 over the ranges $x_m\epsilon[-2.6,2.6]$ and $y_m\epsilon[-2.6,2.6]$. A numeral 104 indicates the y-direction and a numeral 106 indicates the x-direction, such that point 108 is located at (x,y)=(2.6,2.6), point 110 is located at (x,y)=(2.6,−2.6), and point 112 is located at (x,y)=(−2.6,−2.6). A numeral 114 indicates the location of the BHA 66 at the center of the 3-D plot 100. Four spikes in amplitude Bt 102 denoted by numerals 116, 118, 120, and 122 indicate respectively a location of the existing wells 52, 54, 56, and 58.

FIG. 8 similarly represents the induced magnetic field 90 amplitude $B_t$ in the form of a contour plot 124. The contour plot 124 illustrates magnetic field 90 amplitude $B_t$ in microTesla (μT) using distinct hatching, as indicated in the legend 126. An ordinate 128 illustrates the y-direction and an abscissa 130 illustrates the x-direction, such that point 132 is located at (x,y)=(2.6,2.6), point 134 is located at (x,y)=(2.6,−2.6), point 136 is located at (x,y)=(−2.6,−2.6), and point 138 is located at (x,y)=(−2.6,2.6). The center of the contour plot 124 indicates a location 140 of the BHA 66. Four spikes in amplitude Bt denoted by numerals 142, 144, 146, and 148 indicate respectively a location of the existing wells 52, 54, 56, and 58.

Figure 9:
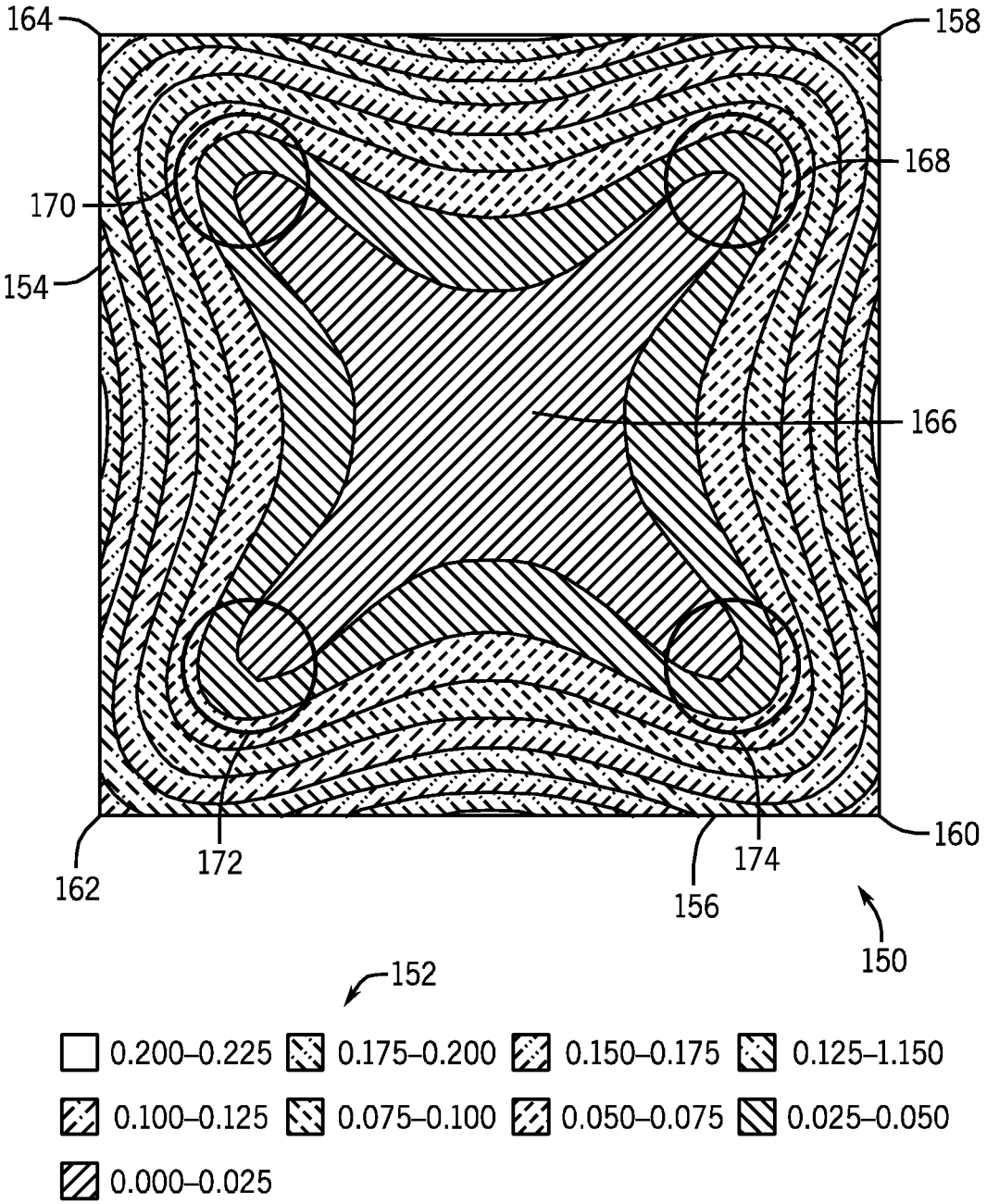
FIG. 9 is an expanded view of the total magnetic field amplitude depicted in FIG. 9.

Turning to FIG. 9, an expanded view 150 of the contour plot 124 of FIG. 8 represents the induced magnetic field 90 amplitude $B_t$ over the ranges $x_m\epsilon[-1,1]$ and $y_m\epsilon[-1,1]$. The expanded view 150 illustrates magnetic field 90 amplitude $B_t$ in microTesla (μT) using distinct hatching, as indicated in the legend 152. An ordinate point 154 illustrates the y-direction and an abscissa 156 illustrates the x-direction, such that 158 is located at (x,y)=(1,1), point 160 is located at (x,y)=(1,−1), point 162 is located at (x,y)=(−1,−1), and point 164 is located at (x,y)=(−1,1). The center of the contour plot 166 indicates a location 140 of the BHA 66. Though the four spikes in amplitude Bt denoted by numerals 142, 144, 146, and 148 of FIG. 8 are not visible in the plot 150 of FIG. 9, the very steep gradient patterns in the induced magnetic field amplitude $B_t$ 168, 170, 172, and 174 indicate respectively that the casings of the existing wells 52, 54, 56, and 58 are nearby.

A simple alarm may be triggered if the induced magnetic field amplitude $B_t$ exceeds a certain value which indicates that the casing is too close to the BHA 66. The alarm may indicate a potential collision between the drill bit 70 and a casing of one of the existing wells 52, 54, 56, or 58 if the drilling continues unchanged. A driller controlling the BHA 66 may be prompted to stop and evaluate the situation upon the triggering of the alarm.

As indicated by FIGS. 7-9, the induced magnetic field amplitude $B_t$ is quite large if the BHA 66 is more than 1 m from the origin in the center of each plot. If the induced magnetic field 90 amplitude exceeds 150 nanoTesla (nT), then the BHA 66 is more than 1 m from the origin in the center of each plot. Because the value exceeds the minimum resolution of conventional MWD magnetometers, approximately 10 nanoTesla (nT), and because magnetometers with a resolution of 1 nanoTesla (nT) or smaller are available, the presently described technique may be performed using existing magnetometer technology.

The position of the BHA 66 relative to the casings of the existing wells 52, 54, 56, and 58 may further be determined by measuring the induced magnetic field 90 components $Bx(x_m,y_m)$ and $By(x_m,y_m)$. Note that resolving the Bx-By components of the induced magnetic field 90 requires an independent measurement of the BHA 66 orientation, i.e. x-y, or North and East. Under normal conditions, the orientation is provided by a measurement of the Earth's magnetic field using the magnetometer 94 when the current 76 on the BHA 66 is not active. However, nearby steel casings of the existing wells 52, 54, 56, or 58 may perturb the Earth's magnetic field and thus degrade the directional measurement, reducing the accuracy with which one may resolve the x-y directions.

Accordingly, an MWD gyro in the BHA 66 may additionally or alternatively be used to determine the direction, or a wireline gyro may be periodically run in the drill string attached to the BHA 66 to determine the x-y directions. The MWD gyro or the wireline gyro could be employed to calibrate the effect of the casings on the Earth's magnetic field or to directly determine orientation with respect to North. If the existing wells 52, 54, 56, and 58 and the BHA 66 are slightly inclined, then a gravity tool face may be used to determine the x-y directions. In the foregoing discussion, it may be assumed that the x-y directions have been determined according to the above-described manners or any other appropriate manner.

Figure 10:
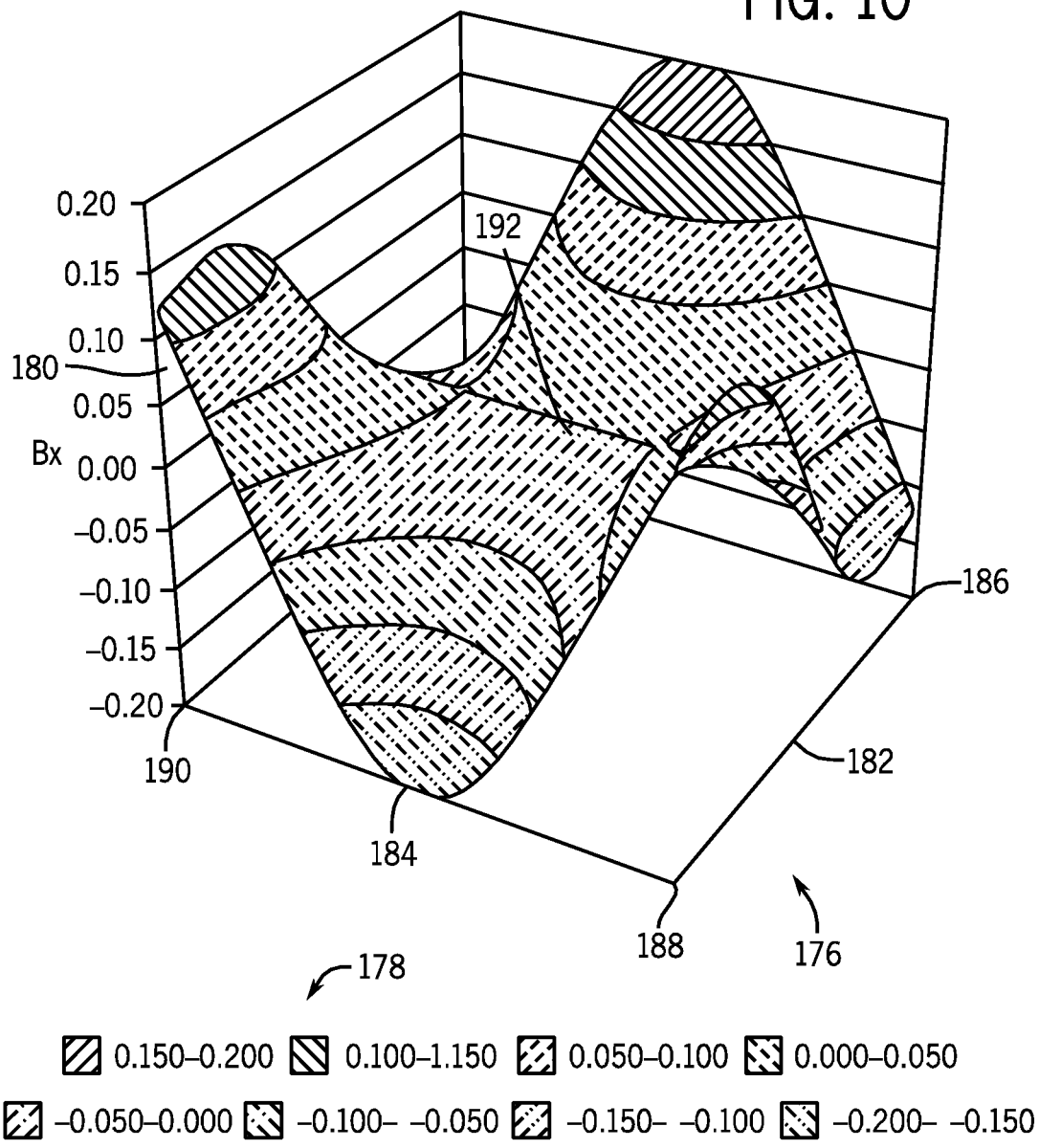
FIG. 10 is a 3-D plot of x-component magnetic field amplitude.
Figure 11:
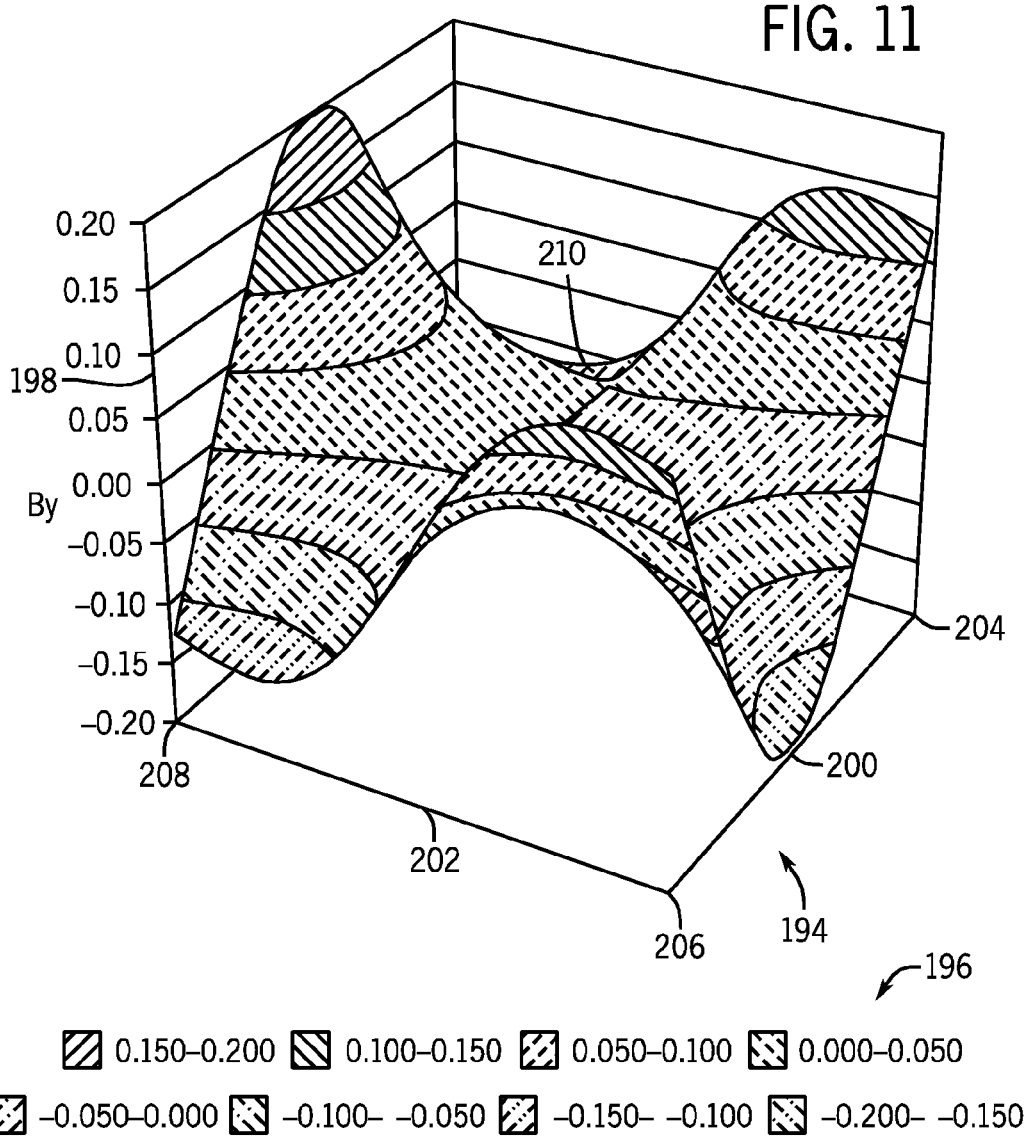
FIG. 11 is a 3-D plot of y-component magnetic field amplitude.

FIGS. 10 and 11 illustrate respectively the magnetic field components $Bx(x_m,y_m)$ and $By(x_m,y_m)$ over the region $x_m\epsilon[-1,1]$ and $y_m\epsilon[-1,1]$. Turning first to FIG. 10, a 3-D plot 176 illustrates the magnetic field component $Bx(x_m,y_m)$ over the region $x_m\epsilon[-1,1]$ and $y_m\epsilon[-1,1]$. A legend 178 indicates magnetic field strength in microTesla (μT), which is illustrated along the height 180 of the 3-D plot 176. A numeral 182 indicates the y-direction and a numeral 184 indicates the x-direction, such that a point 186 is located at (x,y)=(1,1), a point 188 is located at (x,y)=(1,−1), and a point 190 is located at (x,y)=(−1,−1). A numeral 192 marks the location of the BHA 66 in the center of the 3-D plot 176.

Turning next to FIG. 11, a similar 3-D plot 194 illustrates the magnetic field component $By(x_m,y_m)$ over the region $x_m\epsilon[-1,1]$ and $y_m\epsilon[1,1]$. A legend 196 indicates magnetic field strength in microTesla (μT), which is illustrated along the height 198 of the 3-D plot 194. A numeral 200 indicates the y-direction and a numeral 202 indicates the x-direction, such that a point 204 is located at (x,y)=(1,1), a point 206 is located at (x,y)=(1,−1), and a point 208 is located at (x,y)=(−1,−1). A numeral 210 marks the location of the BHA 66 in the center of the 3-D plot 194.

From FIGS. 10 and 11, it should be noted that there is additional information in the amplitudes and phases of the component data, which may be distinguished from the total induced magnetic field 90 amplitude. The total induced magnetic field 90 amplitude may be described according to the following equation:

$$Bt(x_m,y_m)=\sqrt{Bx(x_m,y_m)^2+By(x_m,y_m)^2} \quad (7).$$

Figure 12:
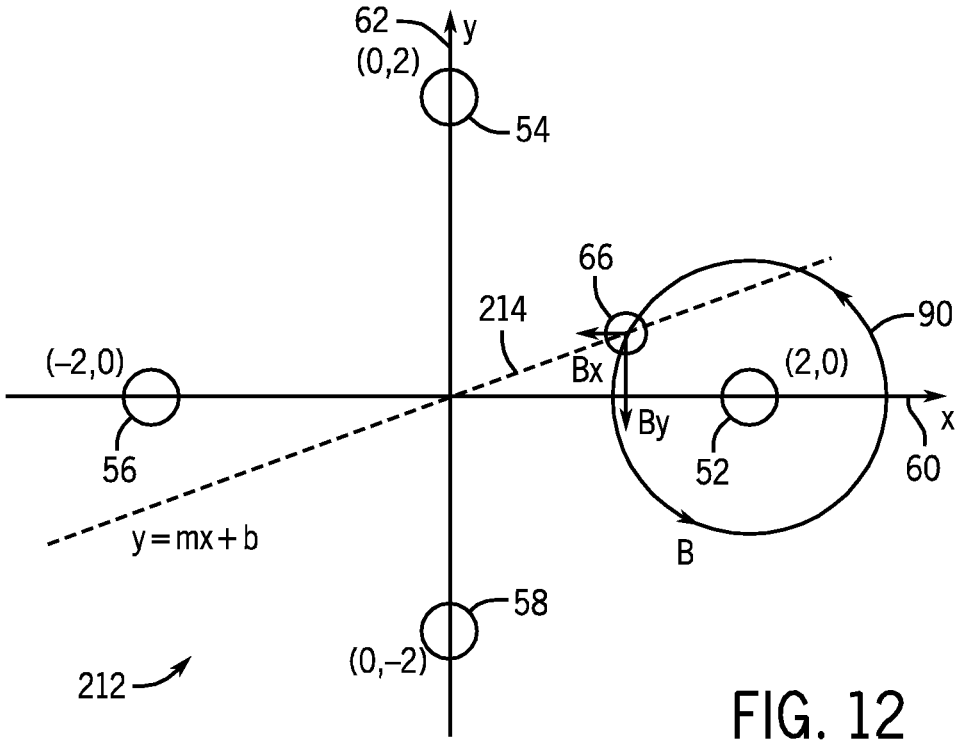
FIG. 12 is a schematic of the location of the BHA relative to four cased wells.

FIG. 12 provides a schematic 212 which depicts a situation where the BHA 66 is located more closely to the casing of the existing well 52 than to any other of the existing wells 54, 56, or 58. The magnetometer 94 within the BHA 66 measures the Bx and By components of the magnetic field 90 which surrounds the casing of the existing well 52. In the schematic 212 of FIG. 12, the x-axis is denoted by numeral 60 and the y-axis is denoted by the numeral 62. A drift trajectory 214 shows a path, along which the BHA 66 slowly drifts from its original position at the origin due to slight errors in the MWD inclination measurements in the BHA 66.

The situation depicted in schematic 212 of FIG. 12 may illustrate a manner of obtaining additional information from the individual magnetic field 90 components $Bx(x_m,y_m)$ and $By(x_m,y_m)$. Because the casing of the existing well 52 has the largest current 84, the induced magnetic field 90 from this casing will be stronger than that of any other of the existing wells 54, 56, or 58. Moreover, because the current 84 flows in the +z direction, both components of magnetic field 90 will be negative, such that Bx<0 and By<0.

Both the phases and amplitudes of Bx and By may provide additional information about the location of the BHA 66 with respect to the casings of the existing wells 52, 54, 56, and 58. For the purposes of plotting the magnetic field 90 components, it may be assumed that the magnetometer 94 in the BHA 66 moves along the drift trajectory 214, represented by a line defined by $y=m\cdot x+b=0.2x$. This may occur if the MWD inclination measurement of the BHA 66 is slightly erroneous, such that the vertical well trajectory drifts away from vertical with increasing depth. For a specific example, suppose that the new well drilled by the BHA 66 drifts 0.25 m in the x-direction and 0.05 m in the y-direction for every 10 m increase in depth. Such drift corresponds to an angle of about 1.4° deviation from vertical.

Figure 13:
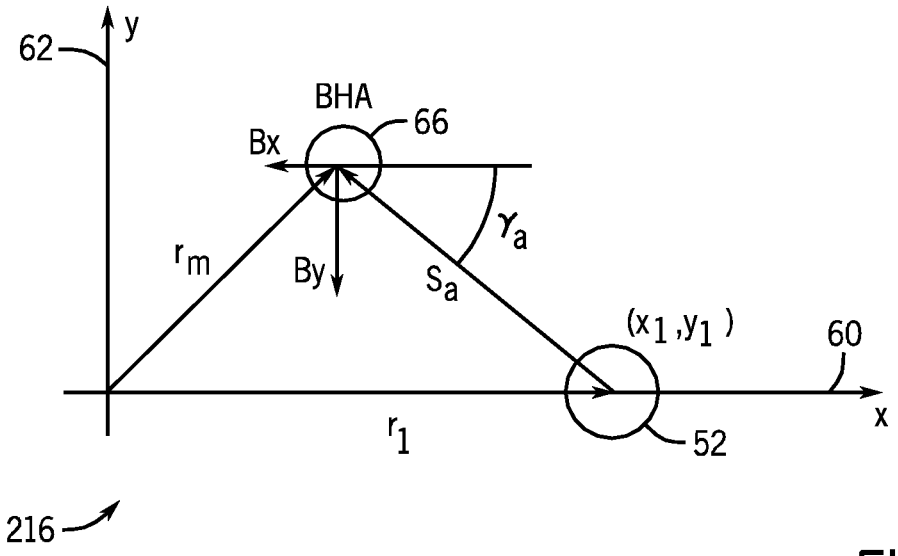
FIG. 13 is a schematic illustrating the geometry for estimating the direction and distance to the nearest cased well at (2, 0) based on x-component and y-component magnetic field amplitude.

FIG. 13 provides a schematic 216 which depicts geometry for estimating the direction and distance from the BHA 66 to the closest existing well 52. The magnetometer 94 within the BHA 66 measures the Bx and By components of the magnetic field 90 which surrounds the casing of the existing well 52. In the schematic 216 of FIG. 13, the x-axis is denoted by numeral 60 and the y-axis is denoted by the numeral 62.

By neglecting the effect of casings of the other existing wells 54, 56, and 58, an apparent distance ($S_a$) and an apparent direction ($\gamma_a$) from the magnetometer 94 at the BHA 66 to the nearby casing of existing well 52 may be estimated. As illustrated in the schematic 216, the BHA 66 is located at $\vec{r}_m=(x_m,y_m)$ and the casing of the existing well 52 is located at $\vec{r}_1=(x_1,y_1)$. Accordingly, an apparent direction to the casing can be derived from the induced magnetic field 90 components according to the following equation:

$$\gamma_a(x_m, y_m) = \tan^{-1}\left(\frac{-Bx(x_m, y_m)}{By(x_m, y_m)}\right). \quad (8)$$

If the existing well 52 were the only casing, the above result would be exact, since the azimuthal magnetic field 90 is perpendicular to a radial vector which is directed from a line current to the observation point. As derived from the geometry depicted in the schematic 216, the true direction ($\gamma$) from the BHA to the casing may be represented according to the following equation:

$$\gamma = \tan^{-1}\left(\frac{y_1 - y_m}{x_1 - x_m}\right). \quad (9)$$

Figure 14:
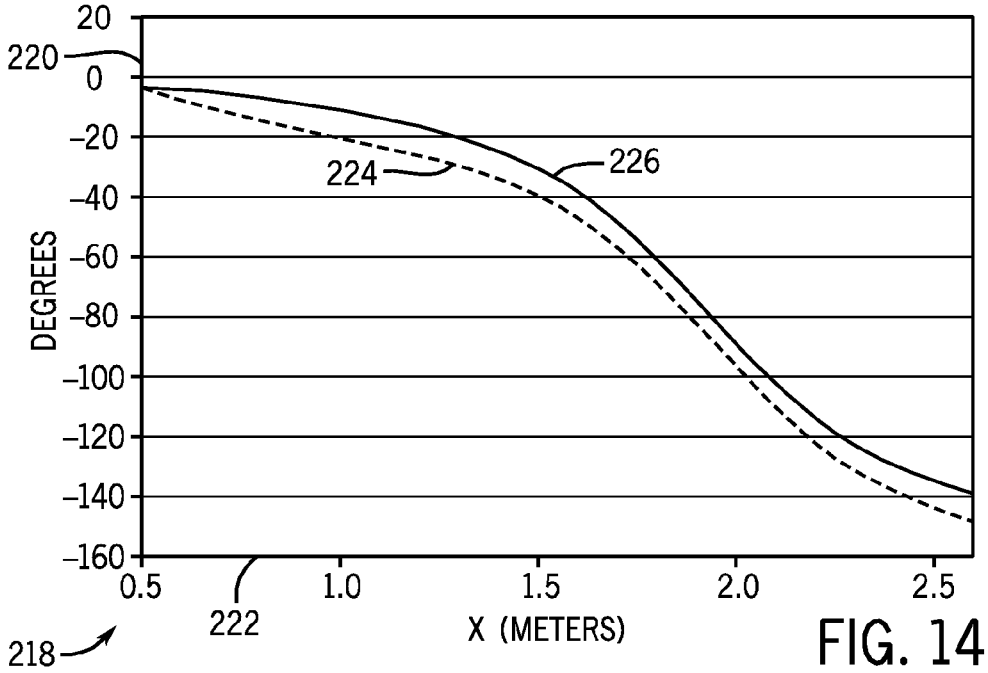
FIG. 14 is a plot illustrating the true angle and the apparent angle when y=0.2x.

Turning next to FIG. 14, a plot 218 illustrates a change in angle over distance when the drift trajectory 214 is defined by $y=0.2\times$. An ordinate 220 represents the direction in degrees and an abscissa 222 represents distance in meters (m). A curve 224 illustrates a change in apparent direction ($\gamma_a$) over distance from 0.5 m to 2.6 m, while a curve 226 illustrates a change in true direction ($\gamma$) over the distance from 0.5 to 2.6 m.

In the example shown by the plot 218, the apparent direction ($\gamma_a$) is within 10° of the true direction ($\gamma$) over the range $x_m\epsilon[0.5, 2.6]$. The difference results by neglecting the casings of the other existing wells 54, 56, and 58, particularly the existing well 54 located at $(x_2,y_2)=(0,2)$. Nonetheless, the apparent direction ($\gamma_a$) is sufficient information to steer the BHA 66 back toward the origin and away from the casing of the existing well 52 at $(x_1,y_1)=(2,0)$.

Figure 15:
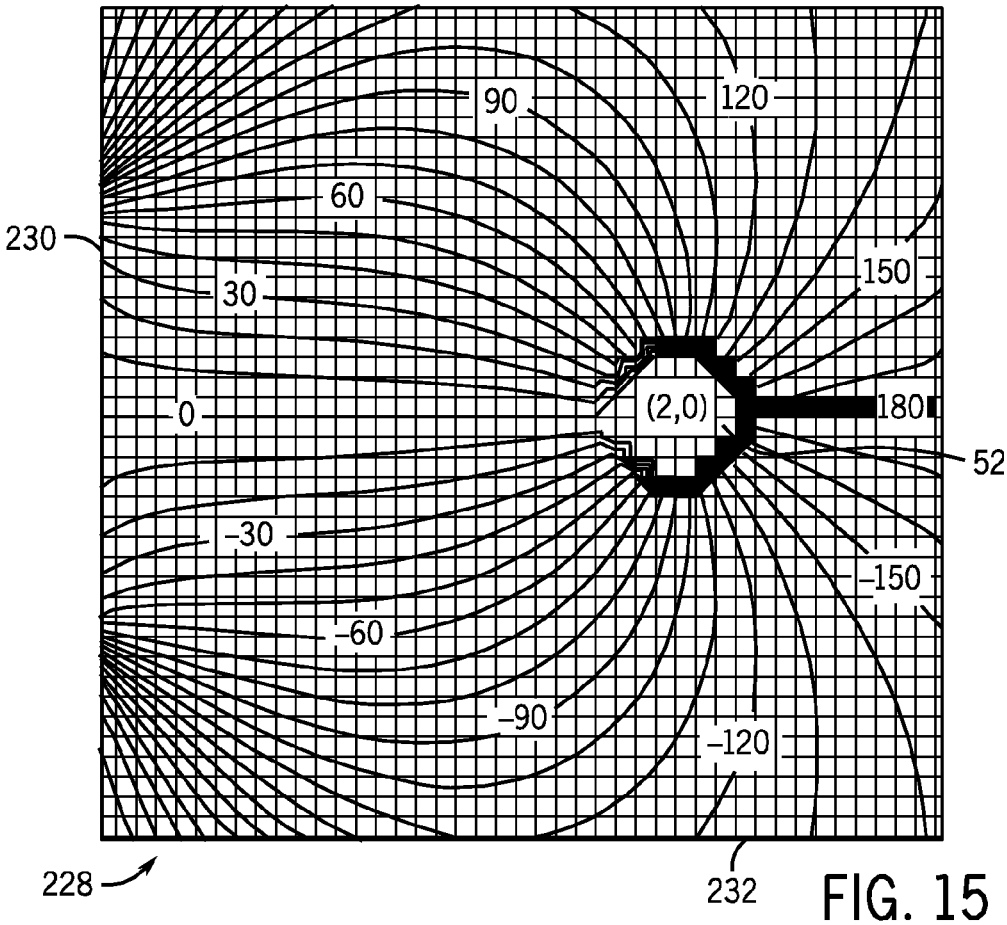
FIG. 15 is a plot illustrating lines of constant apparent angle around the cased well located at (2,0)

FIG. 15 is a plot 228 illustrating lines of constant apparent angle $\gamma_a(x_m,y_m)$ for the area surrounding the casing of the existing well 52 at $(x_1,y_1)=(2,0)$. An ordinate 230 indicates the y-coordinate value over a range of $y_m\ \epsilon[-1,1]$ and an abscissa 232 indicates the x-coordinate value over a range of $x_m\epsilon[0.5,2.6]$. Each of the lines illustrated in the plot 228 shows a constant apparent angle $\gamma_a(x_m,y_m)$ as a multiple of 10. Every third line is labeled accordingly. The plot 228 of FIG. 15 shows that the error in the apparent direction $\gamma_a\ (x_m,y_m)$ reduces as the BHA 66 approaches this casing of the existing well 52.

Figure 16:
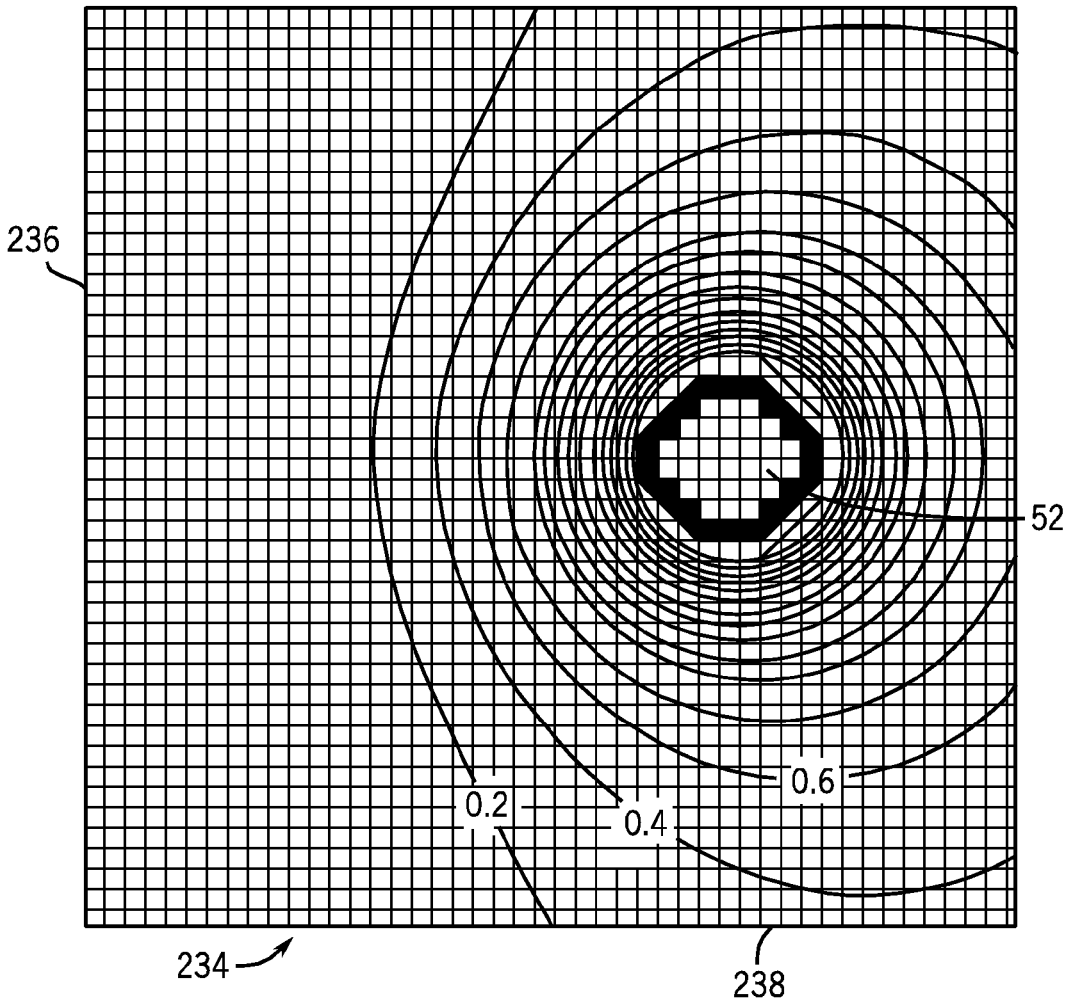
FIG. 16 is a plot illustrating lines of constant magnetic field amplitude plotted around the cased well located at (2,0)

FIG. 16 is a plot 234 illustrating the corresponding contour lines for the induced magnetic field 90 amplitude $Bt(x_m,y_m)$ surrounding the casing of the existing well 52 at $(x_1,y_1)=(2, 0)$. An ordinate 236 indicates the y-coordinate value over a range of $y_m\epsilon[-1,1]$ and an abscissa 238 indicates the x-coordinate value over a range of $x_m\epsilon[-0.5,2.6]$. Each contour line indicates an increase in magnetic field 90 amplitude $Bt(x_m, y_m)$ in increments of 0.2 microTesla (μT) as the BHA 66 approaches this casing of the existing well 52.

As indicated by the plot 234, the magnetic field 90 amplitude $Bt(x_m,y_m)$ lines are approximately circular near the casing of the existing well 52, so that it is possible to invert for the approximate distance to the casing of the existing well 52 with the total induced magnetic field 90. A first order approximation is given by $$S_a = \frac{\mu_0 I_C}{2\pi Bt},$$

where $I_C$ represents an estimate of the current 84 on the casing of the existing well 52. The simplest approach is to allocate $1/4^{th}$ of the total current 76 ($I_Z$) to the casing of the existing well 52, namely $I_C=I(z)/4$. The factor of ¼ is chosen because the BHA 66 is surrounded by the four casings of the existing wells 52, 54, 56, and 58.

Figure 17:
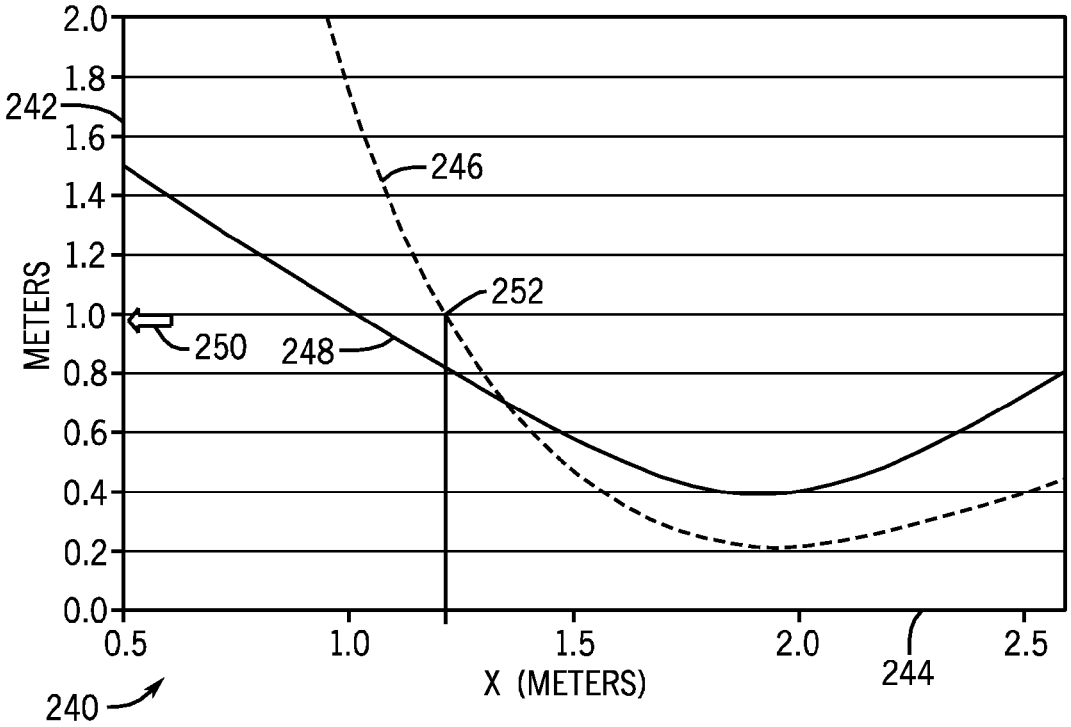
FIG. 17 is a plot illustrating the true distance and the apparent distance when y=0.2x.

Turning to FIG. 17, a plot 240 illustrates a change in distance from the BHA 66 to the casing of the existing well 52 when the drift trajectory 214 is defined by $y=0.2x$. An ordinate 242 represents the distance from the BHA 66 to the casing of the existing well 52 in meters (m) and an abscissa 244 represents distance in the x-direction in meters (m). A curve 246 illustrates a change in apparent distance ($S_a$) over distance in the x-direction from 0.5 m to 2.6 m, while a curve 248 illustrates a change in true distance (S) over distance in the x-direction from 0.5 m to 2.6 m. Further denoted in the plot 240 is a threshold distance 250, which may trigger an alarm indicating that the BHA 66 is too close to another well.

The true distance (S) between the BHA 66 and the casing of the existing well 52 at $(x_1,y_1)=(2,0)$ may be represented as $S_1=\sqrt{(x_1-x_m)^2+(y_1-y_m)^2}$. As mentioned above, the plot 240 illustrates the true distance in curve 248 and the apparent distance ($S_a$) in curve 246 for the same drift trajectory 214, y=0.2x. The apparent distance ($S_a$) is an overestimate for x<1.4m because the other three casings of the existing wells 54, 56, and 58 reduce the magnetic field 90 amplitude around the origin. The apparent distance ($S_a$) is an underestimate for x>1.4 m as the BHA 66 approaches the casing of the existing well 52 at $(x_1,y_1)=(2,0)$ because the current 84 on the casing will be greater than ¼$^{th}$ of the total current.

Figure 18:
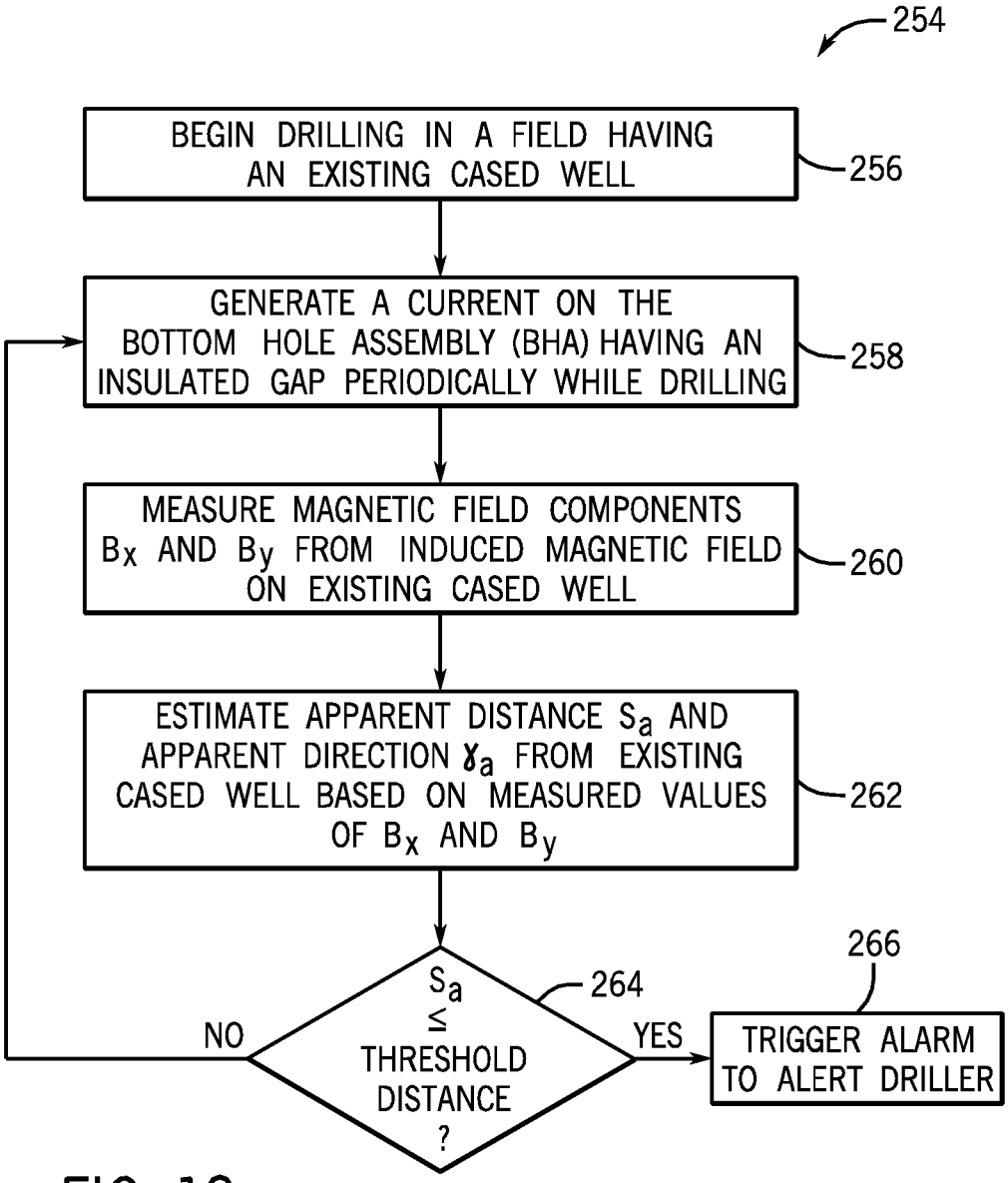
FIG. 18 is a flowchart illustrating a first order method of avoiding collisions with existing cased wells in accordance with an embodiment of the invention.

FIG. 18 is a flowchart 254 for employing the apparent distance ($S_a$) for avoiding a collision with one of the existing wells 52, 54, 56, or 58. The flowchart 254 begins with step 256, in which drilling begins in a field having at least one existing well such as the existing wells 52, 54, 56, or 58. In step 258, magnetic ranging while drilling may be periodically or consistently employed generating the current 76 on the BHA 66 using the electric current driving tool 74. The current 76 will enter the surrounding formation as the current 82 and run along the casing of one of the existing wells 52, 54, 56, of 58 as the current 84, which induces the azimuthal magnetic field 90. In step 260, the components of the magnetic field 90, Bx and By, may be measured from the magnetometer 94 in the BHA 66.

Step 262 involves estimating the apparent distance ($S_a$) and apparent direction ($\gamma_a$) using the first order approximation described above. As indicated by a decision block 264, if the apparent distance ($S_a$) drops below the predetermined threshold distance 250, then the process turns to step 266. An alarm may alert the driller that the drill bit 70 of the BHA 66 is approaching a well casing, allowing the driller to take evasive action by steering in the direction opposite the apparent direction ($\gamma_a$). For example, if the threshold distance 250 is set at $S_a$=1 m, then the driller would be alerted at an alarm trigger distance 252 of x=1.2 m, which corresponds to a true distance of $S_1$=0.8 m. Of course, the threshold distance 250 could be set to be a larger apparent distance ($S_a$). For example, if the threshold distance 250 were instead $S_a$=2 m, then the closest true distance would be $S_1$=1. Returning to decision block 264, if the apparent distance ($S_a$) remains above the threshold distance 250, the process returns to step 258 to continue drilling.

As noted, the collision-avoidance solution above represents a first order solution for locating the BHA 66 with respect to the casings of the existing wells 52, 54, 56, and 58. The accuracy could be further improved by accounting for the current 84 on the casings of the existing wells 54, 56, and 58 in the inversion process, starting from the first order result. In addition, the currents 84 could be adjusted to reflect the relative distances from the BHA 66 to the casings of the existing wells 52, 54, 56, and 58. The apparent distance calculation may be improved by including an estimate of the conductance $G_i$ between the BHA 66 and any i$^{th}$ casing. The conductance $G_i$ increases as the distance between the BHA 66 and the i$^{th}$ casing decreases. Accordingly, the current on the casing, $I_i$, increases. This effect may be included in the inversion by replacing the approximation for current 84 $I_C$=I(z)/4 with an approximation that includes estimates for the conductances $G_i$ for each existing well 52, 54, 56, and 58.

Alternatively, the first order solution may be practiced in other ways. For example, the apparent direction $\gamma_a$ $(x_m \cdot y_m)$ may be plotted as in FIG. 15, and the total field amplitude $Bt(x_m,y_m)$ may be plotted as in FIG. 16. The comparison of the two plots may provide a better estimate of the BHA 66 location, since only the (x,y) points where both conditions are satisfied are possible locations for the BHA 66. A related approach using least squares will be described below.

Summarizing, the first order inversion process, which assumes a single well, involves estimating the apparent angle from the BHA to the cased well as $$\gamma_a = \tan^{-1}\left(\frac{-Bx}{By}\right)$$

and estimating the apparent distance to the cased well according to the following equation:

$$S_a = \frac{\mu_0 I_C}{2\pi Bt}. \tag{10}$$

In equation (10) above, the current $I_C$ is chosen depending on the situation. If there is only one cased well nearby, then a reasonable choice is $I_C \equiv I(0)(1+z_m/L)$, where I(0) represents the current 76 generated at the insulated gap and where the magnetometer 94 is located at $z_m$. If there are four casings nearby, as occurs when the BHA 66 is surrounded by the existing wells 52, 54, 56, and 58, then $I_C \equiv /(0)(1+z_m/L)$ 4 is a reasonable choice. When the apparent distance $S_a$ drops below a threshold value, the driller may be warned via an alarm of an impending collision with a cased well. The apparent angle $\gamma_a$ points toward the casing, and so the driller can avoid the collision by steering the drill bit in the opposite direction.

Using inversion and assuming a single cased well may apply to any arbitrary arrangement of cased wells. One may avoid a collision following the procedure described above. Knowing the location of the cased well is not required, as such information is not needed for $S_a$ or $\gamma_a$. It is not even necessary to know that there are any cased wells in the immediate vicinity, as the threshold alarm may indicate the proximity of a nearby cased well. Further, while the process has been illustrated with parallel wells, it may also be employed with non-parallel wells.

The above analyses assumed that the location of a casing of the existing wells 52, 54, 56, or 58 may be unknown. If the positions of the existing wells 52, 54, 56, and 58 are known, such data, in combination with measurements of the magnetic field 90, may be used to locate the BHA 66. The foregoing technique for locating the BHA 66 amid the existing wells 52, 54, 56, and 58 involves calculating a theoretical magnetic field distribution and comparing the theoretical values to actual measurements of the magnetic field 90. A least squares analysis may be employed for estimating the position of the BHA 66.

The theoretical magnetic field that is measured at the magnetometer is denoted by $\vec{B}(x_m,y_m)=(x_m,y_m)\hat{x}+By(x_m,y_m)\hat{y}$; where $(x_m,y_m)$ refers to the position of the magnetometer 94 in the BHA 66. For the purposes of illustrating the concept, simplifying assumptions about the theoretical model for $\vec{B}(x_m,y_m)$ are employed. First, the BHA 66 and the casings of the existing wells 52, 54, 56, and 58 are parallel or nearly parallel. Second, the positions of the existing wells 52, 54, 56, and 58 are known. Third, resistivity of the surrounding formation is homogenous. Fourth, the current 84 on a casing of the existing wells 52, 54, 56, or 58 may be calculated using the theoretical conductance between the BHA 66 and the casing. With a more sophisticated analysis, the above assumptions may be relaxed accordingly, but the underlying principles of the method will remain the same.

The present embodiment may explained by returning to view the geometry illustrated in FIGS. 4 and 5. From the geometry of the FIGS. 4 and 5, a resulting theoretical field $\vec{B}(x_m,y_m)$ is plotted in FIGS. 7-11. The position of the BHA 66 may be assumed not well known, owing to accumulated errors in the standard MWD direction and inclination measurements. The actual measurement of the induced magnetic field 90 observed by the magnetometer 94 in the BHA 66 may be denoted as $\vec{\beta}(x,y)=\beta x(x,y)\hat{x}+\beta y(x,y)\hat{y}$. Also, the actual position of the magnetometer 94 may be denoted as (x,y), which is treated as unknown. An objective of the present embodiment is to estimate (x,y) by comparing the actual magnetometer 94 measurement $\vec{\beta}(x,y)$ to the theoretical model $\vec{\beta}(x_m,y_m)$.

One approach for comparing measured or experimental values to theoretical values is to employ a least squares method, whereby the differences between the measured and theoretical values are minimized The quantity Q to be minimized may be defined according to the following relationship:

$$Q(x_m, y_m) = \sqrt{[\beta x(x, y) - Bx(x_m, y_m)]^2 + [\beta y(x, y) - By(x_m, y_m)]^2}\,. \quad (11)$$

In equation (11) above, the actual position of the BHA 66, (x,y), is an unknown quantity. Moreover, $x_m \in [-2.6,2.6]$ and $y_m \in [-2.6,2.6]$ are variables. To estimate the actual position of the BHA 66, the objective is to minimize $Q(x_m,y_m)$ on the $x_m$-$y_m$ plane.

Figure 19:
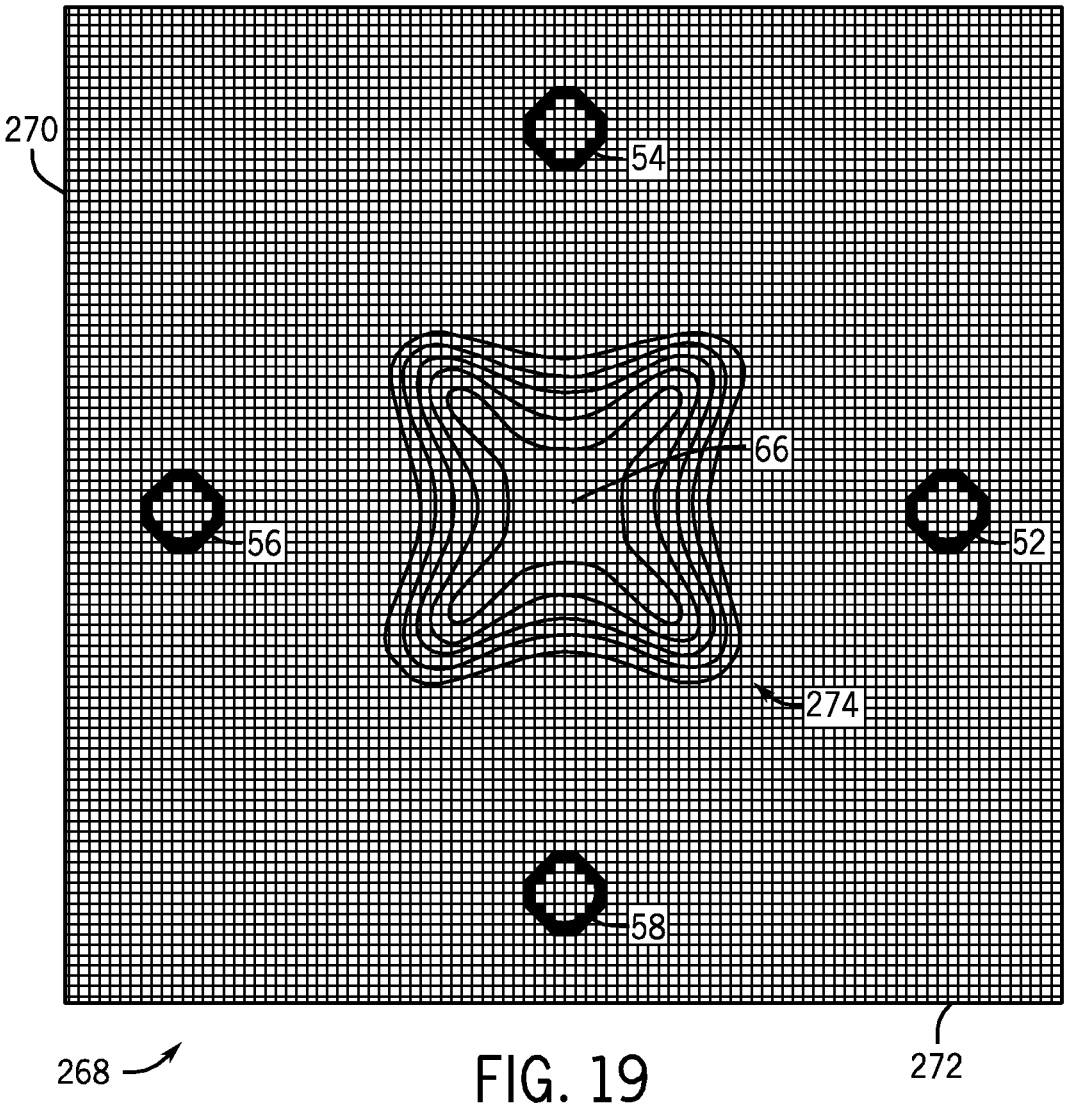
FIG. 19 is a plot of $Q(x_m,y_m)$ when the BHA is located at (0, 0)

FIG. 19 illustrates a 2-D plot 268 of the function $Q(x_m,y_m)$ when the BHA 66 is at the origin, so that the true position of the magnetometer 94 in the BHA 66 is (x,y)=(0,0) and the measured values of the magnetic field 90 from the existing wells 52, 54, 56, and 58 are $\beta x(0,0)=0$ and $\beta y(0,0)=0$. An ordinate 270 represents a range of $y_m \in [-2.6,2.6]$ in the y-direction and abscissa 272 represents a range of $x_m \in [-2.6,2.6]$ in the x-direction. The 2-D plot 268 for $Q(x_m,y_m)$ includes contour lines 274 in increments of 20 nanoTesla (nT). The largest value plotted is 100 nanoTesla (nT). The location of the casings of the existing wells 52, 54, 56, and 58 in the plot 268 are marked accordingly. The contour line closest to the origin is a minimum of $Q(x_m,y_m)$, which has a value less than 20 nT within this area. If the magnetometer 94 is accurate to 20 nanoTesla (nT) and reads a value less than or equal to 20 nT, then the BHA 66 must be within ±0.5 m of the origin where the theoretical value for the magnetic field is zero. The more accurate the measurement, the better to estimate the actual location of the BHA 66. Defining the magnetometer 94 accuracy as $\sigma_B$ allows for the definition of a unit-less quantity $\xi(x_m,y_m)$ as follows:

$$\xi(x_m,y_m)=Q(x_m,y_m)/\sigma_B \quad (12).$$

Figure 20:
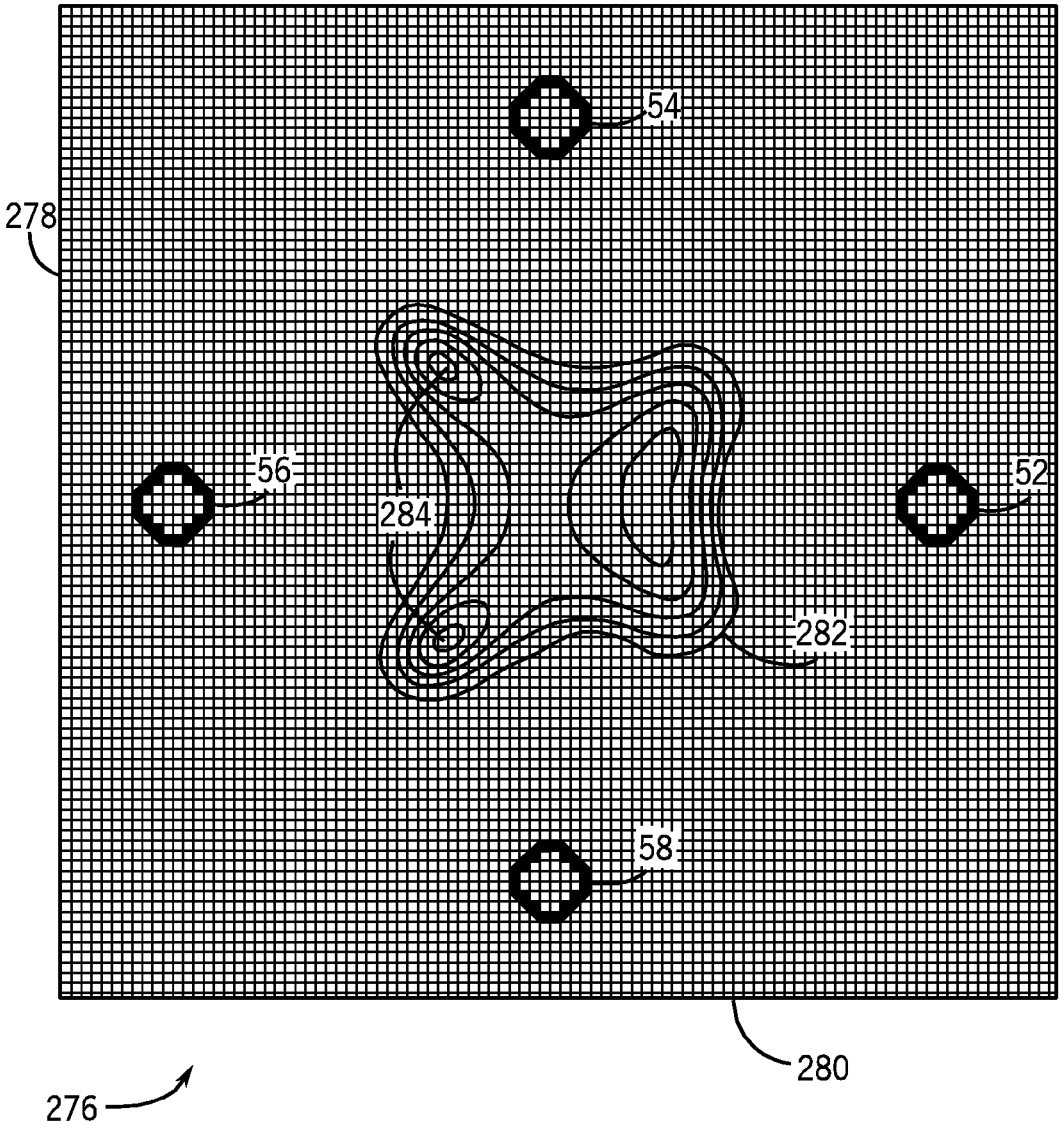
FIG. 20 is a plot of $Q(x_m,y_m)$ when the BHA is located at (0.5,0.1)

FIGS. 20-24 offer similar 2-D plots of the function $Q(x_m, y_m)$ for different positions of the BHA 66 following the drift trajectory 214 of y=0.2x. Turning first to FIG. 20, a plot 276 of the function $Q(x_m, y_m, y_m)$ indicates the true position of the BHA 66 at (x,y)=(0.5,0.1). An ordinate 278 represents a range of $y_m \in [-2.6,2.6]$ in the y-direction and abscissa 280 represents a range of $x_m \in [-2.6, 2.6]$ in the x-direction. The location of the casings of the existing wells 52, 54, 56, and 58 in the plot 276 are marked accordingly. The 2-D plot 276 for $Q(x_m, y_m, y_m)$ includes contour lines 282 in increments of 20 nanoTesla (nT). The largest value for a contour line is 100 nanoTesla (nT). The smallest value for a contour line is 20 nT, and it lies to the right of the origin, centered near (x,y)=(0.5,0.1). The area within this contour line indicates that the measured magnetic field is within 20 nT of the theoretical value for the magnetic field. This contour line 2 indicates that the BHA 66 is within the contour line centered on (x,y)=(0.5,0.1). However, it should be noted there are also two areas to the left of the origin that are also minima 284 of $Q(x_m,y_m)$.

Figure 21:
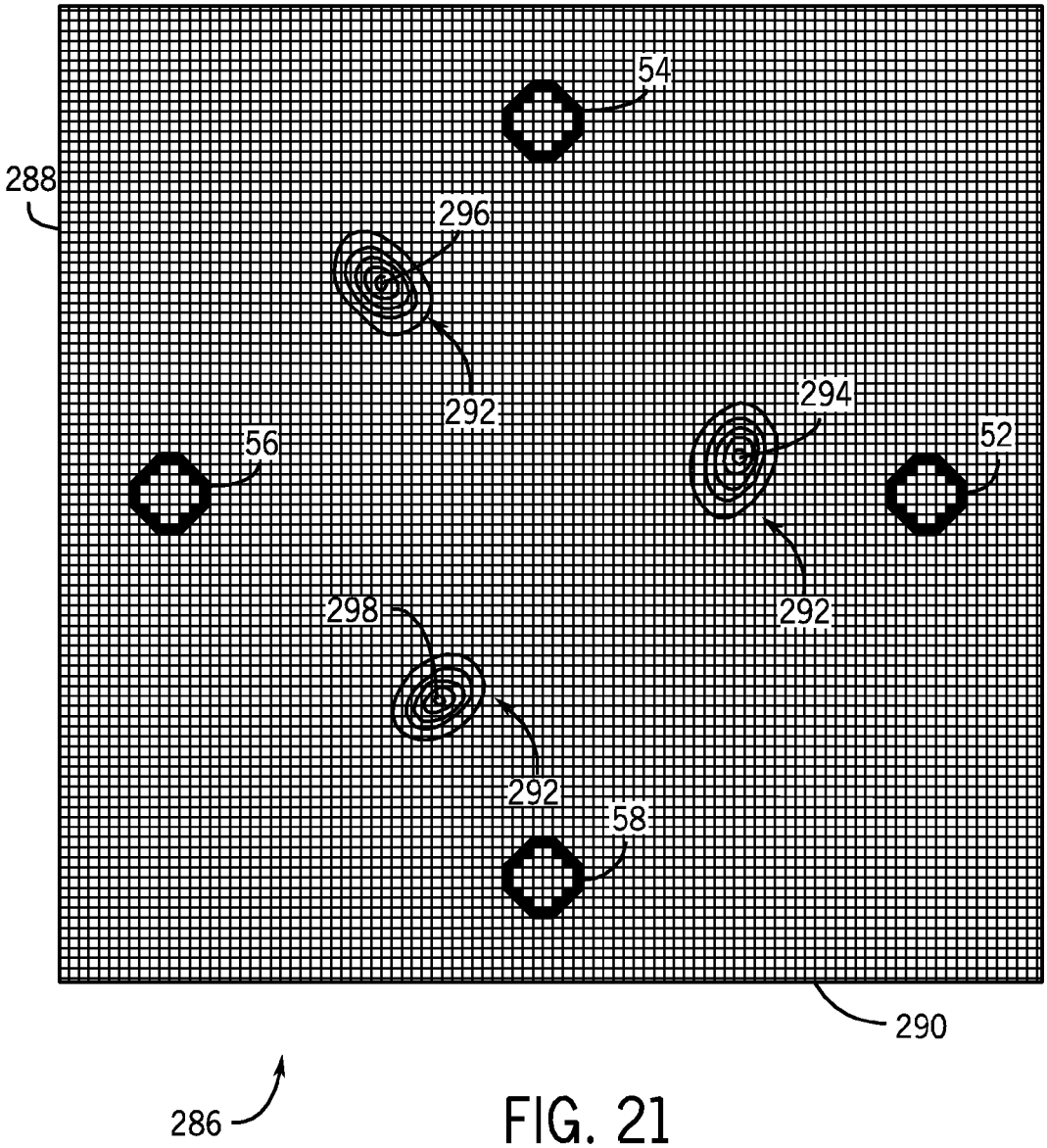
FIG. 21 is a plot of $Q(x_m,y_m)$ when the BHA is located at (1.0,0.2)

FIG. 21 depicts a plot 286 of the function $Q(x_m,y_m)$ where the true position of the BHA 66 is at (x,y)=(1.0,0.2). An ordinate 288 represents a range of $y_m \in [-2.6,2.6]$ in the y-direction and abscissa 290 represents a range of $x_m \in [-2.6,2.6]$ in the x-direction. The location of the casings of the existing wells 52, 54, 56, and 58 in the plot 286 are marked accordingly. The 2-D plot 286 for $Q(x_m,y_m)$ further includes contour lines 292 in increments of 20 nanoTesla (nT). The largest value plotted is 100 nanoTesla (nT).

As apparent in the plot 286 of FIG. 21, there are three minima 294, 296, and 298 of $Q(x_m,y_m)$. The minimum 294 to the right of the origin at (x,y)=(1.0,0.2) represents the true position of the BHA 66, and is located to within ±0.05 m for measurement accuracy of 20 nanoTesla (nT). However, the two minima 296 and 298 to the left of the origin at (x',y')=(−0.90,1.15) and (x",y")=(−0.60,−1.10), respectively, are false positions or ghost images.

Figure 22:
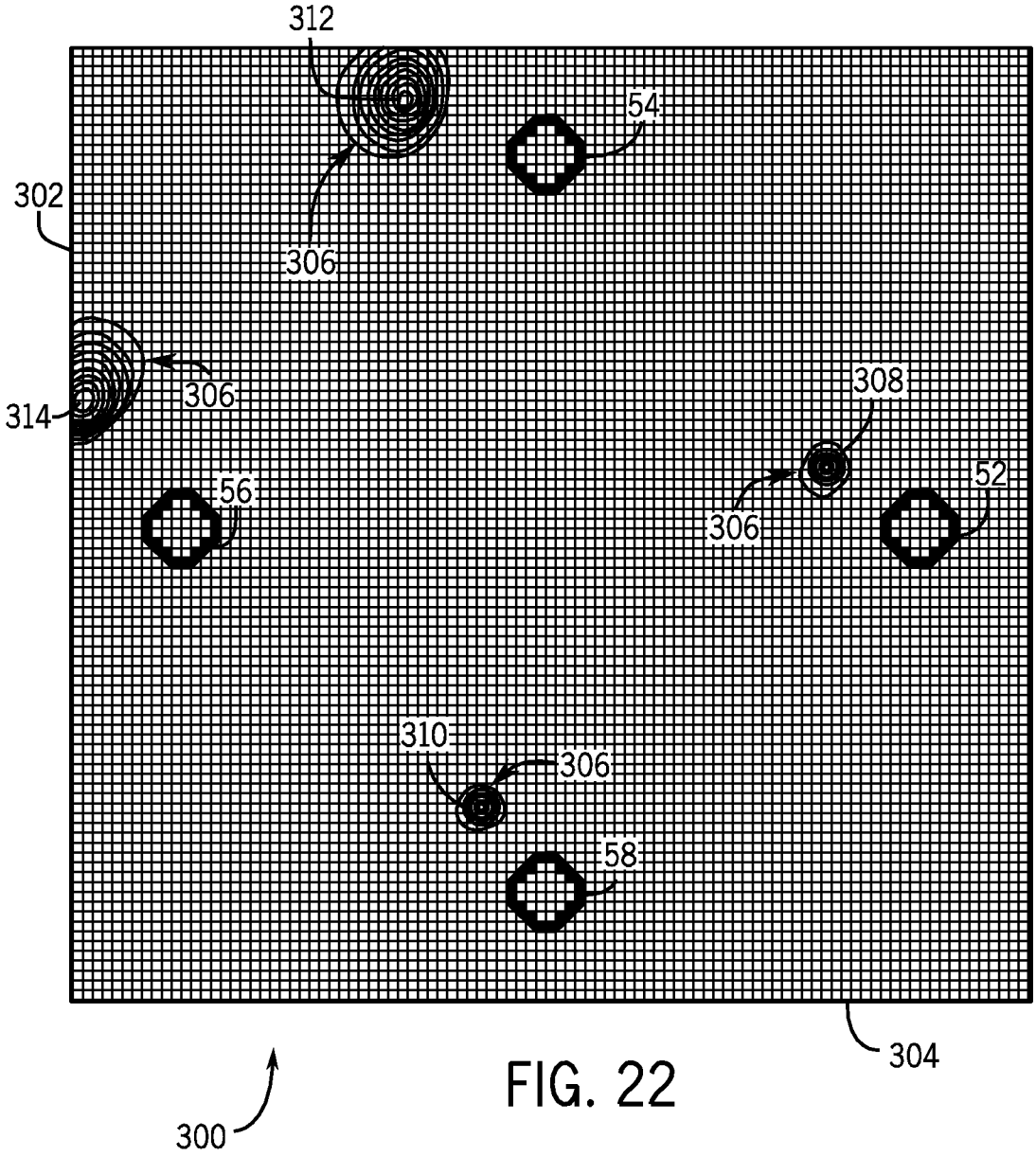
FIG. 22 is a plot of $Q(x_m,y_m)$ when the BHA is located at (1.5,0.3)

FIG. 22 depicts a plot 300 of the function $Q(x_m,y_m)$ where the true position of the BHA 66 at (x,y)=(1.5,0.3). An ordinate 302 represents a range of $y_m \in [-2.6, 2.6]$ in the y-direction and abscissa 304 represents a range of $x_m \in [-2.6, 2.6]$ in the x-direction. The location of the casings of the existing wells 52, 54, 56, and 58 in the plot 300 are marked accordingly. The plot 300 for $Q(x_m,y_m)$ includes contour lines 306 in increments of 20 nanoTesla (nT). The largest value plotted is 200 nanoTesla (nT).

As apparent in the plot 300 of FIG. 22, there are four minima 308, 310, 312, and 314 of $Q(x_m,y_m)$. The minimum 308 to the right of the origin at (x,y)=(1.5,0.3) represents the true position of the BHA 66, and is located to within ±0.05 m for measurement accuracy of 20 nanoTesla (nT). As in the plot 286 of FIG. 22, the remaining minima 310, 312, and 314 are ghost images.

Figure 23:
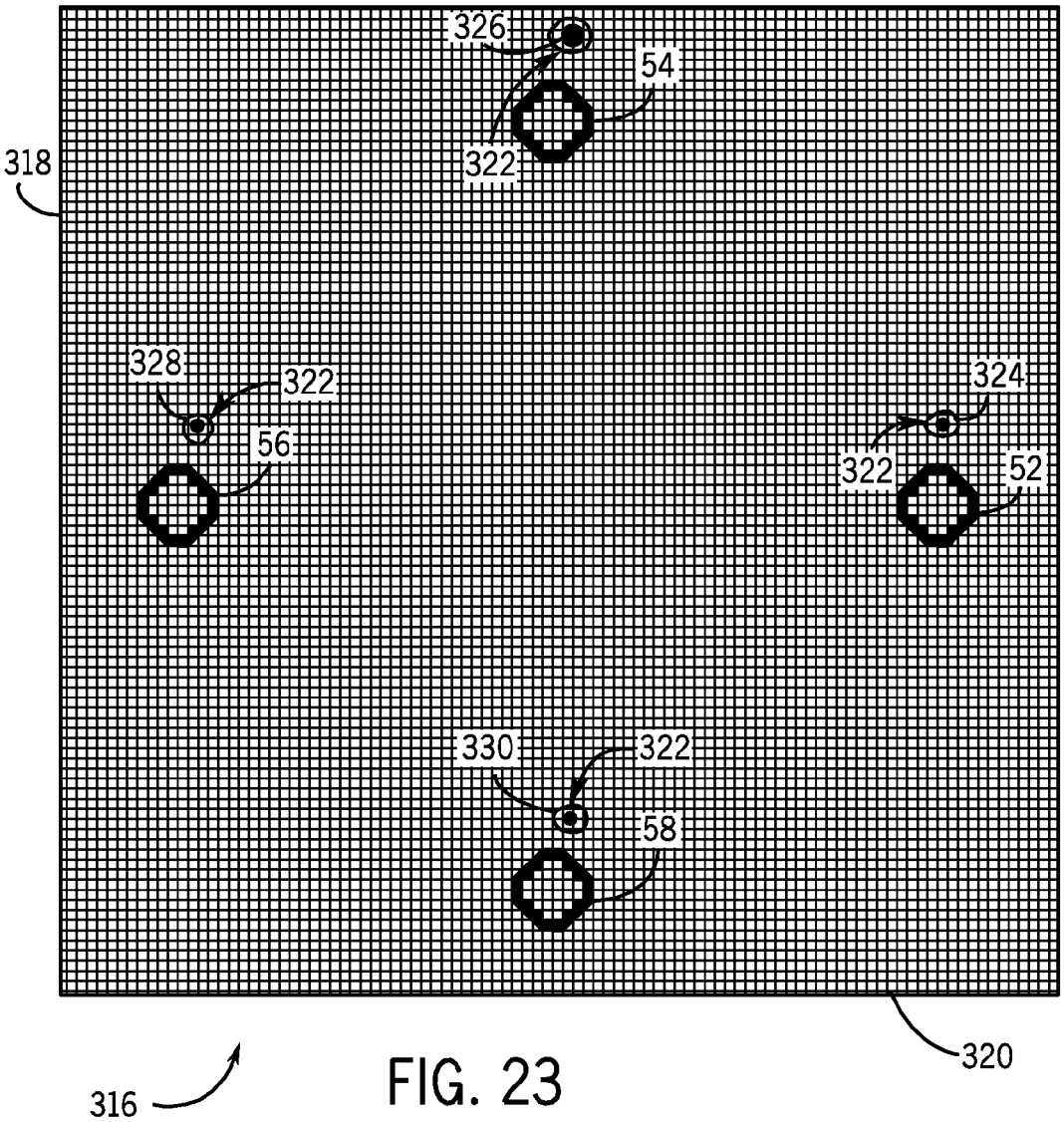
FIG. 23 is a plot of $Q(x_m,y_m)$ when the BHA is located at (2.0,0.4)
Figure 24:
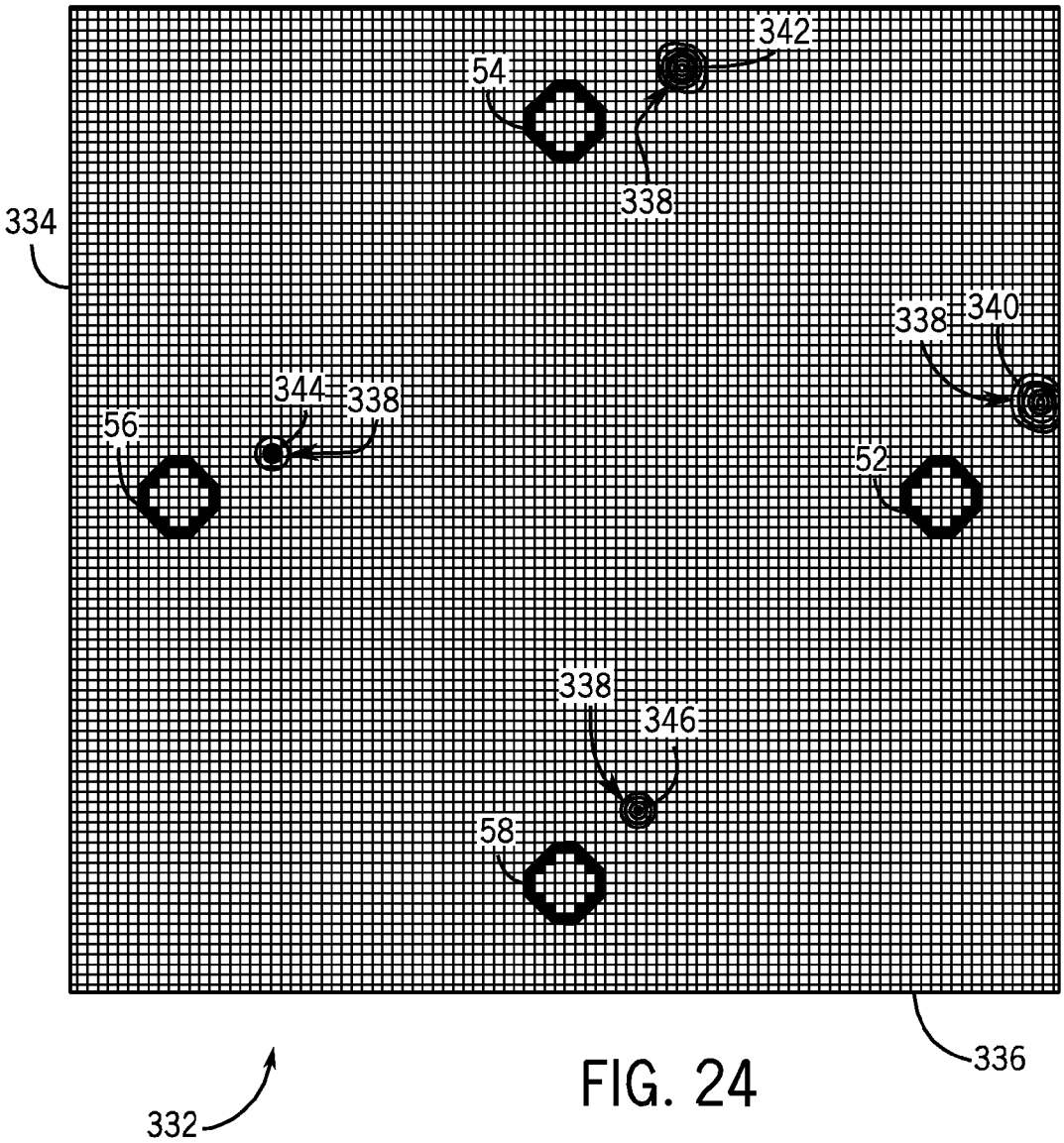
FIG. 24 is a plot of $Q(x_m,y_m)$ when the BHA is located at (2.5,0.5)

FIGS. 23 and 24 illustrate plots of the function $Q(x_m,y_m)$ when the BHA 66 is located at (x,y)=(2.0,0.4) and (x,y)=(2.5, 0.5), respectively. Turning first to FIG. 23, the true position of the BHA 66 is (x,y)=(2.0,0.4). An ordinate 318 represents a range of $y_m \in [-2.6,2.6]$ in the y-direction and abscissa 320 represents a range of $x_m \in [-2.6, 2.6]$ in the x-direction. The locations of the casings of the existing wells 52, 54, 56, and 58 in the plot 316 are marked accordingly. The 2-D plot 316 for $Q(x_m,y_m)$ includes contour lines 322 in increments of 20 nanoTesla (nT). The largest value plotted is 200 nanoTesla (nT).

As apparent in the plot 316 of FIG. 23, there are four minima 324, 326, 328, and 330 of $Q(x_m,y_m)$. The minimum 324 to the right of the origin at (x,y)=(2.0,0.4) represents the true position of the BHA 66. However, the remaining minima 326, 328, and 330 are ghost images. Thus, a single measurement at one depth would not provide sufficient data to ascertain which minimum corresponds to the position of the BHA 66 and which minima are ghost images.

Similarly, FIG. 24 depicts a plot 322 where the true position of the BHA 66 is at (x,y)=(2.5,0.5). An ordinate 334 represents a range of $y_m \epsilon [-2.6,2.6]$ in the y-direction and abscissa 336 represents a range of $x_m \epsilon [-2.6,2.6]$ in the x-direction. The locations of the casings of the existing wells 52, 54, 56, and 58 in the plot 332 are marked accordingly. The 2-D plot 332 for $Q(x_m,y_m)$ includes contour lines 338 in increments of 20 nanoTesla (nT). The largest value plotted is 200 nanoTesla (nT).

As apparent in the plot 332 of FIG. 24, there are four minima 340, 342, 344, 346 of $Q(x_m,y_m)$. The minimum 340 to the right of the origin at (x,y)=(2.5,0.5) represents the true position of the BHA 66. However, the remaining minima 342, 344, 346 are ghost images. Thus, a single measurement at one depth would not provide sufficient data to ascertain which minimum corresponds to the position of the BHA 66 and which minima are ghost images.

Figure 25:
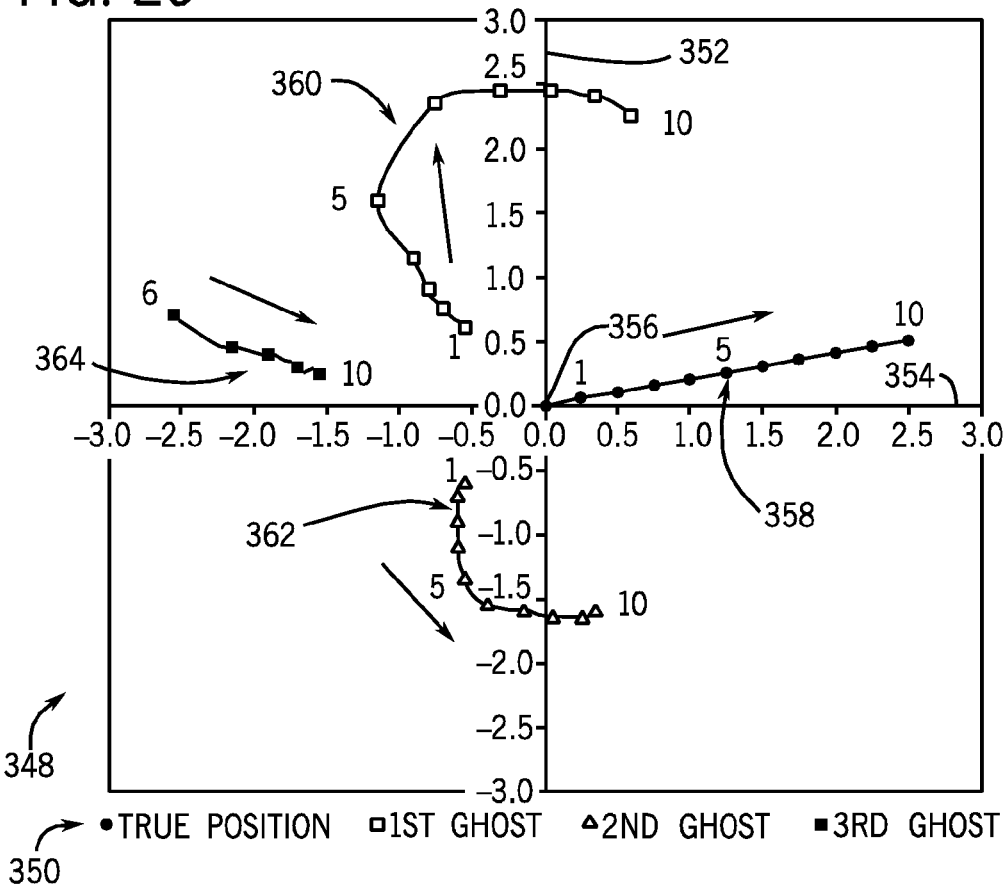
FIG. 25 is a plan view of trajectories of minima of $Q(x_m, y_m)$ plotted at different depths of the BHA.

To distinguish the true location of the BHA 66 from the false positions or ghost images which may arise, a sequence of measurements may be obtained at different depths which may indicate the true position of the BHA 66 over the ghost images. Turning to FIG. 25, a plan view 348 shows the minima of $Q(x_m,y_m)$ for BHA 66 at various depths. A legend 350 indicates the true position of the BHA 66 and three ghost images. An ordinate 352 represents a range of $y_m \epsilon [-3,3]$ in the y-direction and abscissa 354 represents a range of $x_m \epsilon [-3,3]$ in the x-direction. In the plan view 348, the minima of $Q(x_m,y_m)$ are plotted for increments of $\Delta x=0.25$ m, $\Delta y=0.05$ m for every 10 m increase in BHA 66 depth.

The initial position 356 of the BHA 66 is at the origin, (x,y)=(0,0), a logical starting point at the surface to drill another well amid the existing wells 52, 54, 56, and 58. Since the initial position 356 of the BHA 66 is known, the sequence of measurements versus depth may be used to differentiate the true trajectory 358 from the ghost trajectories 360, 362, and 364. At the first measured depth (10 m), the minima of $Q(x_m,y_m)$ which are plotted are labeled "1." Among the points labeled "1", the point labeled "1" in the true trajectory 358 may be more probably understood to be the true location of the BHA 66 than the first ghost trajectory 360 or the second ghost trajectory 362 because the step-out is smaller. Moreover, the step-out should be appreciated to be more consistent with an expected deviation from the BHA 66 drilling tendencies or MWD direction and inclination errors.

As the well is drilled, the true trajectory 358 follows a relatively straight line with relatively consistent increments in the position on the x-y plane. Meanwhile, the first ghost trajectory 360 and the second ghost trajectory 362 are curved and their increments are more erratic. Furthermore, the third ghost trajectory 364 does not even appear until the sixth depth measurement is made, and thus may clearly be eliminated as a ghost image. An interpreter could differentiate the true trajectory 358 from the ghost trajectories 360, 362, and 364 based on a plot such as the plot 348.

Figure 26:
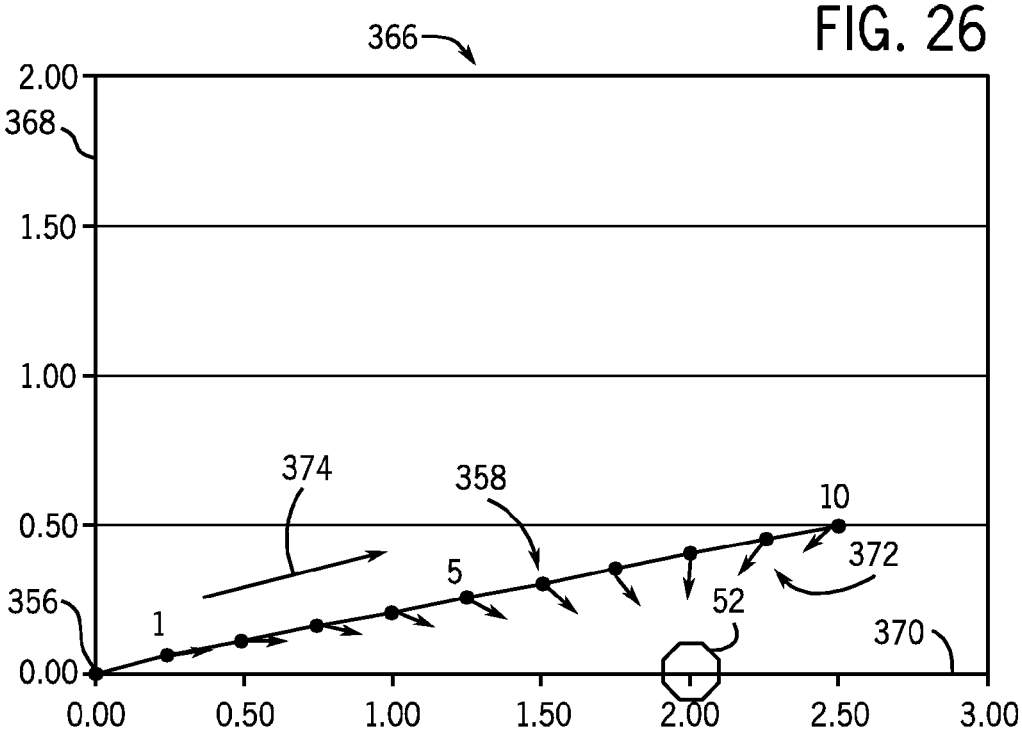
FIG. 26 is a plot indicating a true trajectory of the plan view of FIG. 25 with apparent directions illustrated as arrows.

FIGS. 26-28 illustrate how additional information may clarify the interpretation and further distinguish the true trajectory from ghost trajectories which may arise. Turning first to FIG. 26, a plot 366 denotes the computed apparent direction $$\gamma_a = \tan^{-1}\left(\frac{-Bx}{By}\right)$$

to the casing of the nearest well, existing well 52, for the true trajectory 358. In the plot 366, a numeral 368 denotes the y-axis and a numeral 370 denotes the x-axis. Directional arrows 372 indicate the apparent direction ($\gamma_a$) to the nearest casing for each point along the true trajectory 358 and an arrow 374 indicates the movement of the true trajectory 358. As illustrated in the plot 366, the apparent positions and directions show a high degree of consistency with the casing of the existing well 52 located at $(x_1,y_1)$=(2,0). All of the directional arrows 372 point toward the casing at $(x_1,y_1)$=(2,0), beginning with the point labeled "1."

FIG. 27 depicts a plot 376 denoting the computed apparent direction $$\gamma_a = \tan^{-1}\left(\frac{-Bx}{By}\right)$$

for each point of the ghost trajectory 360. In the plot 376, the numeral 368 denotes the y-axis and the numeral 370 denotes the x-axis. Arrows 378 indicate the movement of the ghost trajectory 360 and directional arrows 372 indicate the apparent direction ($\gamma_a$) to the nearest casing for each point along the ghost trajectory 360.

As illustrated in the plot 376, the apparent positions and directions for the ghost trajectory 360 are not as consistent as those associated with the true trajectory 358. The inconsistencies are especially notable near the origin. For example, the first point, labeled "1," is located to the left of the origin to (x,y)=(−0.55,0.60), and hence is thus further from the casing of the existing well 52 at $(x_1,y_1)$=(2,0) than the casing of the existing well 54 at $(x_2,y_2)$=(0,2). However, the directional arrow for point "1" points toward the casing of the existing well 52. Thus, point "1" is clearly shown not to represent a part of the true trajectory 358. Not until the sixth point in the ghost trajectory 360 does the directional arrow point toward the nearest casing, located at $(x_2,y_2)$=(0,2).

Similar conclusions may be drawn from FIG. 28, which depicts a plot 382 denoting the computed apparent direction $$\gamma_a = \tan^{-1}\left(\frac{-Bx}{By}\right)$$

for each point of the ghost trajectory 362. In the plot 382, the numeral 368 denotes the y-axis and the numeral 370 denotes the x-axis. Arrows 384 indicate the movement of the ghost trajectory 362 and directional arrows 386 indicate the apparent direction ($\gamma_a$) to the nearest casing for each point along the ghost trajectory 362. As similarly illustrated in the plot 376 of FIG. 27, in the plot 382 of FIG. 28, the apparent positions and directions for the ghost trajectory 362 are not as consistent as those associated with the true trajectory 358.

The data presented in FIGS. 25-28 may greatly enhance the ability to avoid a collision with one of the existing wells 52, 54, 56, or 58. However, even without such data, a driller may be able simply to steer the BHA 66 away from a well casing. Suppose a driller were to make a decision as to which way to steer the BHA 66 based solely on the data illustrated in the plot 316 of FIG. 23. The true position is (x,y)=(2.0,0.4), as indicated by the minimum 324, and the ghost images are at (x',y')=(0.05,2.45), (x",y")=(0.05,−1.65), and (x'",y '")=(−1.9,0.4), as indicated by the minima 326, 328, and 330. Suppose an alarm based on the apparent distance has alerted the driller to an impending collision, but the driller does not have the historical sequence of measurements to tell him which minima of the plot 316 are ghosts. For all four possible positions indicated by the minima 324, 326, 328, and 330, the apparent direction remains the same, $\gamma_a=-1.69$ radians or $-97°$. Thus, the driller would know to steer at 83°, thus avoiding a collision with the casing, despite not knowing which minimum represents the true position and which minima represent ghost images.

Figure 29B:
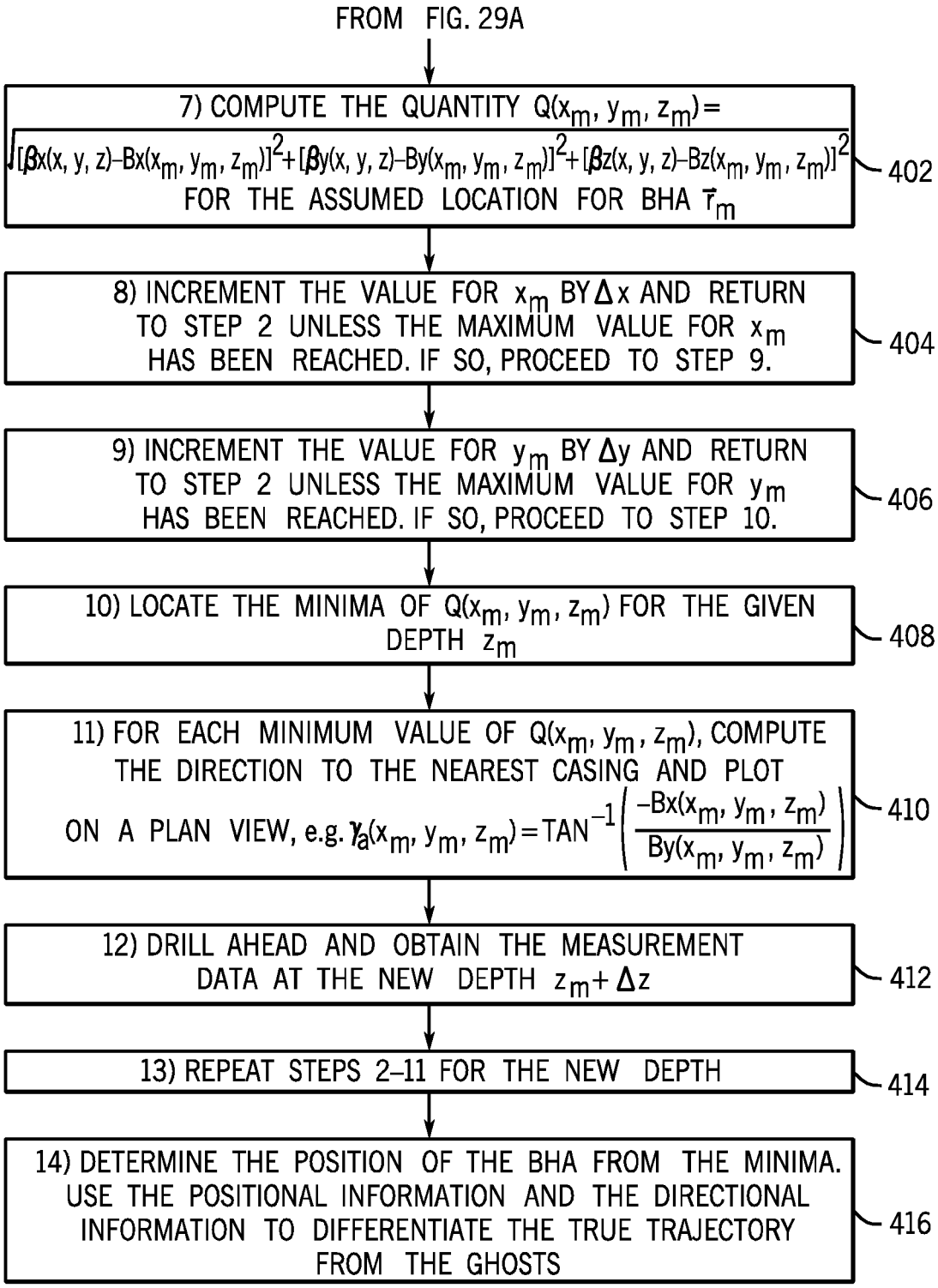
FIG. 29 A-B is a flowchart depicting a technique for determining the position of the BHA when positions of the cased wells are known in accordance with an embodiment of the invention.

FIG. 29 is a flowchart 388 representing a general embodiment of the same approach which may be applied for other well configurations with any number of cased wells surrounding the BHA 66. The principle remains the same, but the geometry may be different. In a first step 390, the locations of cased wells versus depth are defined as $\vec{r}_i=(x_i,y_i,z_i)$ for i={1, 2, 3, . . . , n} where $\vec{r}_i$ represents the assumed location of the $i^{th}$ cased well and n represents the total number of nearby cased wells. The $\{\vec{r}_i\}$ will remain fixed throughout the procedure. The diameter of each cased wells is similarly defined as Di.

In step 392, for a given depth $z_m$, a location for the magnetometer 94 may be assumed as $\vec{r}_m=(x_m,y_m,z_m)$, where $x_m$ and $y_m$ will incremented over a range of values. In a subsequent step 394, the conductance G, between the BHA 66 and each cased well may be computed according to the relationship $$Gi = \frac{\pi\sigma}{\cosh^{-1}(S_i/D)},$$

where $$S_i = \sqrt{(x_m - x_i)^2 + (y_m - y_i)^2}.$$

Similarly, the conductance may also be computed between each pair of cased wells. In both cases, the computations should take into account formation resistivity, cement resistivity, and bedding.

Turning next to step 396 of the flowchart 388, the current 84 on each casing, Ii, may be computed for the assumed position of the BHA 66, $\vec{r}_m$. In step 398, the magnetic field 90 at the magnetometer 94 for the assumed BHA 66 position $\vec{r}_m$ may be computed according to the relationship $$\vec{B}(x_m, y_m, z_m) = \sum_{i=1}^{n} \vec{B}i(x_m, y_m, z_m) = \sum_{i=1}^{n} \frac{\mu_0 I_i(z_m)}{2\pi S_i^2} \hat{n} \times (\vec{r}_m - \vec{r}_i),$$

where $\hat{n}$ represents a unit vector in the direction of the $i^{th}$ well.

In step 400, the induced magnetic field 90 may be measured with the three-axis magnetometer 94 to obtain the quantities $\vec{\beta}(x,y,z)=\beta x(x,y,z)\hat{x}+\beta y\ (x,y,z)\hat{y}+\beta z(x,y,z)\hat{z}$, where $\vec{r}=(x,y,z)$ represents the actual position of the BHA 66 which is to be determined. Having obtained the magnetic field 90 measurements, in step 402, the quantity $$Q(x_m, y_m, z_m) = \sqrt{\begin{array}{l}[\beta x(x, y, z) - Bx(x_m, y_m, z_m)]^2 + \\ [\beta y(x, y, z) - By(x_m, y_m, z_m)]^2 + \\ [\beta z(x, y, z) - Bz(x_m, y_m, z_m)]^2\end{array}}$$

may be computed for the assumed location for the BHA 66, $\vec{r}_m$.

Continuing with step 404 of the flowchart 388 of FIG. 29, the value for $x_m$ may be incremented by $\Delta x$. Unless the maximum value for $x_m$ has been reached, the process returns to the second step 392. However, if the maximum value for $x_m$ has been reached, the process continues to a ninth step 406. In step 406, the value for $y_m$ may be incremented by $\Delta y$. Unless the maximum value for $y_m$ has been reached, the process next returns to the second step 392. However, if the maximum value for $y_m$ has been reached, the process continues to a tenth step 408.

Tenth step 408 involves locating the minima of $Q(x_m,y_m,z_m)$ for the given depth $z_m$. In step 410, a direction to the nearest casing for each minimum value of $Q(x_m,y_m,z_m)$ may be computed. Once computed, the apparent direction may be plotted on a plan view, such that $$\gamma_a(x_m, y_m, z_m) = \tan^{-1}\left(\frac{-Bx(x_m, y_m, z_m)}{By(x_m, y_m, z_m)}\right).$$

Continuing to drill in step 412, measurement data may be obtained at a new depth $z_m+\Delta z$. In step 414 which follows, the process returns to second step 392 to perform steps 392-410 with data obtained at the new depth. Finally, in step 416, the position of the BHA 66 may be determined from the minima plotted in step 410. Using both the positional information and the directional information, the true trajectory of the BHA 66 may be differentiated from the ghost trajectories of the minima The approaches described above rely entirely on magnetic ranging data to resolve ambiguities that arise in estimating the actual position, (x,y), of the BHA 66 containing the magnetometer 94 when the objective function $Q(x_m,y_m)$ has multiple minima Another approach may be to use the survey data to supplement the ascertainment of the actual position of the BHA 66 from the many ghost positions which may be represented by the minima in $Q(x_m,y_m)$. As discussed above, when wells are tightly clustered, as in the example discussed above involving the existing wells 52, 54, 56, and 58, available survey data may not provide sufficient precision for drilling to continue within a desired margin of error. Nevertheless, the survey data may still contain additional information to resolve some ambiguities that may arise in the inversion of the ranging data.

The uncertainty in the position of a well bore resulting from survey errors can be described by a Gaussian probability distribution of the following form:

$$F(x, y, z) = \frac{1}{(2\pi)^{3/2}\sigma_x\sigma_y\sigma_z}\exp\left\{-\frac{(x-x')^2}{2(\sigma_x)^2} - \frac{(y-y')^2}{2(\sigma_y)^2} - \frac{(z-z')^2}{2(\sigma_z)^2}\right\}. \quad (13)$$

In equation (13) above, (x',y',z') represents the well bore location obtained from the survey data, and $\sigma_x$, $\sigma_y$, and $\sigma_z$ represent the standard deviations derived from measurement errors. It should be noted that the coordinate system, (x,y,z), is chosen such that there is null covariance between any two directions. Thus, the coordinate system to achieve such a result generally defines z along the wellbore, x in the vertical plane containing the wellbore, and y perpendicular to the x-z plane. As such, the coordinate system tends to decouple measured depth ("along hole") errors, inclination errors, and azimuth errors.

An ellipsoid of uncertainty 22 (as depicted in FIG. 1) may be defined such that there is a given probability that the actual well falls inside the ellipsoid. Such an ellipsoid of uncertainty 22 may be centered on the location indicated by the survey data, (x',y',z'), may have semi-axes $k\sigma_x$, $k\sigma_y$, and $k\sigma_z$, and may be described according to the following equation:

$$\left(\frac{x-x'}{\sigma_x}\right)^2+\left(\frac{y-y'}{\sigma_y}\right)^2+\left(\frac{z-z'}{\sigma_z}\right)^2=k^2. \tag{14}$$

By way of example, there is a 20% probability that the well lies within the ellipsoid defined by equation 14 when k=1. Similarly, there is an 86% probability that the well lies within the ellipsoid defined by equation 14 when k=2.

For the case of nearly parallel, vertical wells, the "along hole" errors correspond to $\sigma_z$, while the inclination and direction errors may combine to affect $\sigma_x$ and $\sigma_y$. Because the relative angle between the BHA 66 and a cased well is small, an error in depth does not translate to a significant error in the x or y directions, in which there may be a risk of a collision. Hence, the probability distribution may be reduced to two dimensions (x,y) at any given depth z. Although not necessarily true in general, it may also be assumed that $\sigma_x=\sigma_y=\sigma$ for simplicity. The probability density function at a given depth z may be defined by the following equation:

$$F(x,y)=\frac{1}{(2\pi)\sigma^2}\exp\left\{-\frac{(x-x')^2}{2\sigma^2}-\frac{(y-y')^2}{2\sigma^2}\right\} \tag{15}$$

The three dimensional ellipsoid may reduce to a two dimensional circle, as defined by the following equation:

$$(x-x')^2+(y-y')^2=(k\sigma)^2 \tag{16}$$

For such a special case, the probability is given by $1-\exp(-0.5\,k^2)$. Thus, there is a 39% probability that the well lies within the circle defined by equation (16) when k=1, and a 95% probability that the well lies within the ellipsoid defined by k=2.45.

Figure 30A:
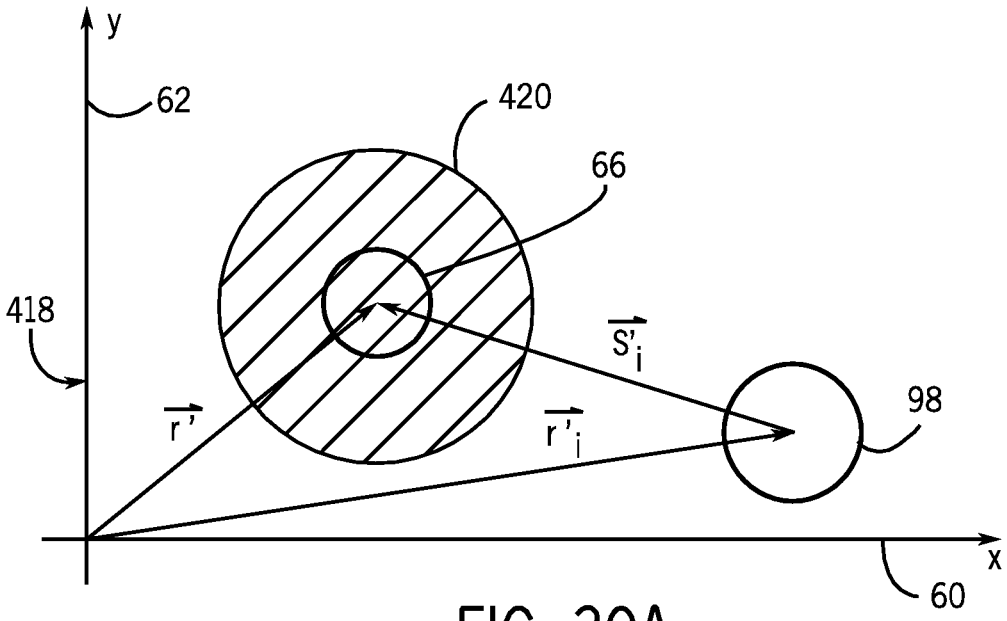
FIGS. 30A and 30B depict a position of the BHA according to a survey and an actual position of the BHA respectively.

FIG. 30A illustrates the situation described above with a well placement schematic 418. The well placement schematic 418 depicts the predicted location of the BHA 66 relative to an $i^{th}$ cased well 98. The numeral 60 represents the x-axis, while the numeral 62 represents the y-axis. The survey data predicts the BHA 66 location to be $\vec{r}'=(x',y')$, with a one sigma circle 420 of radius σ centered on $\vec{r}'$. The survey data for the $i^{th}$ cased well 98 indicates that it is located at $\vec{r}_i'$ and hence the two surveys predict that the separation between the BHA 66 and the $i^{th}$ cased well 98 is $\vec{S}_i'=\vec{r}'-\vec{r}_i'$. If the only uncertainty came from the BHA 66 survey, but the position of the $i^{th}$ cased well was known exactly, then one would need $|\vec{S}_i'|\geqq 2.456$ for a 5% probability of collision with the cased well. However, the above equation is true only with perfect knowledge of the location of the $i^{th}$ cased well 98. Equations to here . . . .

In reality, the position of the $i^{th}$ cased well 98 is also described by a Gaussian probability distribution with an uncertainty, $\sigma_i$, associated with it. Hence, the actual condition for a 5% probability of a collision may be described according to the following equation:

$$|\vec{S}_i'|\geqq 2.445\sqrt{\sigma^2+\sigma_i^2} \tag{17}$$

The uncertainty of the $i^{th}$ cased well 98 may be accounted for in the Gaussian probability distribution with the following equations:

$$\sigma\rightarrow\tilde{\sigma}=\sqrt{\sigma^2+\sigma_i^2}\,; \tag{18}$$

$$F(x,y)=\frac{1}{(2\pi)\tilde{\sigma}^2}\exp\left\{-\frac{(x-x')^2}{2\tilde{\sigma}^2}-\frac{(y-y')^2}{2\tilde{\sigma}^2}\right\}. \tag{19}$$

Equation (18) combines the standard deviation for the BHA 66 with the standard deviation for a cased well to obtain an effective standard deviation $\tilde{\sigma}$. Equation (19) expands the width of the Gaussian probability distribution to include the uncertainties from the surveys of the cased wells. In equation (19), the most likely position for the BHA 66 is still the survey result, $\vec{r}'$.

Figure 30B:
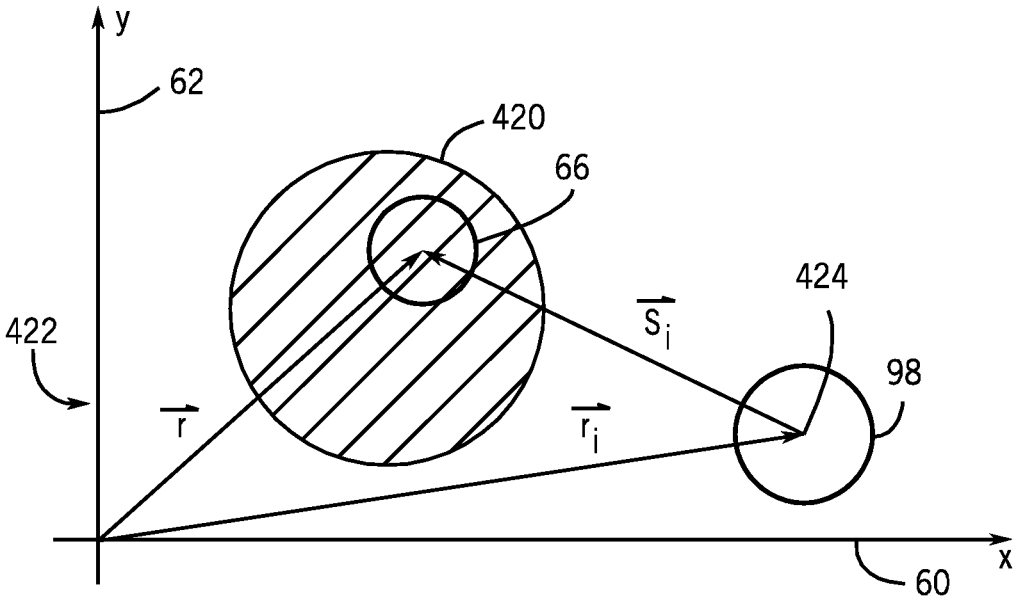

FIG. 30B depicts the actual position of the BHA 66 in a well placement schematic 422. In the well placement schematic 422, the numeral 60 represents the x-axis, while the numeral 62 represents the y-axis. The BHA 66 is actually located at $\vec{r}$ which, according to the Gaussian probability distribution, has a 39% probability of being in the one sigma circle 420 centered on $\vec{r}'$. The true location for the $i^{th}$ cased well 98 is $\vec{r}_i$, and the true separation between the BHA 66 and the $i^{th}$ cased well 98 is $\vec{S}_i=\vec{r}-\vec{r}_i$. However, to proceed with the analysis it may be assumed that the $i^{th}$ cased well 98 is actually located at a point of maximum probability 424, such that $\vec{r}_i=\vec{r}'$. While this assumption is not true in general, the uncertainty in the separation between the BHA 66 and the $i^{th}$ cased well has been accounted for by equations (18) and (19). Alternatively, a Gaussian probability distribution function for each cased well can be used with that for the BHA 66. However, this alternative approach only adds to the mathematical complexity. The simpler approach using equations (18) and (19) adequately illustrates the principle.

Figure 31:
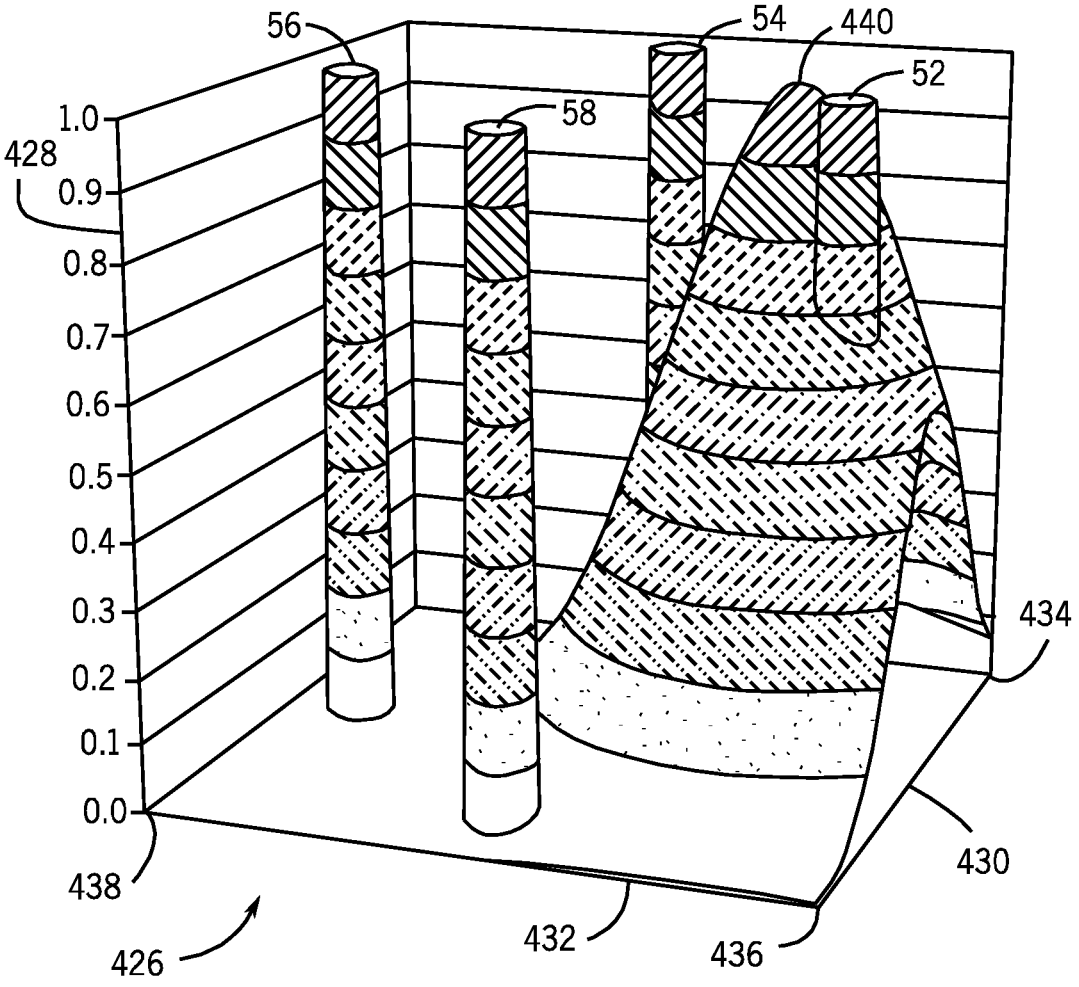
FIG. 31 is a plot of probability density function for a first survey point.
Figure 32:
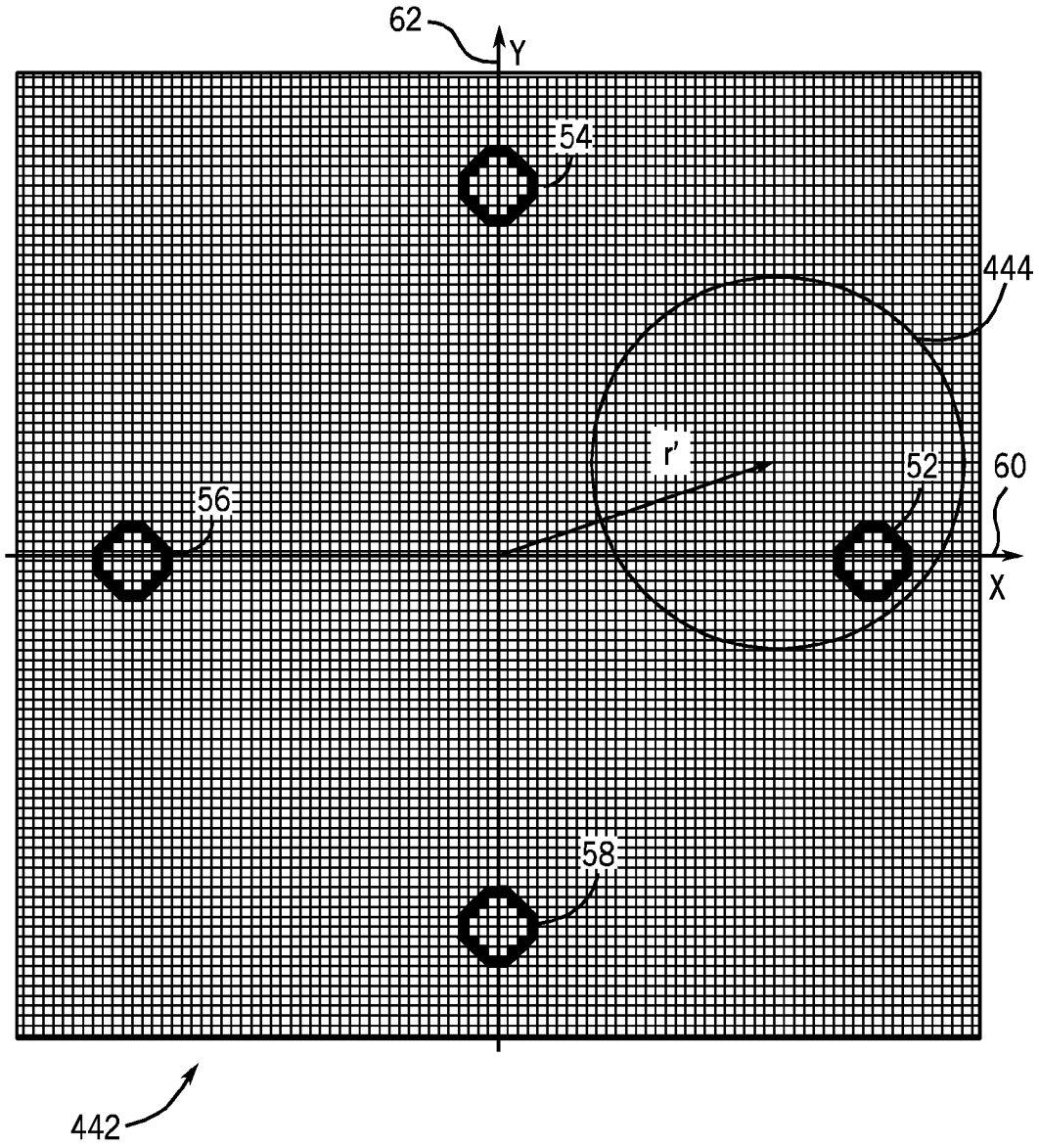
FIG. 32 is a plot of probability density function for a second survey point.

FIGS. 31 and 32 depict two views of a Gaussian probability function for the magnetic ranging illustrated in FIG. 21. Considering that it is desirable to resolve magnetic ranging ambiguities using the survey data while including the uncertainties in the survey data, a Gaussian probability function as given by equations (18) and (19) may be combined with the magnetic ranging illustrated in FIG. 21. Recalling FIG. 21, there are three possible locations for the BHA 66 derived from the quantity $Q(x_m,y_m)$. One location is the true position at $\vec{r}=(1.0,0.2)$, while the other two locations are ghosts.

Turning to FIG. 31, a 3-D probability density plot 426 illustrates probability 428 from 0 to 1 in increments of 0.1 for the locations of the existing wells 52, 54, 56, and 58 and the BHA 66. A numeral 430 indicates the y-direction over the range $y_m\epsilon[-2.6,2.6]$ and a numeral 432 indicates the x-direction over the range $x_m\epsilon[-2.6,2.6]$, such that a point 434 is located at (x,y)=(2.6,2.6), a point 436 is located at (x,y)=(2.6,−2.6), and a point 438 is located at (x,y)=(−2.6,−2.6). The locations of the existing wells 52, 54, 56, and 58 are represented by a probability of 1, as such data is assumed to be known. The casing diameters for the existing wells 52, 54, 58, and 58 are shown in FIG. 31, while the Gaussian probability density is shown for the BHA 66. A peak amplitude 440 of the probability density distribution of the location of the BHA 66 is normalized to 1, representing survey data which may be available predicting the BHA 66 location as $\vec{r}'=(1.5,0.5)$ with an uncertainty of $\tilde{\sigma}=1$.

FIG. 32 depicts a probability density plot 442 corresponding to the 3-D probability density function plot 426 of FIG. 31. The probability density plot 442 similarly illustrates the location of a one sigma circle 444, which indicates a high probability of the location of the BHA 66. The x-axis 60 indicates the x-direction over a range $x_m \epsilon [-2.6, 2.6]$ and the y-axis 62 indicates the y-direction over a range $y_m \epsilon [-2.6, 2.6]$. The probability density plot 442 further indicates the location of the existing wells 52, 54, 56, and 58. The one sigma circle 444 encircles the casing of the existing well 52 located at $\vec{r}_1=(2,0)$, indicating a high probability of a collision between the BHA 66 and the existing well 52. Because the probability density data is provided by survey data alone, the new well being drilled by the BHA 66 could not be drilled with certainty if only survey data were available.

The survey data can be combined with the magnetic ranging information to improve the knowledge of the BHA 66 location. The probability distribution can be modified to include the magnetic ranging data by weighting the Gaussian probability density by $\xi(x,y)$ as indicated by the following relationship:

$$H(x, y) = \frac{F(x, y)}{\xi(x, y)}. \tag{20}$$

Figure 33:
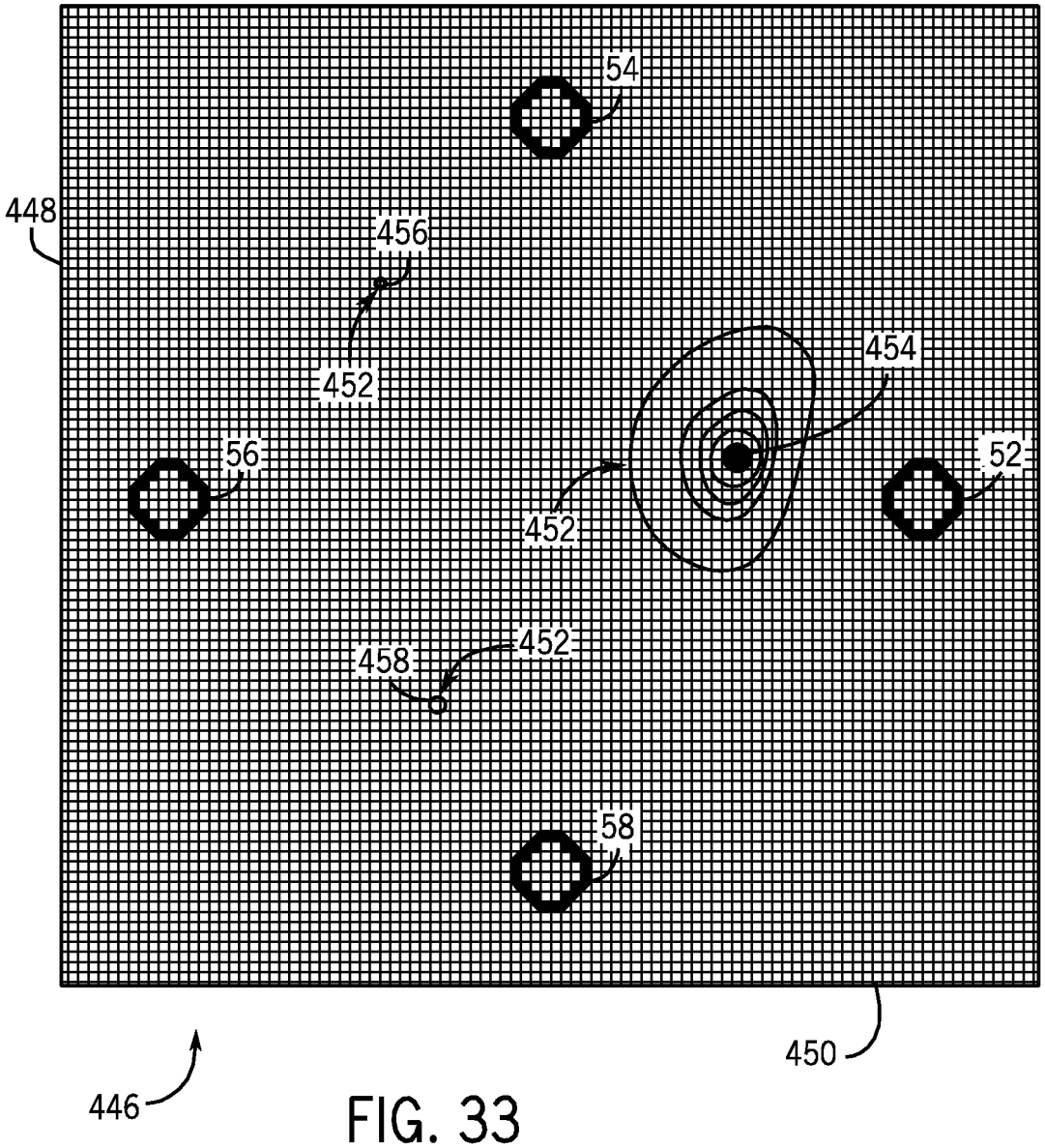
FIG. 33 is a plot of probability density function for a third survey point.

FIG. 33 depicts a plot 446 illustrating the weighted probability density function $H(x_m,y_m)$, for $\vec{r}'=(1.5,0.5)$ and $\tilde{\sigma}=1$, when the true BHA position is at $\vec{r}=(1.0,0.2)$. An ordinate 448 represents a range of $y_m \epsilon [-2.6, 2.6]$ in the y-direction and abscissa 450 represents a range of $x_m \epsilon [-2.6, 2.6]$ in the x-direction. The location of the casings of the existing wells 52, 54, 56, and 58 in the plot 446 are marked accordingly. Weighted probability density function contour lines 452 indicate three maxima 454, 456, or 458. However, as apparent in the plot 446, the maxima 454 vastly outweighs the other two maxima 456 and 458. Thus the maxima 454 clearly represents the true location of the BHA 66, while the remaining locations 456 and 458 are clearly ghost images.

Figure 34C:
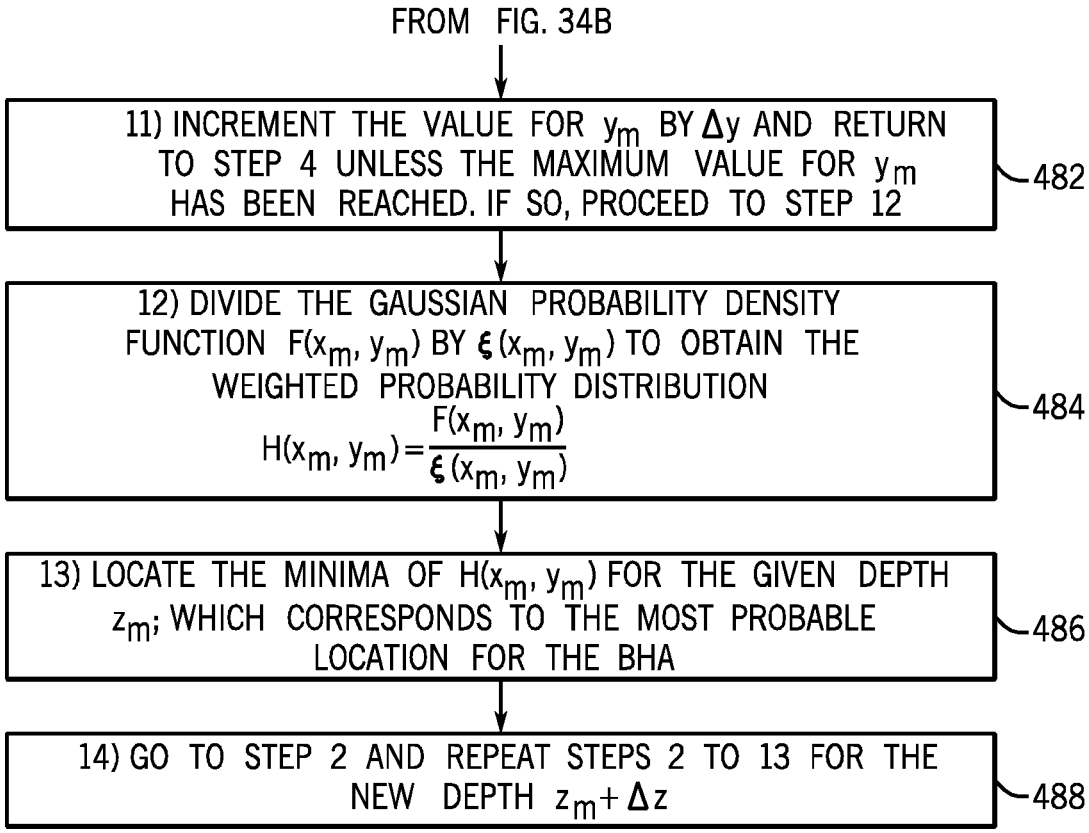
FIG. 34 A-C is a flowchart depicting a technique for determining the position of the BHA when positions of the cased wells are known, further including survey data and probability distribution function of the BHA in accordance with an aspect of the invention.

FIG. 34 represents a flowchart 460 illustrating a process for employing the weighted probability density function of equation (20) to estimate the location of the BHA 66 when the locations of the existing wells 52, 54, 56, and 58 are known. In a first step 462, the locations of cased existing wells 52, 54, 56, and 58 versus depth may be defined as $\vec{r}_i=(x_i,y_i,z_i)$ for $i=\{1, 2, 3, \ldots, n\}$, where $\vec{r}_i$ represents the assumed location of the $i^{th}$ cased well 98 and n represents the total number of nearby cased wells. The $\{\vec{r}_i\}$ will remain fixed throughout the procedure. The diameter of each cased well is similarly defined as Di. In step 464, the new well is drilled using the BHA 66 down to a depth $z_m$.

In step 466, MWD survey data may be used to obtain the probability distribution function $$F(x, y) = \frac{1}{2\pi\tilde{\sigma}^2}\exp\left\{-\frac{(x-x')^2}{2\tilde{\sigma}^2} - \frac{(y-y')^2}{2\tilde{\sigma}^2}\right\}$$

at the given depth $z_m$, where $\vec{r}'=(x',y',z_m)$ represents the most likely position of the BHA 66 determined by the survey data, where $\tilde{\sigma}=\sqrt{\sigma^2+\sigma_i^2}$, $\sigma$ represents the standard deviation in the x-y plane for the BHA 66, and $\sigma_i$ represents the standard deviation for survey data for the cased wells. Step 468, which follows, involves assuming a location for the magnetometer 94 in the BHA 66, $\vec{r}_m=x_m, y_m, z_m$, for the given depth $z_m$. As discussed further in the flowchart 460 of FIG. 34, $x_m$ and $y_m$ will be incremented over a range of values.

With further reference to the flowchart 460 of FIG. 34, in step 470, the conductance $G_i$ between the BHA 66 and each cased well may be computed according to the relationship $$G_i = \frac{\pi\sigma}{\cosh^{-1}(S_i/D)},$$

where $$S_i = \sqrt{(x_m - x_i)^2 + (y_m - y_i)^2}.$$

Similarly, the conductance may also be computed between each pair of cased wells. In both cases, the computations should take into account formation resistivity, cement resistivity, and bedding. In step 472, the current 84 on each casing, $I_i$, may be computed for the assumed position of the BHA 66, $\vec{r}_m$.

In step 474, the magnetic field 90 at the magnetometer 94 for the assumed BHA 66 position $\vec{r}_m$ may be computed according to the relationship $$\vec{B}(x_m, y_m, z_m) = \sum_{i=1}^{n} \vec{B}i(x_m, y_m, z_m) = \sum_{i=1}^{n} \frac{\mu_0 I_i(z_m)}{2\pi S_i^2}\hat{n}\times(\vec{r}_m - \vec{r}_i),$$

where $\hat{n}$ represents a unit vector in the direction of the $i^{th}$ well 98. In step 476, the induced magnetic field 90 may be measured with the three-axis magnetometer 94 to obtain the quantities $\vec{\beta}(x,y,z)=\beta x(x,y,z)\hat{x}+\beta y(x,y,z)\hat{y}+\beta z(x,y,z)\hat{z}$, where $\vec{r}=(x,y,z)$ represents the actual position of the BHA 66 which is to be determined The standard deviation in the measured magnetic field components is $\sigma_B$. Having obtained the magnetic field 90 measurements in step 476, in step 478, the quantity $$\xi(x_m, y_m, z_m) = Q(x_m, y_m, z_m)/\sigma_B = \frac{\sqrt{\begin{array}{l}[\beta x(x, y, z) - Bx(x_m, y_m, z_m)]^2 + \\ [\beta y(x, y, z) - By(x_m, y_m, z_m)]^2 + \\ [\beta z(x, y, z) - Bz(x_m, y_m, z_m)]^2\end{array}}}{\sigma_B}$$

may be computed for the assumed location for the BHA 66, $\vec{r}_m$.

Continuing to step 480 of the flowchart 460 of FIG. 34, the value for $x_m$ may be incremented by $\Delta x$. Unless the maximum value for $x_m$ has been reached, the process returns to the fourth step 468. However, if the maximum value for $x_m$ has been reached, the process continues to an eleventh step 482. In step 482, the value for $y_m$ may be incremented by $\Delta y$. Unless the maximum value for $y_m$ has been reached, the process next returns to the fourth step 468. However, if the maximum value for $y_m$ has been reached, the process continues to a twelfth step 484.

In step 484, the Gaussian probability density function $F(x_m,y_m)$ is divided by $\xi(x_m,y_m)$ to obtain the weighted probability distribution $$H(x_m, y_m) = \frac{F(x_m, y_m)}{\xi(x_m, y_m)}.$$

Using the weighted probability distribution $H(x_m,y_m)$ calculated in step 484, in step 486, the minima of $H(x_m,y_m)$ may be located for the given depth $z_m$ which corresponds to the most probable location for the BHA 66. Continuing to drill in step 488, measurement data may be obtained at a new depth $z_m+\Delta z$, before returning to the fourth step 468 to perform steps 468-486 with data obtained at the new depth. From the data obtained in the flowchart 460, the position of the BHA 66 may be estimated by locating the true position as distinguished from any ghost images which may arise.

Another approach to finding the 'best estimate' for the location of the BHA 66 is to use a method described in U.S. Pat. No. 6,736,221, assigned to Schlumberger Technology Corporation, incorporated by reference herein [NOTE: we may not be able to incorporate this patent by reference; the cited patent incorporates matter by reference in the background. I do not know whether the incorporated matter is essential.]. This technique requires covariance matrices for the positions calculated from the ranging and survey data. The covariance matrices can be evaluated by standard methods.

The previous example was based in part on the assumption that the uncertainty in the positions of the existing wells 52, 54, 56, and 58 may simply be included in the uncertainty for the BHA 66 location, and that the locations of the existing wells 52, 54, 56, and 58 may be assumed to be at the most probable locations provided by the survey data for the cased wells, i.e. $\vec{r}_i=\vec{r}'_i$. In the manner described above, the magnetic ranging data used to compute $Q(x_m,y_m)$ derived from a model in which the cased well locations are assumed to be known. In a more general case, however, this assumption may be substituted by describing the locations of the cased wells using Gaussian probability distributions.

For example, the $i^{th}$ cased well 98 may have a Gaussian probability distribution of the form represented by the following equation:

$$F_i(x'_i, y'_i) = \frac{1}{(2\pi)\sigma_i^2}\exp\left\{-\frac{(x_i - x'_i)^2}{2\sigma_i^2} - \frac{(y_i - y'_i)^2}{2\sigma_i^2}\right\}. \tag{21}$$

In equation (21) above, $\sigma_i$ represents the standard deviation, and $\vec{r}'_i=(x'_i,y'_i)$ represents the survey position of the $i^{th}$ cased well 98, which corresponds to the most probable location of the $i^{th}$ cased well 98. For simplicity, the probability distributions are assumed to be symmetric, i.e. $\sigma_{ix}=\sigma_{iy}=\sigma_i$.

Figure 35A:
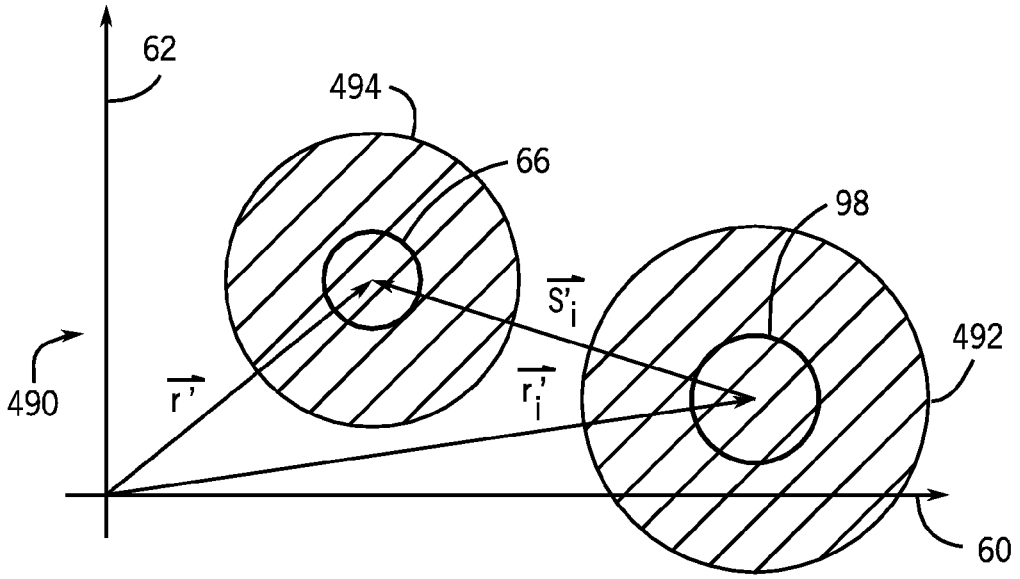
FIGS. 35A and 35B depict a position of the BHA and a cased well both associated with Gaussian probability distributions.
Figure 35B:
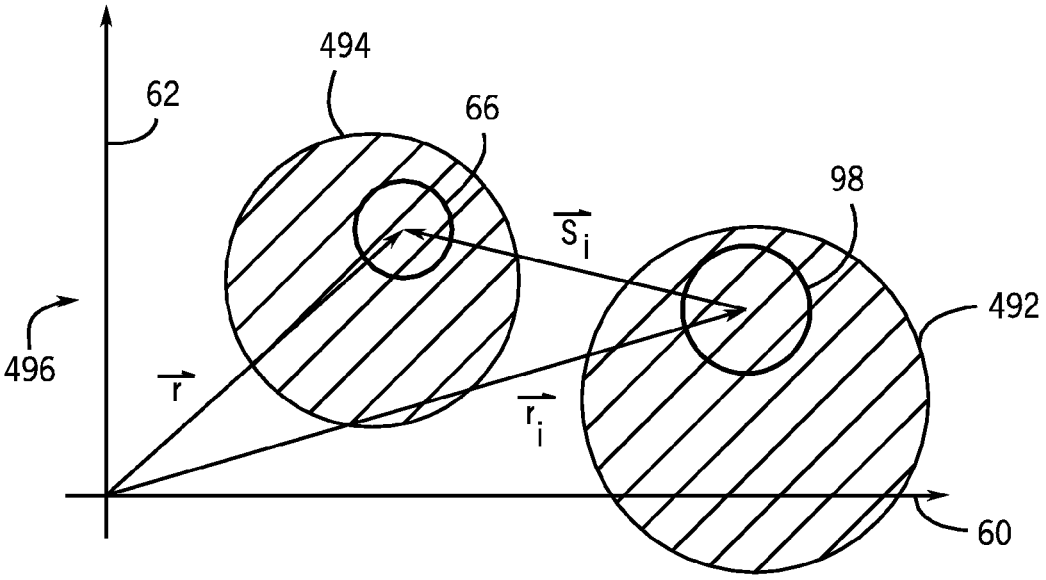

FIGS. 35A and 35B may illustrate the geometry used in estimating the location of the BHA 66 using equation (21). Turning first to FIG. 35A, a well placement schematic 490 depicts the predicted location of the BHA 66 relative to the $i^{th}$ cased well 98. The numeral 60 represents the x-axis, while the numeral 62 represents the y-axis. The survey data for the cased well 98 indicates that $r'_i$ is the most likely location for it, which is surrounded by a one sigma circle 492. Likewise, survey data for the BHA 66 indicates that $\vec{r}'$ is its most likely location of the BHA 66, which is surrounded by a one sigma circle 494. The relative displacement between the BHA 66 and the cased well is thus S=

In contrast, FIG. 35B depicts a well placement schematic 496 represents the actual location of the BHA 66 and the actual location of the $i^{th}$ cased well 98. The numeral 60 represents the x-axis, while the numeral 62 represents the y-axis. As indicated in the well placement schematic 496, the $i^{th}$ cased well 98 is actually at a different location, $\vec{r}_i=(x_i,y_i)$, and the BHA 66 is actually at a different location $\vec{r}=(x,y)$. The relative displacement between the BHA 66 and the $i^{th}$ cased well 98 is $\vec{S}_i=\vec{r}-\vec{r}_i$. Because the magnetic field 90 will be different for the two cases, i.e. when the cased well is at $\vec{r}'_i$ or $\vec{r}_i$, the procedure is more complex.

The Monte Carlo method provides one method for combining two or more probability distributions with magnetic ranging in order to avoid a collision between the BHA 66 and a cased well, and to improve the knowledge of the relative positions of the BHA 66 and any cased wells, such as the existing wells 52, 54, 56, or 58. The Monte Carlo method is a well known computational process where random numbers and a large number of calculations are performed to model a physical process. Modern computers are capable of performing large numbers of calculations rapidly. To apply the Monte Carlo method to this particular problem, a set of values is chosen for the locations of the n nearby cased wells (i.e., for $\{\vec{r}_1, \vec{r}_2, \vec{r}_3, \ldots, \vec{r}_n, \}$). The procedure described by the steps of the flowchart 460 of FIG. 34 from step 462 to step 486 may then be executed. The magnetic field 90 may be calculated for various possible positions of the BHA 66 given the set of values for $\{\vec{r}_1, \vec{r}_2, \vec{r}_3, \ldots, \vec{r}_n, \}$. The quantity $\xi(x_m,y_m)$ may be calculated and used to weight the probability distribution for the BHA 66. The result, $H_i(x_m,y_m)$, may be recorded or stored (the subscript "1" indicates that this is the first calculation). Then a different set of values for $\{\vec{r}_1, \vec{r}_2, \vec{r}_3, \ldots, \vec{r}_n, \}$ may be chosen, and the procedure described by the steps of the flowchart 460 of FIG. 34 from step 462 to step 486 may then be executed again. The result, $H_2(x_m,y_m)$, may be recorded or stored. The process may be repeated many times, but with the proviso that the probability distributions $F_i(x'_i,y'_i)$ are honored by the values chosen for $\{\vec{r}_1, \vec{r}_2, \vec{r}_3, \ldots, \vec{r}_n, \}$ For example, 68% of the random values chosen for the location of the $i^{th}$ cased well 98, located at $\{\vec{r}_i\}$, should fall within the circle of radius $\sigma_i$ that is centered on the point $\vec{r}'_i$. After a sufficiently large number of calculations (p) are performed to achieve statistical accuracy, the quantity described according to the following equation is calculated:

$$H(x_m, y_m) = \frac{1}{p}\sum_{j=1}^{p} H_j(x_m, y_m). \tag{22}$$

The results of the equation above may be plotted in a manner similar to that shown by the plot 446 of FIG. 33. The greatest of the maxima of $H(x_m,y_m)$ corresponds to the best estimate for the location of the BHA 66 amongst the n cased wells, and takes both the probability distributions and the magnetic ranging data into account. It should be appreciated that the same techniques used for determining the position of the BHA 66 relative to the n cased wells may also be used to determine the position of the n cased wells relative to the BHA 66. Thus, using MWD direction and inclination measurements from the BHA 66, combined with the above-described methods of determining apparent distance and direction to the n cased wells, the position of the n cased wells may be similarly determined.

Figure 36:
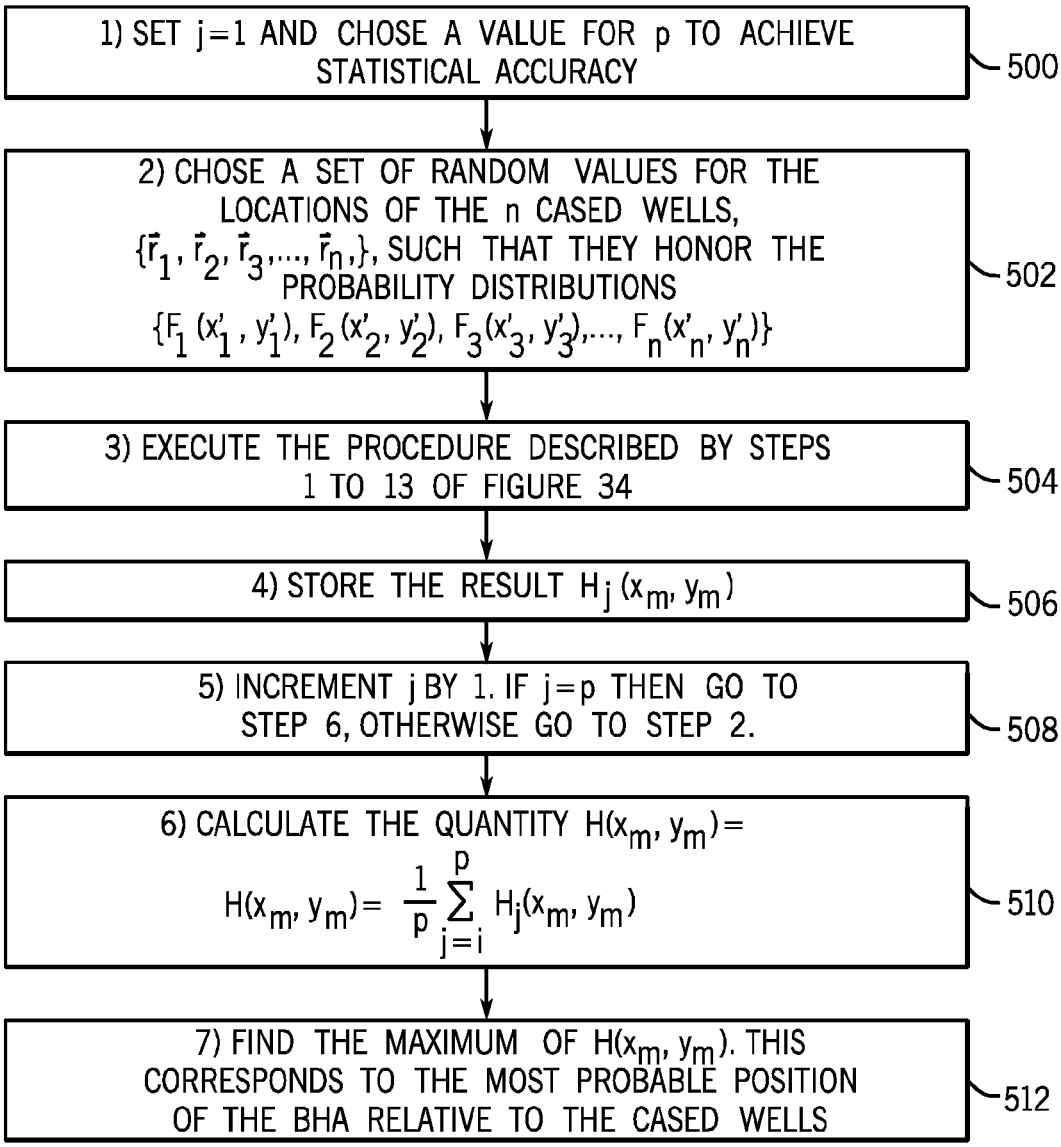
FIG. 36 is a flowchart depicting a technique for determining the position of the BHA with survey data and probability distribution functions for the BHA and for the cased wells.

FIG. 36 illustrates the procedure discussed above with a flowchart 498. In a first step 500, a for-do loop from 1 to p may be initialized by setting j=1 and choosing a value for p to achieve statistical accuracy. In step 502, a set of random values for the locations of the n cased wells, $\{\vec{r}_1, \vec{r}_2, \vec{r}_3, \ldots, \vec{r}_n, \}$, may be chosen, such that the random values honor the probability distributions $\{F_1(x'_1,y'_1), F_2(x'_2,y'_2), F_3(x'_3,y'_3), \ldots, F_n(x'_n,y'_n)\}$. Step 504 involves executing the procedure described by the steps of the flowchart 460 of FIG. 34 from step 462 to step 486.

Having obtained a result for $H_j(x_m,y_m)$ in step 504, the result $H_j(x_m,y_m)$ may be recorded and stored in a subsequent step 506. In step 508, the variable j may be incremented by 1. If j=p then the process continues to step 510. Otherwise, the process returns to step 502. In step 510, the quantity $$H(x_m, y_m) = \frac{1}{p}\sum_{j=1}^{p} H_j(x_m, y_m)$$

may be calculated, and in step 512, the greatest of the maxima of $$H(x_m, y_m) = \prod_{j=1}^{p} H_j(x_m, y_m)$$

may be ascertained. As discussed above, the greatest of the maxima of $$H(x_m, y_m) = \frac{1}{p}\sum_{j=1}^{p} H_j(x_m, y_m)$$

represents a most probable position of the BHA 66 relative to the n cased wells.

Another application is determining the location of a cased well that has inaccurate survey data or no survey data. For example, old cased wells may have been surveyed with old and less accurate equipment, or the well surveys may have been lost, or the wells may not have been surveyed at all. When drilling a new well in the proximity of such an existing well, magnetic ranging while drilling and the MWD survey data from the well being drilled can be used to establish the cased well's location. Magnetic ranging can determine the relative displacement $\vec{S}=\vec{r}'-\vec{r}_c$ of the cased well to the well being drilled. The MWD measurements provide data for the well being drilled, i.e. $\vec{r}'$—the survey position. Hence, the location of the cased well $\vec{r}_c$ is determined from $\vec{r}_c=\vec{r}'-\vec{S}$.

While these methods have been demonstrated for wells that are essentially parallel, this has been done only to simplify the equations and to provide a clear understanding of the technique. The condition of parallel wells is not essential for these methods to be applied. In particular, techniques for using magnetic ranging while drilling as applied to non-parallel wells are described in described in Published Application No. US 2007/016426 A1, Provisional Application No. 60/822,598, application Ser. No. 11/833,032, and application Ser. No. 11/781,704, each of which is assigned to Schlumberger Technology Corporation and incorporated herein by reference.

Moreover, the probability distribution functions for the well position may be three-dimensional, using arbitrary orientations of the ellipsoids for the cased wells and for the well being drilled. The probability distributions need not be Gaussian, although these are commonly used for describing oil and gas wells. Additionally, as discussed above, the above description illustratively discusses vertical wells only to simplify the mathematical analysis. When the wells are vertical, magnetic fields 90 which are induced on around the casings of the existing wells 52, 54, 56, and 58 lie in the x-y plane, while the electric currents on the BHA 66 and casings of the existing wells 52, 54, 56, and 58 flow in the ±z-direction. However, it is not necessary in general for the existing wells 52, 54, 56, and 58 to be vertical or exactly parallel. The magnetic fields induced on a non-vertical well that is not parallel to the BHA can be modeled using the techniques described in the patent applications referenced above.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. A method comprising:

drilling a new well in a field having an existing cased well using a bottom hole assembly having a drill collar having by an insulated gap;

generating a current on the bottom hole assembly such that some of the current passes through a surrounding formation and travels along a casing of the existing cased well;

measuring from the bottom hole assembly a magnetic field caused by the current traveling along the casing, of the existing cased well to determine a measurement of the magnetic field;

adjusting a trajectory of the bottom hole assembly to avoid a collision between the new well and the existing cased well based on the measurement of the magnetic field; and estimating a relative position of the new well to the existing cased well based on the measurement of the magnetic field;

wherein the relative position of the new well to the existing cased well is estimated based on the measurement of the magnetic field and a probability distribution of a probable location for the bottom hole assembly based on survey data.

2. The method of claim 1, comprising estimating an apparent distance of the new well to the existing cased well based on the measurement of the magnetic field.

3. The method of claim 2, comprising triggering an alarm if the apparent distance is less than a threshold distance.

4. The method of claim 1, comprising estimating an apparent direction of the new well to the existing cased well based on the measurement of the magnetic field.

5. The method of claim 1, wherein the relative position of the new well to the existing cased well is estimated based on the measurement of the magnetic field and the probability distribution of the probable location for the bottom hole assembly based on the survey data, wherein the survey data represents a measurement while drilling direction measurement.

6. The method of claim 1, wherein the relative position of the new well to the existing cased well is estimated based on the measurement of the magnetic field and the probability distribution of the probable location for the bottom hole assembly based on the survey data, wherein the survey data represents inclination survey data from a wireline gyroscope survey.

7. The method of claim 1, wherein the relative position of the new well to the existing cased well is estimated based on the measurement of the magnetic field, the probability distribution of the probable location for the bottom hole assembly based on survey data, and a probability distribution of a probable location for the existing cased well based on survey data.

8. The method of claim 1, wherein the method is performed in the recited order.

9. A method comprising:

drilling a new well in a field having a plurality of existing cased wells using a bottom hole assembly having a drill collar having by an insulated gap generating a current on the bottom hole assembly such that some of the current passes through a surrounding formation and travels along casings oldie plurality of existing cased wells;

measuring a magnetic field resulting from the current traveling along the casings of the plurality of the existing cased wells to determine a measurement of the magnetic field; and determining a plurality of probable locations for the bottom hole assembly based on the measurement of the magnetic field.

10. The method of claim 9, wherein drilling the new well comprises drilling the new well in the field such that the new well is surrounded by the plurality of existing cased wells.

11. The method of claim 9, wherein the plurality of probable locations for the bottom hole assembly is determined based on a comparison of the measurement of the magnetic field to a plurality of theoretical magnetic field values.

12. The method of claim 11, wherein the plurality of probable locations for the bottom hole assembly is based on the quantity, which is based on the following relationship:

$$Q(x_m, y_m) = \sqrt{[\beta x(x, y) - Bx(x_m, y_m)]^2 + [\beta y(x, y) - By(x_m, y_m)]^2}\ .$$

13. The method of claim 11, wherein the plurality of probable locations for the bottom hole assembly is based on the quantity $\xi(x_m, y_m)$, which is based on the following relationships:

$$\xi(x_m, y_m) = Q(x_m, y_m)/\sigma_B;$$

$$Q(x_m, y_m) = \sqrt{[\beta x(x, y) - Bx(x_m, y_m)]^2 + [\beta y(x, y) - By(x_m, y_m)]^2}\ .$$

14. The method of claim 9, wherein the plurality of probable locations for the bottom hole assembly is determined based on a weighted probability density function accounting for survey data.

15. The method of claim 14, wherein the plurality of probable locations for the bottom hole assembly is determined based on the following weighted probability density function:

$$F(x, y, z) = \frac{1}{(2\pi)^{3/2}\sigma_x\sigma_y\sigma_z}\exp\left\{-\frac{(x-x')^2}{2(\sigma_x)^2} - \frac{(y-y')^2}{2(\sigma_y)^2} - \frac{(z-z')^2}{2(\sigma_z)^2}\right\}.$$

16. The method of claim 15, wherein planning to drill the new well comprises planning to measure a magnetic field generated by a current on the at least one existing cased well.

17. The method of claim 14, comprising choosing a most probable location for the bottom hole assembly from among the plurality of probable locations for the bottom hole assembly, wherein the most probable location for the bottom hole assembly is located at a minimum of the weighted probability density function.

18. The method of claim 17, wherein choosing the most probable location for the bottom hole assembly from among the plurality of probable locations for the bottom hole assembly comprises choosing the a minimum of the weighted probability density function $H(x_m, y_m)$ based on the following relationships:

$$H(x, y) = \frac{F(x, y)}{\xi(x, y)};$$

$$F(x, y) = \frac{1}{2\pi\tilde{\sigma}^2}\exp\left\{-\frac{(x-x')^2}{2\tilde{\sigma}^2} - \frac{(y-y')^2}{2\tilde{\sigma}^2}\right\};$$

$$\xi(x_m, y_m, z_m) = \frac{\sqrt{\begin{array}{l}[\beta x(x, y, z) - Bx(x_m, y_m, z_m)]^2 + \\ [\beta y(x, y, z) - By(x_m, y_m, z_m)]^2 + \\ [\beta z(x, y, z) - Bz(x_m, y_m, z_m)]^2\end{array}}}{\sigma_B}.$$

19. The method of claim 14, wherein planning to drill the new well comprises planning to drill the new well using a bottom hole assembly configured for magnetic ranging while drilling.

20. A well in a field having at least one existing eased well, the well drilled using the method of claim 14.

21. The method of claim 9, comprising performing the method at a plurality of depths.

22. The method of claim 21, comprising determining an apparent direction of the bottom hole assembly to a nearest of the plurality of existing cased wells associated with each of the plurality of probable locations for the bottom hole assembly based on the measurement of the magnetic field.

23. The method of claim 22, comprising choosing a most probable location for the bottom hole assembly from among the plurality of probable locations for the bottom hole assembly using the apparent direction associated, with each of the plurality of probable locations for the bottom hole assembly.

24. The method of claim 23, comprising estimating a relative position of the vertical section of the new well to the plurality of vertical sections of the plurality of existing cased wells based on the measurement of the magnetic field.

25. The method of claim 23, wherein the vertical section of the new well is drilled within at least one of the ellipsoid of uncertainty of the plurality of vertical sections of the plurality of existing cased wells.

* * * * *